US011511169B2

(12) United States Patent
Schweigert et al.

(10) Patent No.: US 11,511,169 B2
(45) Date of Patent: Nov. 29, 2022

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Bradley D. Schweigert, Cave Creek, AZ (US); Michael R. Nicolette, Scottsdale, AZ (US); Caleb S. Kroloff, Phoenix, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 17/344,705

(22) Filed: Jun. 10, 2021

(65) Prior Publication Data

US 2021/0299527 A1 Sep. 30, 2021

Related U.S. Application Data

(63) Continuation-in-part of application No. 16/940,806, filed on Jul. 28, 2020, now Pat. No. 11,141,635, and (Continued)

(51) Int. Cl.

| | |
|---|---|
| ***A63B 53/04*** | (2015.01) |
| ***A63B 53/06*** | (2015.01) |
| ***A63B 60/02*** | (2015.01) |

(52) U.S. Cl.

CPC ..... *A63B 53/0487* (2013.01); *A63B 53/065* (2013.01); *A63B 60/02* (2015.10); (Continued)

(58) Field of Classification Search

CPC ..... A63B 53/0487

(Continued)

(56) References Cited

U.S. PATENT DOCUMENTS 922,444 A 5/1909 Youds
1,703,199 A * 2/1929 McClure ..... A63B 53/0487 473/340

(Continued)

FOREIGN PATENT DOCUMENTS

FR 2834647 A1 * 7/2003 ..... A63B 53/02
JP H09271542 A * 10/1997

(Continued)

OTHER PUBLICATIONS

TourSpecGolf (Golds Factory Multi Weighted Custom Putter) [online]. Nov. 20, 2010 [retrieved May 8, 2019] Retrieved from the internet: URL: http://www .tourspecgolf .com/blog/golds-factory-multi-weighted-custom-putter/.

(Continued)

*Primary Examiner* — Alvin A Hunter

(57) ABSTRACT

Examples of golf clubs and methods to manufacture golf clubs are generally described herein. In one example, a golf club may include a golf club head, a hosel portion, and a shaft. The hosel portion may be positioned rearward of a center of gravity of the body portion. The shaft portion may be coupled to the hosel portion and may have a first shaft portion and a second shaft portion. The first shaft portion may extend from the hosel portion and tilt toward the face portion with no lateral tilt toward a toe portion or a heel portion of the body portion. The second shaft portion may extend from the first shaft portion toward the heel portion and toward a face portion of the body portion. Other examples of golf club heads and methods to manufacture the same may be described and claimed.

17 Claims, 23 Drawing Sheets

Related U.S. Application Data a continuation-in-part of application No. 16/866,991, filed on May 5, 2020, now Pat. No. 11,173,361, and a continuation of application No. 16/751,500, filed on Jan. 24, 2020, now Pat. No. 11,045,698, and a continuation-in-part of application No. 16/674,332, filed on Nov. 5, 2019, now Pat. No. 11,131,781, said application No. 16/866,991 is a continuation-in-part of application No. 16/400,128, filed on May 1, 2019, now Pat. No. 10,688,355, and a continuation of application No. 16/283,390, filed on Feb. 22, 2019, now Pat. No. 10,646,758, said application No. 16/674,332 is a continuation of application No. 16/275,883, filed on Feb. 14, 2019, now Pat. No. 10,493,331, said application No. 16/751,500 is a continuation-in-part of application No. 16/035,271, filed on Jul. 13, 2018, now Pat. No. 10,576,339, said application No. 16/940,806 is a continuation of application No. 16/006,055, filed on Jun. 12, 2018, now Pat. No. 10,737,153, and a continuation-in-part of application No. 15/987,731, filed on May 23, 2018, now Pat. No. 10,821,341, which is a continuation-in-part of application No. 15/922,506, filed on Mar. 15, 2018, now abandoned, and a continuation-in-part of application No. 15/831,151, filed on Dec. 4, 2017, now Pat. No. 10,478,680, and application No. 16/400,128, which is a continuation of application No. 15/816,517, filed on Nov. 17, 2017, now Pat. No. 10,315,080, said application No. 15/987,731 is a continuation-in-part of application No. 15/489,366, filed on Apr. 17, 2017, now Pat. No. 10,124,221, said application No. 15/987,731 is a continuation-in-part of application No. 15/188,661, filed on Jun. 21, 2016, now Pat. No. 10,441,858, said application No. 15/165,517 is a continuation of application No. 15/150,006, filed on May 9, 2016, now Pat. No. 10,258,845, said application No. 15/489,366 is a continuation of application No. 15/078,749, filed on Mar. 23, 2016, now Pat. No. 9,649,540, said application No. 16/283,390 is a continuation of application No. 14/962,953, filed on Dec. 8, 2015, now Pat. No. 10,258,844, said application No. 15/188,661 is a continuation of application No. 14/812,212, filed on Jul. 29, 2015, now Pat. No. 9,387,375, said application No. 14/962,953 is a continuation-in-part of application No. 14/686,466, filed on Apr. 14, 2015, now Pat. No. 9,233,283, said application No. 15/150,006 is a continuation-in-part of application No. 14/586,720, filed on Dec. 30, 2014, now Pat. No. 9,440,124.

(60) Provisional application No. 62/798,277, filed on Jan. 29, 2019, provisional application No. 62/755,241, filed on Nov. 2, 2018, provisional application No. 62/745,194, filed on Oct. 12, 2018, provisional application No. 62/659,060, filed on Apr. 17, 2018, provisional application No. 62/644,233, filed on Mar. 16, 2018, provisional application No. 62/574,071, filed on Oct. 18, 2017, provisional application No. 62/536,266, filed on Jul. 24, 2017, provisional application No. 62/533,481, filed on Jul. 17, 2017, provisional application No. 62/518,715, filed on Jun. 13, 2017, provisional application No. 62/480,338, filed on Mar. 31, 2017, provisional application No. 62/431,157, filed on Dec. 7, 2016, provisional application No. 62/213,933, filed on Sep. 3, 2015, provisional application No. 62/212,462, filed on Aug. 31, 2015, provisional application No. 62/146,114, filed on Apr. 10, 2015, provisional application No. 62/138,925, filed on Mar. 26, 2015, provisional application No. 62/059,108, filed on Oct. 2, 2014, provisional application No. 62/041,553, filed on Aug. 25, 2014, provisional application No. 62/030,820, filed on Jul. 30, 2014, provisional application No. 62/015,297, filed on Jun. 20, 2014, provisional application No. 61/992,379, filed on May 13, 2014, provisional application No. 61/985,351, filed on Apr. 28, 2014.

(52) U.S. Cl.
CPC ..... *A63B 53/047* (2013.01); *A63B 53/0408* (2020.08); *A63B 53/0437* (2020.08); *A63B 53/0441* (2020.08); *A63B 53/0466* (2013.01); *A63B 2053/0491* (2013.01)

(58) Field of Classification Search
USPC ..... 473/324–350
See application file for complete search history.

(56) References Cited

U.S. PATENT DOCUMENTS

| | | | | | |
|---|---|---|---|---|---|
| RE19,178 | E | | 5/1934 | Spiker | |
| 4,043,562 | A | | 8/1977 | Shillington | |
| 4,340,230 | A | | 7/1982 | Churchward | |
| 4,754,977 | A | | 7/1988 | Sahm | |
| 4,869,507 | A | | 9/1989 | Sahm | |
| 5,137,275 | A | | 8/1992 | Nelson | |
| D335,317 | S | | 5/1993 | Shearer | |
| D335,692 | S | | 5/1993 | Antonious | |
| D336,757 | S | | 6/1993 | Antonious | |
| 5,275,412 | A | | 1/1994 | Innes | |
| D350,582 | S | | 9/1994 | Miansian et al. | |
| 5,429,366 | A | | 7/1995 | McCabe | |
| D363,101 | S | | 10/1995 | Sturm | |
| 5,454,563 | A | | 10/1995 | Nagamoto et al. | |
| D365,864 | S | | 1/1996 | Sturm | |
| 5,489,097 | A | | 2/1996 | Simmons | |
| D368,751 | S | | 4/1996 | Rife | |
| D369,393 | S | | 4/1996 | Takahashi et al. | |
| 5,544,879 | A | | 8/1996 | Collins | |
| 5,571,053 | A | | 11/1996 | Lane | |
| D378,688 | S | | 4/1997 | Cameron | |
| 5,630,766 | A | * | 5/1997 | Granelli | A63B 53/02 473/328 |
| 5,665,011 | A | * | 9/1997 | Thomas | A63B 53/0487 473/340 |
| D385,609 | S | | 10/1997 | Cameron | |
| 5,683,307 | A | | 11/1997 | Rife | |
| 5,685,784 | A | * | 11/1997 | Butler | A63B 53/0487 473/340 |
| D388,143 | S | | 12/1997 | Huan-Chiang | |
| D389,207 | S | | 1/1998 | Cameron | |
| 5,720,671 | A | | 2/1998 | Cheng | |
| 5,749,793 | A | | 5/1998 | Lucetti | |
| 5,759,114 | A | * | 6/1998 | Bluto | A63B 53/0487 473/340 |
| 5,785,608 | A | * | 7/1998 | Collins | A63B 53/0487 473/294 |
| D398,685 | S | | 9/1998 | Masuda | |
| D399,290 | S | | 10/1998 | Sizemore, Jr. | |
| D399,911 | S | | 10/1998 | Nicolette et al. | |
| 5,839,974 | A | | 11/1998 | McAllister | |
| D401,991 | S | * | 12/1998 | Collins | D21/744 |
| D405,836 | S | | 2/1999 | Nicolette et al. | |
| 5,890,969 | A | * | 4/1999 | Bechler | A63B 60/02 473/340 |
| D409,701 | S | | 5/1999 | Ashcraft et al. | |
| 5,924,938 | A | | 7/1999 | Hines | |
| 6,007,434 | A | | 12/1999 | Baker et al. | |

(56) References Cited

U.S. PATENT DOCUMENTS 6,039,656 A 3/2000 Fireman
D422,655 S 4/2000 Hicks
6,045,453 A * 4/2000 Jenkins ..... A63B 53/047 473/340
6,050,903 A 4/2000 Lake
D426,276 S 6/2000 Besnard et al.
D431,854 S 10/2000 Cameron
D432,192 S 10/2000 Hicks
D434,821 S * 12/2000 Farrar ..... D21/746
D436,151 S 1/2001 Nicolette et al.
D437,374 S 2/2001 Cameron
D441,820 S 5/2001 Nicolette et al.
D443,668 S 6/2001 Nicolette et al.
D443,905 S 6/2001 Nicolette et al.
D444,833 S 7/2001 Wells et al.
6,264,571 B1 7/2001 Lekavich
6,267,689 B1 * 7/2001 Ambrose ..... A63B 60/14 473/340
D449,664 S 10/2001 Beebe et al.
D449,865 S 10/2001 Fife, Jr. et al.
D450,799 S 11/2001 Nicolette et al.
D451,973 S 12/2001 Wells et al.
6,348,014 B1 2/2002 Chiu
6,350,208 B1 * 2/2002 Ford ..... A63B 53/007 473/340
D454,933 S * 3/2002 Shenoha ..... D21/757
6,354,959 B1 3/2002 Nicolette et al.
6,394,910 B1 5/2002 McCarthy
6,497,626 B1 * 12/2002 Sundberg ..... A63B 53/02 473/340
6,497,628 B1 * 12/2002 Gunderson ..... A63B 60/00 473/340
D472,949 S 4/2003 Serrano
D474,821 S 5/2003 Wells et al.
D474,949 S 5/2003 Schaffeld et al.
D483,086 S 12/2003 Schweigert et al.
6,659,883 B2 12/2003 Nelson et al.
D486,872 S 2/2004 Schweigert et al.
6,695,708 B2 * 2/2004 Fisher ..... A63B 53/02 473/340
D488,200 S 4/2004 Olsavsky et al.
6,767,292 B1 * 7/2004 Skalla, Sr. ..... A63B 53/007 473/340
D498,276 S 11/2004 Schweigert et al.
6,902,496 B2 6/2005 Solheim et al.
D512,116 S 11/2005 Miraflor et al.
6,988,956 B2 1/2006 Cover et al.
6,997,819 B2 2/2006 Naylor et al.
D520,088 S 5/2006 Parr
7,077,760 B2 7/2006 Gray
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,396,289 B2 7/2008 Soracco et al.
7,416,494 B2 8/2008 Edel
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert et al.
7,491,131 B2 2/2009 Vinton
D595,793 S 7/2009 Rollinson
D599,425 S 9/2009 Laub
D600,763 S 9/2009 Cameron
7,607,991 B2 * 10/2009 Sorenson ..... A63B 53/0487 473/328
7,744,485 B2 6/2010 Jones et al.
D620,993 S 8/2010 Laub
D621,461 S 8/2010 Serrano et al.
D623,709 S 9/2010 Serrano et al.
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.
D642,643 S 8/2011 Nicolette et al.
D643,485 S 8/2011 Nicolette et al.
D645,104 S 9/2011 Nicolette et al.
8,096,039 B2 1/2012 Soracco et al.
D653,718 S 2/2012 Stokke et al.
D661,753 S 6/2012 Cameron et al.
D666,260 S 8/2012 Cynn
8,371,958 B2 2/2013 Treadwell
8,376,878 B2 2/2013 Bennett et al.
D688,339 S 8/2013 Hilton et al.
D688,341 S 8/2013 Rollinson
D691,226 S 10/2013 Hilton et al.
D699,308 S 2/2014 Rollinson
8,696,492 B1 4/2014 Hocknell et al.
D704,782 S 5/2014 Rollinson
8,721,472 B2 5/2014 Kuan et al.
8,790,193 B2 7/2014 Serrano et al.
D711,483 S 8/2014 Wong
D715,388 S 10/2014 Serrano et al.
8,870,674 B1 10/2014 Abbott
8,905,857 B1 * 12/2014 Eckhart ..... A63B 69/3685 473/307
D722,350 S 2/2015 Schweigert
D722,351 S 2/2015 Parsons et al.
D722,352 S 2/2015 Nicolette et al.
D723,120 S 2/2015 Nicolette
D724,164 S 3/2015 Schweigert et al.
D725,208 S 3/2015 Schweigert
D726,265 S 4/2015 Nicolette
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
9,108,088 B2 8/2015 Serrano et al.
D738,447 S 9/2015 Schweigert
D738,449 S 9/2015 Schweigert
D739,487 S 9/2015 Schweigert
D741,426 S 10/2015 Schweigert
D748,213 S 1/2016 Parsons et al.
D748,215 S 1/2016 Parsons et al.
9,272,193 B1 3/2016 Yim
D753,252 S 4/2016 Schweigert
9,604,108 B1 * 3/2017 Dunnell ..... A63B 60/02
9,808,680 B1 11/2017 Myers et al.
10,293,237 B1 * 5/2019 Hilton ..... A63B 53/065
11,045,698 B2 * 6/2021 Schweigert ..... A63B 53/0487
2002/0065144 A1 * 5/2002 Helmstetter ..... C08G 18/10 473/340
2002/0077193 A1 6/2002 Takeda
2002/0132683 A1 * 9/2002 Buchanan ..... A63B 53/0487 473/340
2003/0013546 A1 * 1/2003 Bradford ..... A63B 60/02 473/341
2003/0069081 A1 * 4/2003 Jung ..... A63B 53/04 473/340
2003/0092503 A1 * 5/2003 Snowdon ..... A63B 53/065 473/340

(56) References Cited

U.S. PATENT DOCUMENTS

2003/0162599 A1* 8/2003 Klein ..... A63B 53/007 473/316
2003/0199332 A1* 10/2003 Lindsay ..... A63B 60/00 473/305
2003/0228925 A1* 12/2003 Rohrer ..... A63B 60/02 473/340
2004/0014532 A1 1/2004 Lee et al.
2004/0138003 A1 7/2004 Grace
2004/0173964 A1* 9/2004 Pollman ..... A63B 53/0487 473/340
2004/0180730 A1 9/2004 Franklin et al.
2004/0214659 A1* 10/2004 Lindsay ..... A63B 53/0487 473/340
2005/0096152 A1* 5/2005 Kuo ..... A63B 53/007 473/340
2005/0096153 A1* 5/2005 Stoakes ..... A63B 53/0487 473/340
2005/0130758 A1* 6/2005 Riseley ..... A63B 53/0487 473/251
2005/0221908 A1* 10/2005 Gornall ..... A63B 53/007 473/285
2005/0261080 A1* 11/2005 Bradford ..... A63B 53/065 473/340
2006/0009305 A1 1/2006 Lindsay
2006/0052178 A1 3/2006 Franklin et al.
2006/0094522 A1 5/2006 Tang et al.
2006/0223649 A1 10/2006 Rife
2007/0129163 A1 6/2007 Solari
2007/0135232 A1 6/2007 Billings
2007/0142122 A1 6/2007 Bonneau
2007/0207875 A1 9/2007 Kuan et al.
2007/0238548 A1 10/2007 Johnson
2007/0259734 A1* 11/2007 Pollman ..... A63B 53/007 473/340
2008/0139333 A1 6/2008 Klein
2008/0146372 A1 6/2008 John
2008/0176672 A1 7/2008 Roach et al.
2009/0029800 A1 1/2009 Jones et al.
2009/0163287 A1 6/2009 Vald'Via et al.
2009/0239678 A1 9/2009 Cruz et al.
2009/0280925 A1* 11/2009 Ines ..... A63B 53/0487 473/340
2010/0035700 A1 2/2010 Yu et al.
2010/0184527 A1* 7/2010 Demkowski ..... A63B 53/04 473/340
2010/0222153 A1* 9/2010 Treadwell ..... A63B 53/12 473/282
2010/0255922 A1 10/2010 Lueders
2010/0317454 A1 12/2010 Sato et al.
2011/0165959 A1 7/2011 Klein
2012/0034990 A1 2/2012 Cohen et al.
2013/0165256 A1 6/2013 Stevenson
2013/0210537 A1 8/2013 Ainscough et al.
2014/0378243 A1* 12/2014 Sanyal ..... A63B 60/52 473/313
2015/0306477 A1 10/2015 Parsons et al.
2016/0016050 A1 1/2016 Rife
2016/0199703 A1* 7/2016 Parsons ..... A63B 60/02 473/335
2016/0346649 A1 12/2016 Jertson et al.
2018/0001163 A1 1/2018 Becktor et al.
2018/0318674 A1* 11/2018 Schweigert ..... A63B 53/0487
2018/0361206 A1 12/2018 Becktor et al.
2020/0155909 A1* 5/2020 Schweigert ..... A63B 53/02
2020/0353327 A1* 11/2020 Schweigert ..... A63B 53/065
2021/0299527 A1* 9/2021 Schweigert ..... A63B 53/065

FOREIGN PATENT DOCUMENTS

JP 2005160691 A 6/2005
KR 20170118254 A * 10/2017
WO WO-03020372 A2 * 3/2003 ..... A63B 53/02
WO 2006087846 A1 8/2006
WO WO-2011043708 A1 * 4/2011 ..... A63B 53/0487
WO WO-2012036991 A * 3/2012 ..... A63B 53/007
WO WO-2014145547 A2 * 9/2014 ..... A63B 53/02

OTHER PUBLICATIONS

U.S. Appl. No. 29/523,587, Schweigert, "Golf Club Head," filed Apr. 102015.

* cited by examiner

GOLF CLUB HEADS AND METHODS TO MANUFACTURE GOLF CLUB HEADS

CROSS REFERENCE

This application is a continuation-in-part of application Ser. No. 16/866,991, filed May 5, 2020, which is a continuation of application Ser. No. 16/283,390, filed Feb. 22, 2019, now U.S. Pat. No. 10,646,758, which is a continuation of application Ser. No. 14/962,953, filed Dec. 8, 2015, now U.S. Pat. No. 10,258,844, which is a continuation of application Ser. No. 14/686,466, filed Apr. 14, 2015, now U.S. Pat. No. 9,233,283, which claims the benefit of U.S. Provisional Application No. 61/985,351, filed Apr. 28, 2014, U.S. Provisional Application No. 61/992,379, filed May 13, 2014, U.S. Provisional Application No. 62/015,297, filed Jun. 20, 2014, U.S. Provisional Application No. 62/030,820, filed Jul. 30, 2014, and U.S. Provisional Application No. 62/059,108, filed Oct. 2, 2014.

U.S. patent application Ser. No. 16/866,991, filed May 5, 2020, is a continuation-in-part of application Ser. No. 16/400,128, filed May 1, 2019, now U.S. Pat. No. 10,688,355, which is a continuation of application Ser. No. 15/816,517, filed Nov. 17, 2017, now U.S. Pat. No. 10,315,080, which is a continuation of application Ser. No. 15/150,006, filed May 9, 2016, now U.S. Pat. No. 10,258,845, which is a continuation-in-part of application Ser. No. 14/586,720, filed Dec. 30, 2014, now U.S. Pat. No. 9,440,124, which claims the benefit of U.S. Provisional Application No. 62/041,553, filed Aug. 25, 2014.

This application is a continuation-in-part of application Ser. No. 16/940,806, filed Jul. 28, 2020, which is a continuation of U.S. application Ser. No. 16/006,055, filed Jun. 12, 2018, now U.S. Pat. No. 10,737,153, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, U.S. Provisional Application No. 62/644,233, filed Mar. 16, 2018, and U.S. Provisional Application No. 62/659,060, filed Apr. 17, 2018.

U.S. patent application Ser. No. 16/940,806, filed Jul. 28, 2020, is a continuation-in-part of application Ser. No. 15/987,731, filed May 23, 2018, now U.S. Pat. No. 10,821,341, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, and U.S. Provisional Application No. 62/574,071, filed Oct. 18, 2017.

U.S. application Ser. No. 15/987,731 is a continuation-in-part of application Ser. No. 15/188,661, filed Jun. 21, 2016, now U.S. Pat. No. 10,441,858, which is a continuation of application Ser. No. 14/812,212, filed Jul. 29, 2015, now U.S. Pat. No. 9,387,375, which claims the benefit of U.S. Provisional Application No. 62/030,820, filed Jul. 30, 2014, and U.S. Provisional Application No. 62/146,114, filed Apr. 10, 2015.

U.S. application Ser. No. 15/987,731 is a continuation-in-part of application Ser. No. 15/489,366, filed Apr. 17, 2017, now U.S. Pat. No. 10,124,212, which is a continuation of application Ser. No. 15/078,749, filed Mar. 23, 2016, now U.S. Pat. No. 9,649,540, which claims the benefit of U.S. Provisional Application No. 62/138,925, filed Mar. 26, 2015, U.S. Provisional Application No. 62/212,462, filed Aug. 31, 2015, and U.S. Provisional Application No. 62/213,933, filed Sep. 3, 2015.

U.S. application Ser. No. 15/987,731 is a continuation-in-part of application Ser. No. 15/831,151, filed Dec. 4, 2017, now U.S. Pat. No. 10,478,680, which claims the benefit of U.S. Provisional Application No. 62/431,157, filed Dec. 7, 2016.

U.S. application Ser. No. 15/987,731 is a continuation-in-part of application Ser. No. 15/922,506, filed Mar. 15, 2018, now abandoned, which claims the benefit of U.S. Provisional Application No. 62/480,338, filed Mar. 31, 2017.

This application is a continuation-in-part of application Ser. No. 16/674,332, filed Nov. 5, 2019, which is a continuation of application Ser. No. 16/275,883, filed Feb. 14, 2019, now U.S. Pat. No. 10,493,331, which claims the benefit of U.S. Provisional Application No. 62/745,194, filed Oct. 12, 2018, and U.S. Provisional Application No. 62/755,241, filed Nov. 2, 2018.

This application is a continuation of application Ser. No. 16/751,500, filed Jan. 24, 2020, which claims the benefit of U.S. Provisional Application No. 62/798,277, filed Jan. 29, 2019.

U.S. application Ser. No. 16/751,500 is a continuation-in-part of application Ser. No. 16/035,271, filed Jul. 13, 2018, now U.S. Pat. No. 10,576,339, which claims the benefit of U.S. Provisional Application No. 62/533,481, filed Jul. 17, 2017.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve performance of an individual. Various alignment aids have been used on golf club heads to improve visual alignment.

Figure 1:
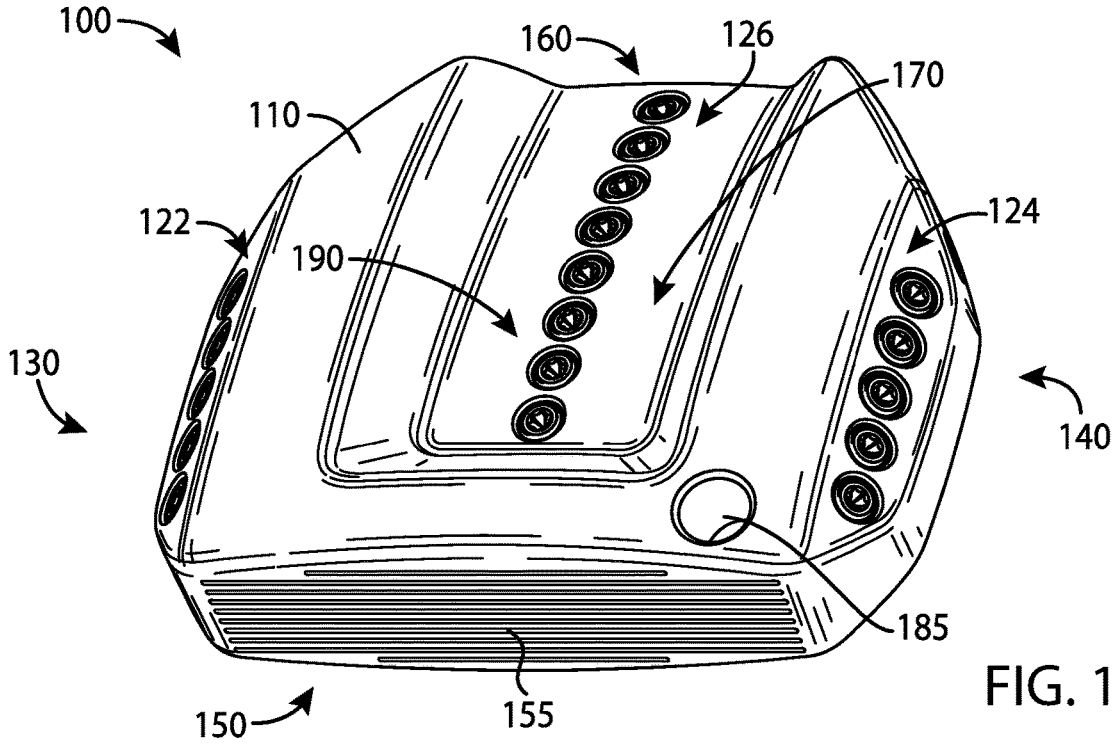
FIG. 1 depicts a front and top perspective view of a golf club head according to an example of the apparatus, methods, and articles of manufacture described herein.
Figure 2:
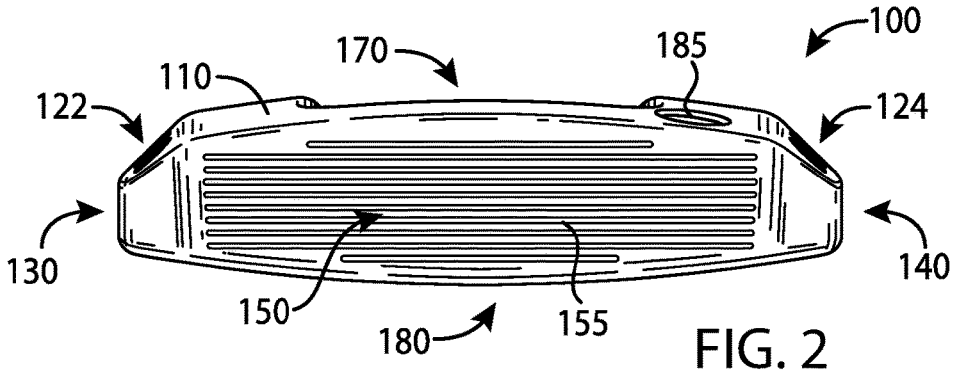
FIG. 2 depicts a front view of the example golf club head of FIG. 1.
Figure 3:
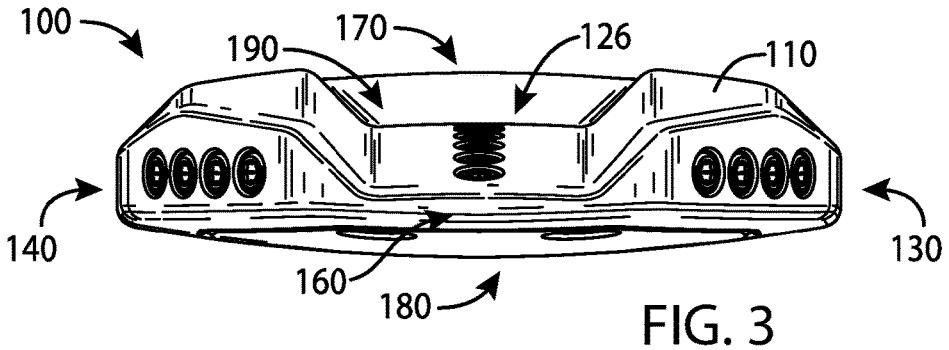
FIG. 3 depicts a rear view of the example golf club head of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIGS. 1-13, a golf club head 100 may include a body portion 110 and a visual guide portion, which is generally shown as a first visual guide portion 122, a second visual guide portion 124, and a third visual guide portion 126. The body portion 110 may include a toe portion 130, a heel portion 140, a front portion 150, a rear portion 160, a top portion 170, and a sole portion 180. The body portion 110 may also include a bore 185 to receive a shaft (not shown) with a grip (not shown). Alternatively, the body portion 110 may include a hosel (not shown) to receive the shaft. The golf club head 100 and the grip may be located on opposite ends of the shaft to form a golf club. The apparatus, methods, and articles of manufacture described herein are not limited in this regard.

The body portion 110 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 110 may be partially or entirely made of a non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. The apparatus, methods, and articles of manufacture described herein are not limited in this regard.

The toe and heel portions 130 and 140, respectively, may be on opposite ends of the body portion 110 and may define a width of the body portion 110. The front and rear portions 150 and 160, respectively, may be on opposite ends of the body portion 110 and may define a length of the body portion 110. The front portion 150 may include a face portion 155 (e.g., a strike face), which may be used to impact a golf ball (not shown). The face portion 155 may be an integral portion of the body portion 110. Alternatively, the face portion 155 may be a separate piece or an insert coupled to the body portion 110 via various manufacturing and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The apparatus, methods, and articles of manufacture described herein are not limited in this regard.

Figure 8:
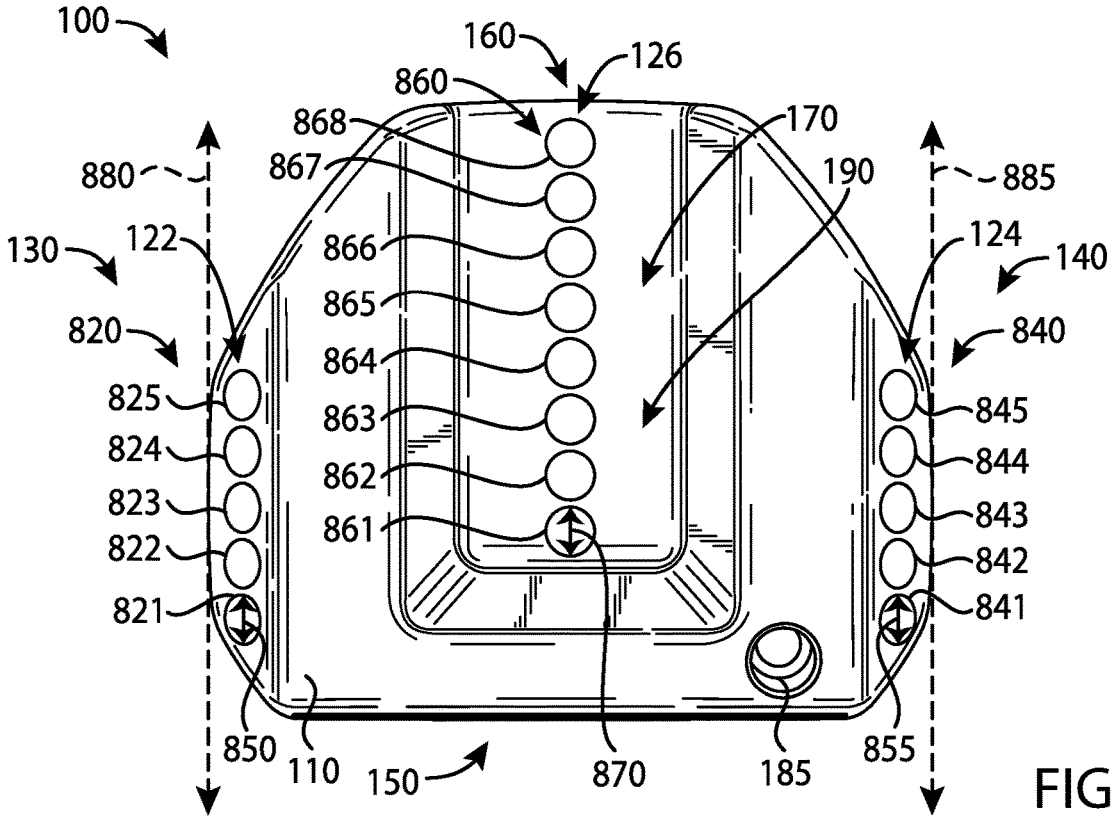
FIG. 8 depicts a top view of a body portion of the example golf club head of FIG. 1.

As illustrated in FIG. 8, for example, the body portion 110 may include two or more weight ports, generally shown as a first set of weight ports 820 (e.g., shown as weight ports 821, 822, 823, 824, and 825) to form the first visual guide portion 122 and a second set of weight ports 840 (e.g., shown as weight ports 841, 842, 843, 844, and 845) to form the second visual guide portion 124. The first and second sets of weight ports 820 and 840, respectively, may be exterior weight ports configured to receive one or more weight portions (e.g., one shown as 1000 in FIG. 10). In particular, the first and second sets of weight ports 820 and 840 may be located at or proximate to a periphery of the golf club head 100. For example, the first and second sets of weight ports 820 and 840, respectively, may be on or proximate to the top portion 170. The first set of weight ports 820 may be at or proximate to the toe portion 130 whereas the second set of weight ports 840 may be at or proximate to the heel portion 140. The apparatus, methods, and articles of manufacture described herein are not limited in this regard.

Each weight port of the first set of weight ports 820 may have a first port diameter ($PD_1$) 850. In particular, a uniform distance of less than the first port diameter 850 may separate any two adjacent weight ports of the first set of weight ports 820 (e.g., (i) weight ports 821 and 822, (ii) weight ports 822 and 823, (iii) weight ports 823 and 824, or (iv) weight ports 824 and 825). In one example, the first port diameter 850 may be about 0.25 inch (6.35 millimeters) and any two adjacent weight ports of the first set of weight ports 820 may be separated by 0.1 inch (2.54 millimeters). In a similar manner, each weight port of the second set of weight ports 840 may have a second port diameter ($PD_2$) 855. A uniform distance of less than the second port diameter 855 may separate any two adjacent weight ports of the second set of weight ports 840 (e.g., (i) weight ports 841 and 842, (ii) weight ports 842 and 843, (iii) weight ports 843 and 844, or (iv) weight ports 844 and 845). For example, the second port diameter 855 may be about 0.25 inch (6.35 millimeters) and any two adjacent weight ports of the second set of weight ports 840 may be separated by 0.1 inch (2.54 millimeters). The first and second port diameters 850 and 855 may be equal (i.e., $PD_1=PD_2$). Alternatively, the first and second port diameters 850 and 855 may be different. The apparatus, methods, and articles of manufacture described herein are not limited in this regard.

As noted above, the visual guide portion may include the third visual guide portion 126. Accordingly, the body portion 110 may include two or more weight ports, generally shown as a third set of weight ports 860 (e.g., shown as weight ports 861, 862, 863, 864, 865, 866, 867, and 868) to form the third visual guide portion 126. In particular, the third visual guide portion 126 may be substantially equidistant from the first and second visual guide portions 122 and 124. For example, the third visual guide portion 126 may extend between the front and rear portions 150 and 160 located at or proximate to a center of the body portion 110. The apparatus, methods, and articles of manufacture described herein are not limited in this regard.

Each weight port of the third set of weight ports 860 may have a third port diameter 870. In one example, the third port diameter 870 may be equal to the first port diameter 850 and/or the second port diameter 855 (e.g., 850=855=870). In another example, the third port diameter 870 may be different from the first port diameter 850 and the second port diameter 855. A uniform distance of less than the third port diameter 870 may separate any two adjacent weight ports of the third set of weight ports 860 (e.g., (i) weight ports 861 and 862, (ii) weight ports 862 and 863, (iii) weight ports 863 and 864, (iv) weight ports 864 and 865, (v) weight ports 865 and 866, (vi) weight ports 866 and 867, or (vii) weight ports 867 and 868). The body portion 110 may also include a U-shape recess portion 190. The third visual guide portion 126 may be located in the U-shape recess portion 190. The apparatus, methods, and articles of manufacture described herein are not limited in this regard.

Figure 9:
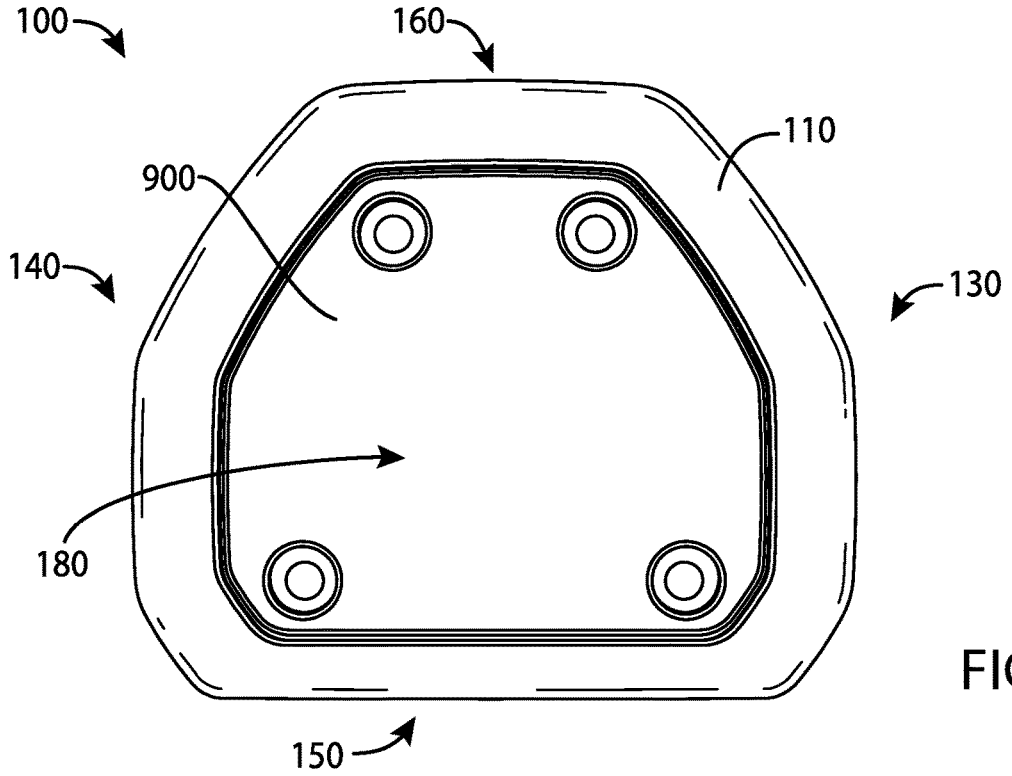
FIG. 9 depicts a bottom view of the example body portion of FIG. 8.

Further, as shown in FIG. 9, the body portion 110 may include an interior cavity 900. The interior cavity 900 may be partially or entirely filled with a polymer material, an elastic polymer or elastomer material, a thermoplastic elastomer material (TPE), a thermoplastic polyurethane material (TPU), and/or other suitable types of materials to absorb shock, isolate vibration, and/or dampen noise. A plate portion 500 (FIG. 5) may cover the interior cavity 900 from the sole portion 180. The plate portion 500 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the plate portion 500 may be partially or entirely made of a non-metal material (e.g., composite, plastic, etc.) with one shown as 1300 in FIG. 13. The apparatus, methods, and articles of manufacture described herein are not limited in this regard.

As illustrated in FIG. 8, the first and second visual guide portions 122 and 124, respectively, may be located a distance from a first vertical plane 880 and a second vertical plane 885, respectively. For example, the first visual guide portion 122 may be located less than one inch (25.4 millimeters) from the first vertical plane 880 and the second visual guide portion 124 may be located less than one inch (25.4 millimeters) from the second vertical plane 885. Further, a distance 400 (FIG. 4) may separate the first and second visual guide portions 122 and 124, which may be greater than a diameter of a golf ball (e.g., 1.68 inches or 42.67 millimeters). In one example, the distance 400 may be greater than three inches (76.2 millimeters). In another example, the distance 400 may be about 3.75 inches (95.25 millimeters). The apparatus, methods, and articles of manufacture described herein are not limited in this regard.

The first and second visual guide portions 122 and 124 may be located relative to the periphery of the golf club head 100. In one example, the first visual guide portion 122 may be located less than 0.5 inch (12.7 millimeters) from the periphery at or proximate to the toe portion 130 whereas the second visual guide portion 124 may be located less than 0.5 inch (12.7 millimeters) from the periphery at or proximate to the heel portion 140. In one example, each of the first and second visual guide portions 122 and 124 may extend about a maximum length 405 between the front and rear portions 150 and 160. In another example, each of the first and second visual guide portions 122 and 124 may extend less than 50% of the maximum length 405 between the front and rear portions 150 and 160. In yet another example, each of the first and second visual guide portions 122 and 124 may extend between 50% and 100% of the maximum length 405 between the front and rear portions 150 and 160. The apparatus, methods, and articles of manufacture described herein are not limited in this regard.

Each of the first and second visual guide portions 122 and 124, respectively, may be dotted lines formed by two or more weight portions, generally shown as a first set of weight portions 420 (e.g., shown as weight portions 421, 422, 423, 424, and 425) and a second set of weight portions 440 (e.g., shown as weight portions 441, 442, 443, 444, and 445). In a similar manner, the third visual guide portion 126 may be a dotted line formed by two or more weight portions, generally shown as a third set of weight portions 460 (e.g., shown as weight portions 461, 462, 463, 464, 465, 466, 467, and 468). The first, second, and third sets of weight portions 420, 440, and 460, respectively, may be partially or entirely made of a high-density material such as a tungsten-based material or suitable types of materials. Alternatively, the first, second, and third sets of weight portions 420, 440, and 460, respectively, may be partially or entirely made of any metal material or non-metal material (e.g., composite, plastic, etc.). The apparatus, methods, and articles of manufacture described herein are not limited in this regard.

Figure 10:
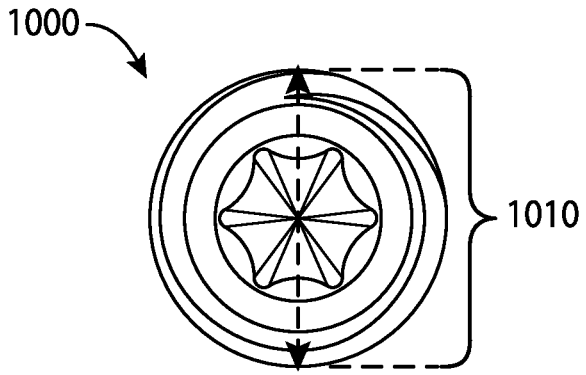
FIG. 10 depicts a top view of a weight portion associated with the example golf club head of FIG. 1.
Figure 11:
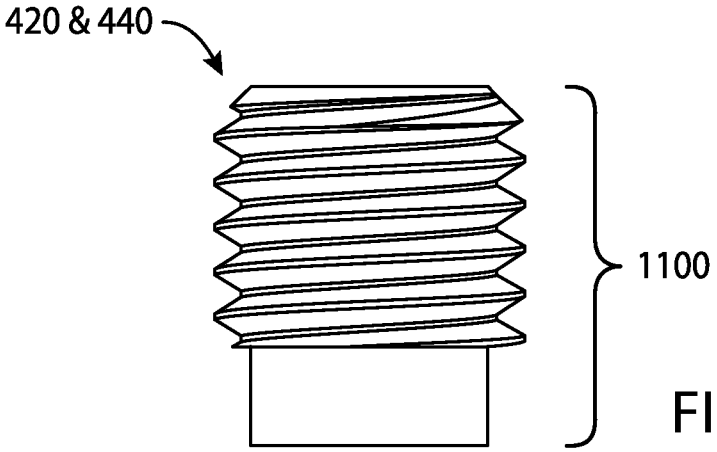
FIG. 11 depicts a side view of a weight portion associated with the example golf club head of FIG. 1.
Figure 12:
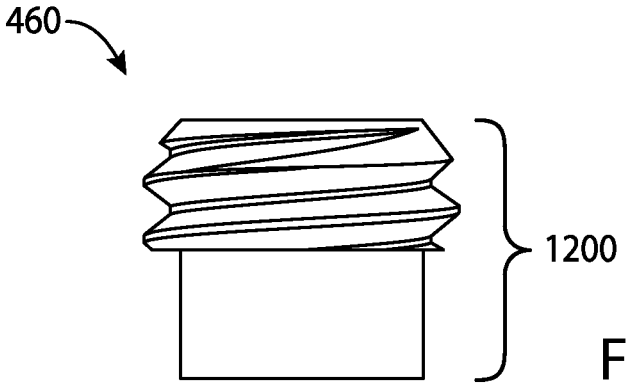
FIG. 12 depicts a side view of another weight portion associated with the example golf club head of FIG. 1.
Figure 13:
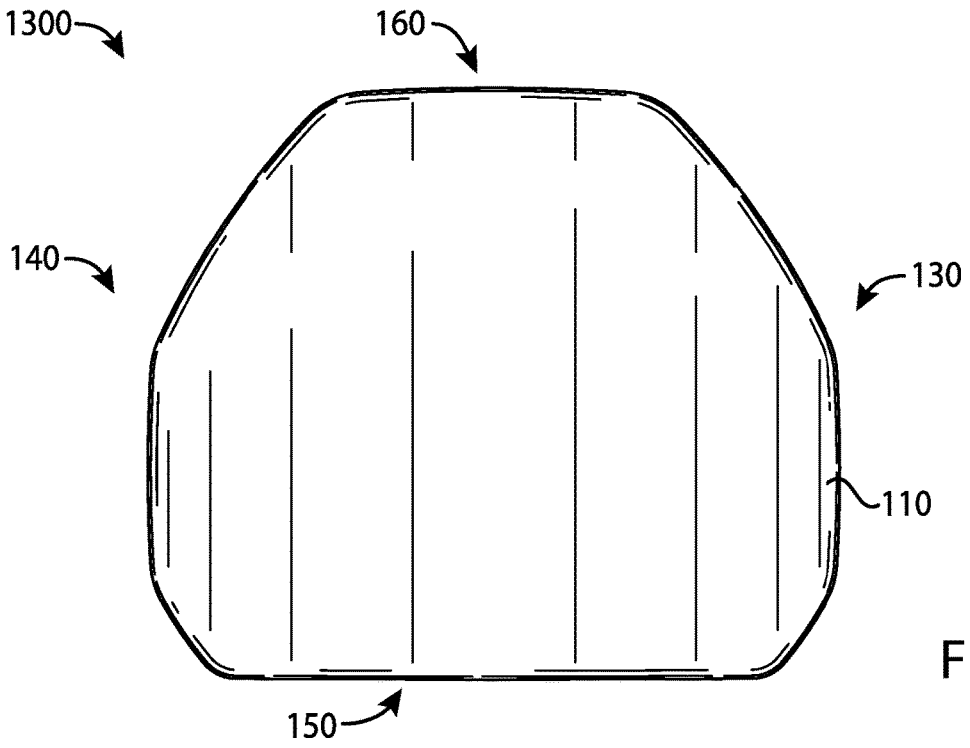
FIG. 13 depicts a bottom view of another example body portion of FIG. 1.

The first, second, and third sets of weight portions 420, 440, and 460, respectively, may have similar or different physical properties (e.g., density, shape, mass, volume, size, color, etc.). In the illustrated example as shown in FIGS. 10-12, each of the weight portions of the first, second, and third sets of weight portions 420, 440, and 460 may have a cylindrical shape (e.g., a circular cross section). Alternatively, each of the weight portions of the first and second sets of weight portions 420 and 440 may have a first shape (e.g., a cylindrical shape) whereas each of the weight portions of the third set of weight portions 460 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

Further, each of the weight portions of the first, second, and third sets of weight portions 420, 440, and 460, respectively, may have a diameter 1010 (FIG. 10) of about 0.25 inch (6.35 millimeters) but the first, second, and third sets of weight portions 420, 440, and 460, respectively, may be different in height. In particular, each of the weight portions of the first and second sets of weight portions 420 and 440 may be associated with a first height 1100 (FIG. 11), and each of the weight portions of the third set of weight portions 460 may be associated with a second height 1200 (FIG. 12). The first height 1100 may be relatively longer than the second height 1200. In one example, the first height 1100 may be about 0.3 inch (7.62 millimeters) whereas the second height 1200 may be about 0.16 inch (4.06 millimeters). Alternatively, the first height 1100 may be equal to or less than the second height 1200. The apparatus, methods, and articles of manufacture described herein are not limited in this regard.

The first and second sets of weight portions 420 and 440, respectively, may include threads to secure in the weight ports. For example, each weight portion of the first and second sets of weight portions 420 and 440 may be a screw. The first and second sets of weight portions 420 and 440, respectively, may not be readily removable from the body portion 110 with or without a tool. Alternatively, the first and second sets of weight portions 420 and 440, respectively, may be readily removable (e.g., with a tool) so that a relatively heavier or lighter weight portion may replace one or more of the weight portions of the first and second sets 420 and 440, respectively. In another example, the first and second sets of weight portions 420 and 440, respectively, may be secured in the weight ports of the body portion 110 with epoxy or adhesive so that the first and second sets of weight portions 420 and 440, respectively, may not be readily removable. In yet another example, the first and second sets of weight portions 420 and 440, respectively, may be secured in the weight ports of the body portion 110 with both epoxy and threads so that the first and second sets of weight portions 420 and 440, respectively, may not be readily removable. The apparatus, methods, and articles of manufacture described herein are not limited in this regard.

Figure 4:
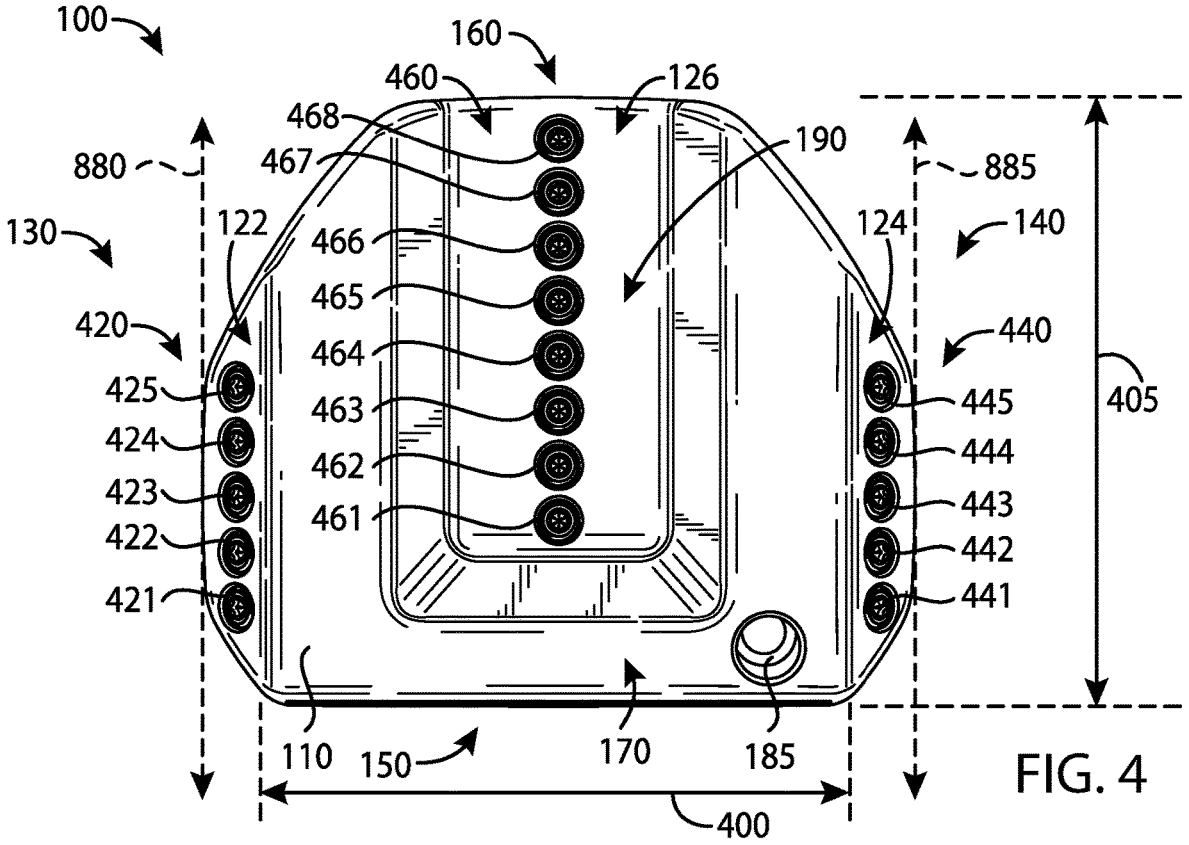
FIG. 4 depicts a top view of the example golf club head of FIG. 1.
Figure 5:
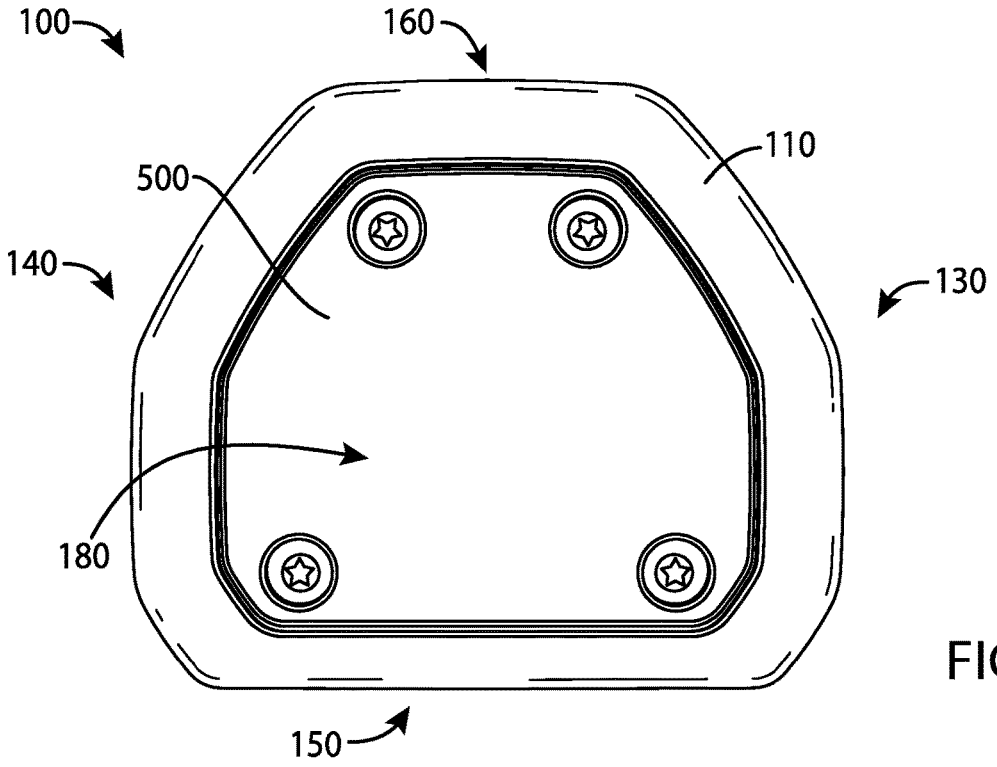
FIG. 5 depicts a bottom view of the example golf club head of FIG. 1.
Figure 6:
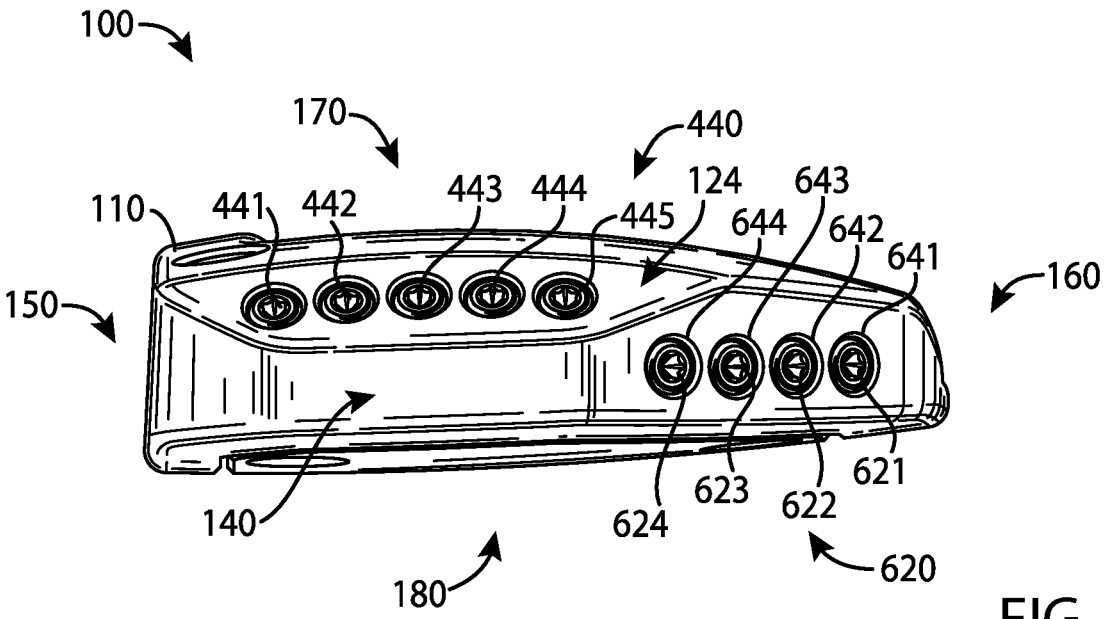
FIG. 6 depicts a left view of the example golf club head of FIG. 1.
Figure 7:
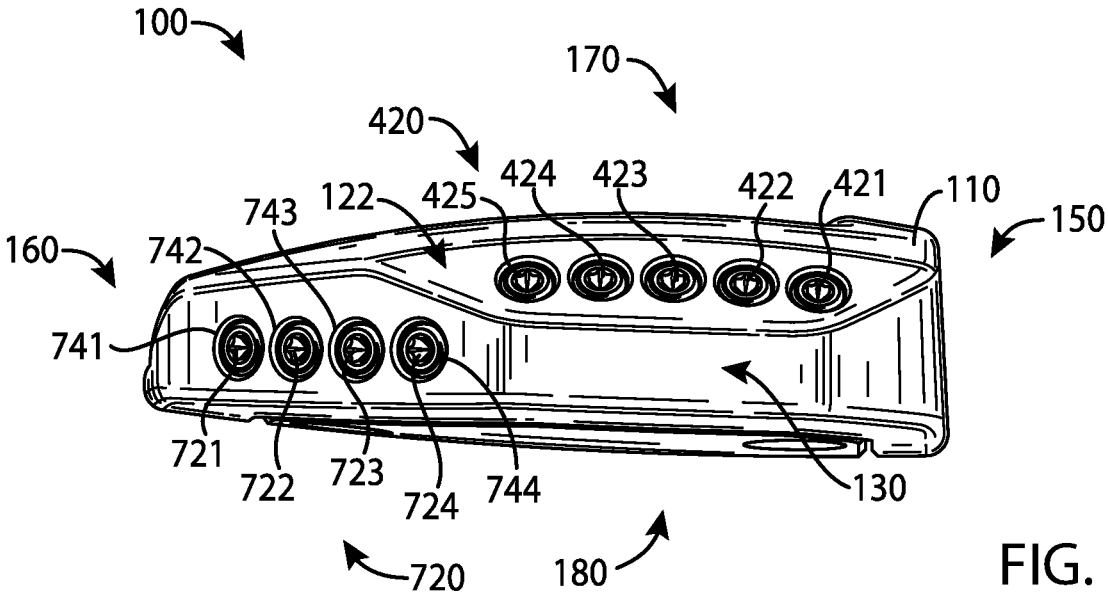
FIG. 7 depicts a right view of the example golf club head of FIG. 1.

As illustrated in FIGS. 6 and 7, the golf club head 100 may also include a fourth set of weight portions 620 (e.g., shown as weight portions 621, 622, 623, and 624) and a fifth set of weight portions 720 (e.g., shown as weight portions 721, 722, 723, and 724). Although both the fourth and fifth sets of weight portions 620 and 720 may be located at or proximate to the rear portion 160, the fourth set of weight portions 620 may be located at or proximate to the heel portion 140 whereas the fifth set of weight portions 720 may be at or proximate to the toe portion 130. Each of the fourth and fifth sets of weight portions 620 and 720 may include at least three weight portions. Each weight portion of the fourth and fifth sets of weight portions 620 and 720 may be coupled (e.g., via threads) to a corresponding weight port (e.g., shown as weight ports 641, 642, 643, 644, 741, 742, 743, and 744) on the periphery of the body portion 110. The corresponding weight ports may be spaced apart and have port diameters similar or different to any one or more of the first, second, and third port diameters 850, 855, and 870 associated with the first, second, and third sets of weight ports 820, 840, and 860. In one example, as shown in FIG. 4, the fourth and fifth sets of weight portions 620 and 720 and the corresponding weight ports may not be visible when the club head 100 is directly viewed from the top. The apparatus, methods, and articles of manufacture described herein are not limited in this regard.

Figure 14:
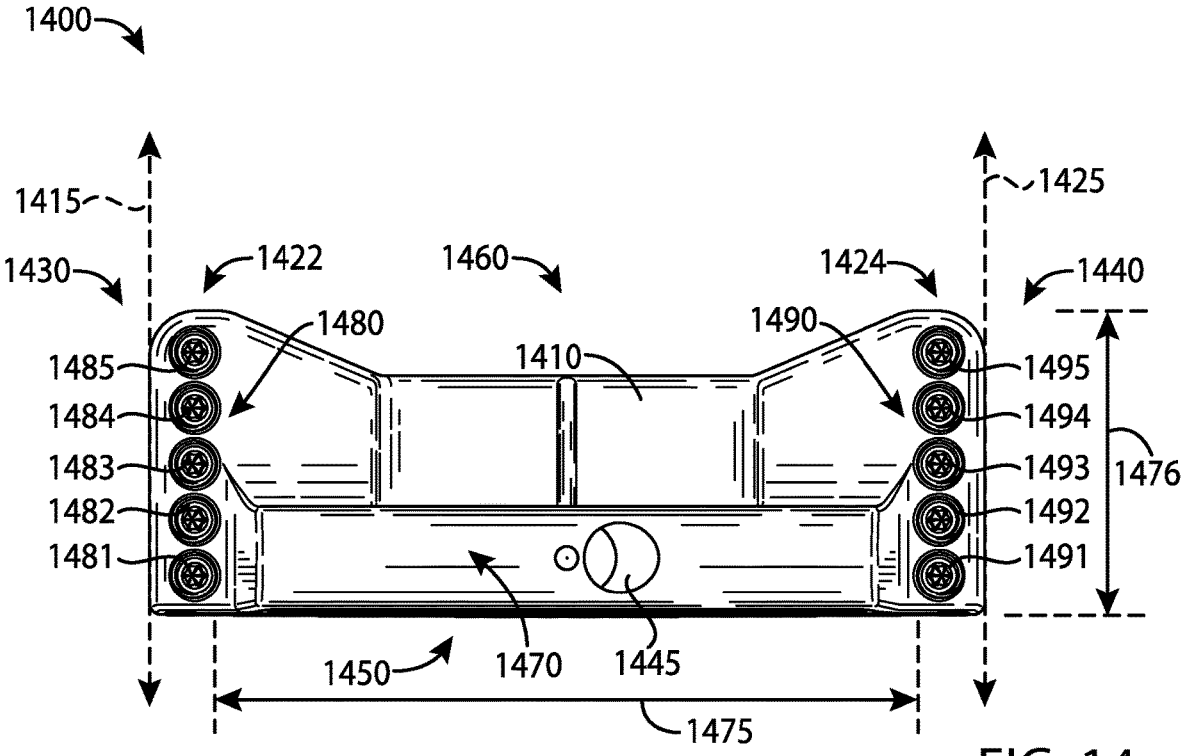
FIG. 14 depicts a top view of a golf club head according to another example of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While the golf club head 100 illustrated in FIGS. 1-9 may depict a particular type of putter club head (e.g., a mallet-type putter club head), the apparatus, methods, and articles of manufacture described herein may be applicable to other types of putters. For example, as illustrated in FIG. 14, the apparatus, methods, and articles of manufacture described herein may be applicable to a blade-type putter golf club head 1400. The golf club head 1400 may include a body portion 1410, and a visual guide portion, generally shown as a first visual guide portion 1422 and a second visual guide portion 1424. The body portion 1410 may include a toe portion 1430, a heel portion 1440, a front portion 1450, a rear portion 1460, a sole portion (not shown), and a top portion 1470. The body portion 1410 may also include a bore 1445 to receive a shaft (not shown). Alternatively, the body portion 1410 may include a hosel (not shown) to receive a shaft. The body portion 1410 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 1410 may be partially or entirely made of a non-metal material (e.g., composite, plastic, etc.). The apparatus, methods, and articles of manufacture described herein are not limited in this regard.

The first and second visual guide portions 1422 and 1424, respectively, may be located a particular distance from a first vertical plane 1415 and a second vertical plane 1425, respectively. For example, the first visual guide portion 1422 may be located less than one inch (25.4 millimeters) from the first vertical plane 1415 and the visual guide portion 1424 may be located less than one inch (25.4 millimeters) from the second vertical plane 1425. Further, a distance 1475 may separate the first and second visual guide portions 1422 and 1424, which may be greater than a diameter of a golf ball. In one example, the distance 1475 may be greater than three inches (76.2 millimeters). In another example, the distance 1475 may be about 3.75 inches (95.25 millimeters).

The first and second visual guide portions 1422 and 1424 may be located relative to a periphery of the golf club head 1400. In one example, the first visual guide portion 1422 may be located less than 0.5 inch (12.7 millimeters) from the periphery at or proximate to the toe portion 1430 whereas the second visual guide portion 1424 may be located less than 0.5 inch (12.7 millimeters) from the periphery at or proximate to the heel portion 1440. In one example, each of the first and second visual guide portions 1422 and 1424 may extend about a maximum length 1476 between the front and rear portions 1450 and 1460. In another example, each of the first and second visual guide portions 1422 and 1424 may extend less than 50% of the maximum length 1476 between the front and rear portions 1450 and 1460. In yet another example, each of the first and second visual guide portions 1422 and 1424 may extend between 50% and 100% of the maximum length 1476 between the front and rear portions 1450 and 1460. The apparatus, methods, and articles of manufacture described herein are not limited in this regard.

Each of the first and second visual guide portions 1422 and 1424, respectively, may be dotted lines formed by two or more weight portions, generally shown as a first set of weight portions 1480 (e.g., shown as weight portions 1481, 1482, 1483, 1484, and 1485) and a second set of weight portions 1490 (e.g., shown as weight portions 1491, 1492, 1493, 1494, and 1495). The first and second sets of weight portions 1480 and 1490, respectively, may be partially or entirely made of a high-density material such as a tungsten-based material or suitable types of materials. Alternatively, the first and second sets of weight portions 1480 and 1490, respectively, may be partially or entirely made of a non-metal material (e.g., composite, plastic, etc.). The apparatus, methods, and articles of manufacture described herein are not limited in this regard.

The first and second sets of weight portions 1480 and 1490, respectively, may have similar or different physical properties (e.g., density, shape, mass, volume, size, color, etc.). In the illustrated example as shown in FIGS. 10-12, each of the weight portions of the first and second sets of weight portions 1480 and 1490 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

The first and second sets of weight portions 1480 and 1490, respectively, may include threads to secure in the weight ports, which may also have corresponding threads. For example, each weight portion of the first and second sets of weight portions 1480 and 1490 may be a screw. The first and second sets of weight portions 1480 and 1490, respectively, may not be readily removable from the body portion 1410 with or without a tool. Alternatively, the first and second sets of weight portions 1480 and 1490, respectively, may be readily removable (e.g., with a tool) so that a relatively heavier or lighter weight portion may replace one or more of the weight portions of the first and second sets of weight portions 1480 and 1490, respectively. In another example, the first and second sets of weight portions 1480 and 1490, respectively, may be secured in the weight ports of the body portion 1410 with epoxy or adhesive so that the first and second sets of weight portions 1480 and 1490, respectively, may not be readily removable. In yet another example, the first and second sets of weight portions 1480 and 1490, respectively, may be secured in the weight ports of the body portion 1410 with both epoxy and threads so that the first and second sets of weight portions 1480 and 1490, respectively, may not be readily removable. The apparatus, methods, and articles of manufacture described herein are not limited in this regard.

Figure 15:
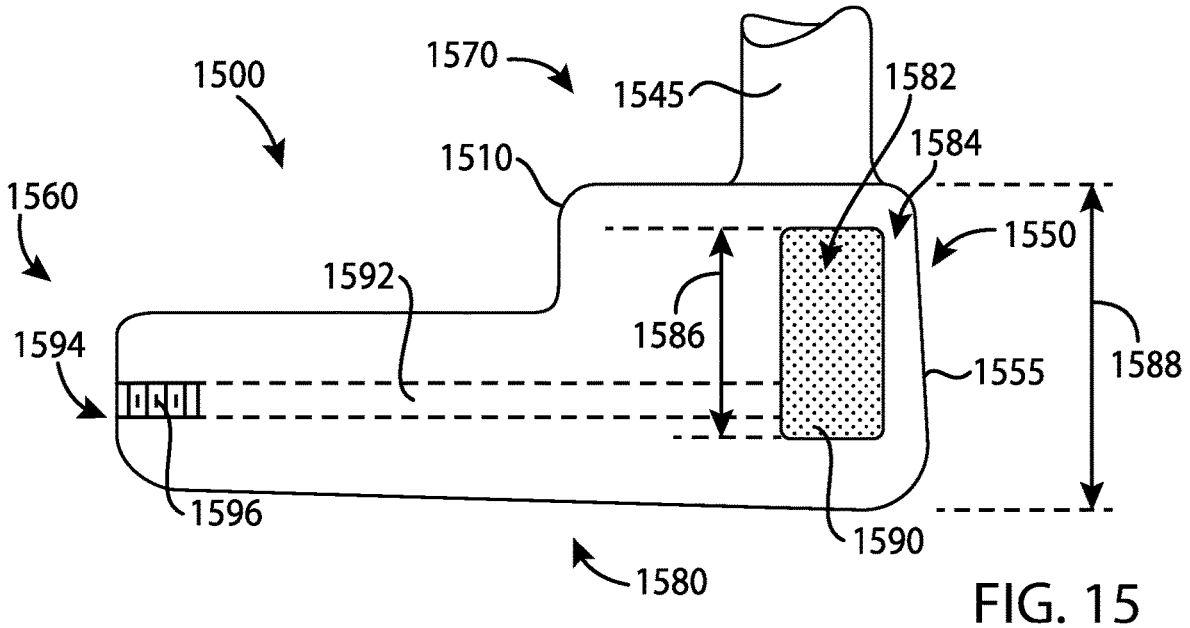
FIG. 15 depicts a schematic cross-sectional view of a golf club head according to yet another example of the apparatus, methods and articles of manufacture described herein.
Figure 16:
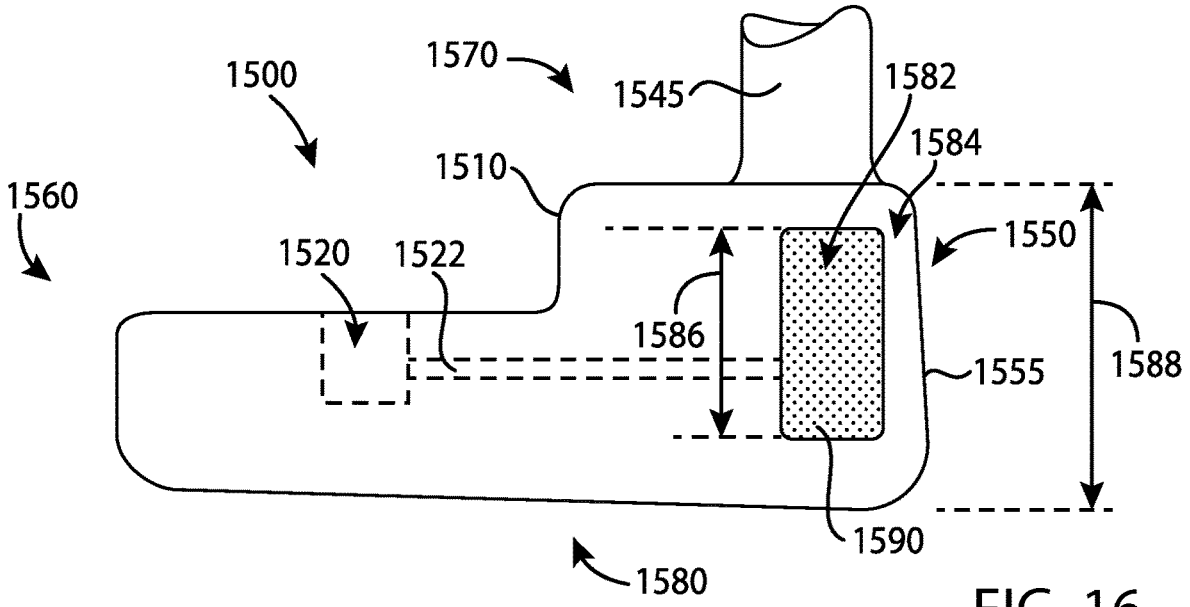
FIG. 16 depicts a schematic cross-sectional view of another example of the golf club head of FIG. 15.

In the example of FIGS. 15 and 16, a golf club head 1500 may include a body portion 1510. The body portion 1510 may include a toe portion (not shown), a heel portion (not shown), a front portion 1550, a rear portion 1560, a top portion 1570, and a sole portion 1580. The body portion 1510 may be manufactured via various manufacturing methods and/or processes (e.g., a casting process, a forging process, a milling process, a cutting process, a grinding process, a welding process, a combination thereof, etc.). The body portion 1510 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1510 may be partially or entirely made of non-metal material (e.g., composite, plastic, etc.). The golf club head 1500 may be a putter-type golf club head (e.g., a blade-type putter, a mid-mallet-type putter, a mallet-type putter, etc.). Based on the type of putter as mentioned above, the body portion 1510 may be at least 200 grams. For example, the body portion 1510 may be in a range between 300 to 600 grams. Although FIGS. 15 and 16 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1510 may include a hosel portion 1545 configured to receive a shaft (not shown) with a grip (not shown). The golf club head 1500 and the grip may be located on opposite ends of the shaft to form a golf club. The front and rear portions 1550 and 1560, respectively, may be on opposite ends of the body portion 1510. The front portion 1550 may include a face portion 1555 (e.g., a strike face). The face portion 1555 may be used to impact a golf ball. The face portion 1555 may be an integral portion of the body portion 1510. Alternatively, the face portion 1555 may be a separate piece or an insert coupled to the body portion 1510 via various manufacturing methods and/or processes (e.g., a bonding process, a welding process, a brazing process, a mechanical locking method, a mechanical fastening method, any combination thereof, or other suitable types of manufacturing methods and/or processes). The face portion 1555 may be associated with a loft plane that defines the loft angle of the golf club head 1500. The apparatus, methods, and articles of manufacture described herein are not limited in this regard.

The body portion 1510 may include one or more weight ports and one or more weight portions similar to any of the golf club heads described herein. For example, a weight port 1520 is shown in FIG. 16. For example, the body portion 1510 may include a first set of weight ports (not shown) similar to the first set of weight ports 820 of the golf club head 100 and a second set of weight ports (not shown) similar to the second set of weight ports 840 of the golf club head 100 that are configured to receive a plurality of weight portions. Accordingly, a detailed description of the weight ports and weight portions of the golf club 1500 is not described. Alternatively, the body portion 1510 may not include any weight ports and/or weight portions.

The body portion 1510 may be a hollow body including an interior cavity 1582 extending between the front portion 1550 and the rear portion 1560. Further, the interior cavity 1582 may extend between the top portion 1570 and the sole portion 1580. A cavity wall portion 1584 may separate the interior cavity 1582 and the face portion 1555. The interior cavity 1582 may be associated with a cavity height 1586 ($H_C$) and the body portion 1510 may be associated with a body height 1588 ($H_B$). While the cavity height 1586 and the body height 1588 may vary between the toe and heel portions, the cavity height 1586 may be at least 50% of the body height 1588 ($H_C>0.5*H_B$). For example, the cavity height 1586 may vary between 70% and 85% of the body height 1588. With the cavity height 1586 of the interior cavity 1582 being greater than 50% of the body height 1588, the golf club head 1500 may produce relatively more consistent feel, sound, and/or result when the golf club head 1500 strikes a golf ball via the face portion 1555 than a golf club head with a cavity height of less than 50% of the body height. However, the cavity height 1586 may be less than 50% of the body height 1588. The apparatus, methods, and articles of manufacture described herein are not limited in this regard.

In one example, the interior cavity 1582 may be unfilled (i.e., empty space). Alternatively, the interior cavity 1582 may be partially or entirely filled with a filler material (e.g., generally shown as 1590). The filler material 1590 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1582 may be filled with a TPE material to absorb shock, isolate vibration, and/or dampen noise when the golf club head 1500 strikes a golf ball via the face portion 1555. The apparatus, methods, and articles of manufacture described herein are not limited in this regard.

In another example, the filler material 1590 may be a polymer material such as an ethylene copolymer material to absorb shock, isolate vibration, and/or dampen noise when the golf club head 1500 strikes a golf ball via the face portion 1555. In particular, at least 50% of the interior cavity 1582 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 1590 may be injected into the interior cavity 1582 by an injection molding process via a port 1592 on the body portion 1510 as shown in FIG. 15. The port 1592 may have an opening 1594 on the body portion 1510 to allow injection of the filler material into the interior cavity 1582 through the port 1592. The port 1592 may have a plug 1596, by which the opening 1594 may be closed after injection of the filler material 1590 into the interior cavity 1582. Alternatively, as shown in the example of FIG. 16, at least one of the weight ports (e.g., 1520) on the body portion 1510 may be connected to the interior cavity 1582 through a connection port 1522 that may be similar to the port 1592. Accordingly, the filler material may be injected into the interior cavity 1582 from the at least one weight port (e.g., 1520) through the connection port 1522. The apparatus, methods, and articles of manufacture described herein are not limited in this regard.

For example, at least 50% of the interior cavity 1582 may be filled with a TPE material to absorb shock, isolate vibration, dampen noise, and/or provide structural support when the golf club head 1500 strikes a golf ball via the face portion 1555. With the support of the cavity wall portion 1584 and filling at least a portion of the interior cavity 1582 with an elastic polymer material, the face portion 1555 may be relatively thin without degrading the structural integrity, sound, and/or feel of the golf club head 1500. In one example, the face portion 1555 may have a thickness of less than or equal to 0.075 inch or 1.905 millimeters (e.g., the thickness of the cavity wall portion 1584). In another example, the face portion 1555 may have a thickness of less than or equal to 0.060 inch (1.524 millimeters). In yet another example, the face portion 1555 may have a thickness of less than or equal to 0.050 inch (1.270 millimeters). Further, the face portion 1555 may have a thickness of less than or equal to 0.030 inch (0.762 millimeters). The apparatus, methods, and articles of manufacture described herein are not limited in this regard.

Figure 17:
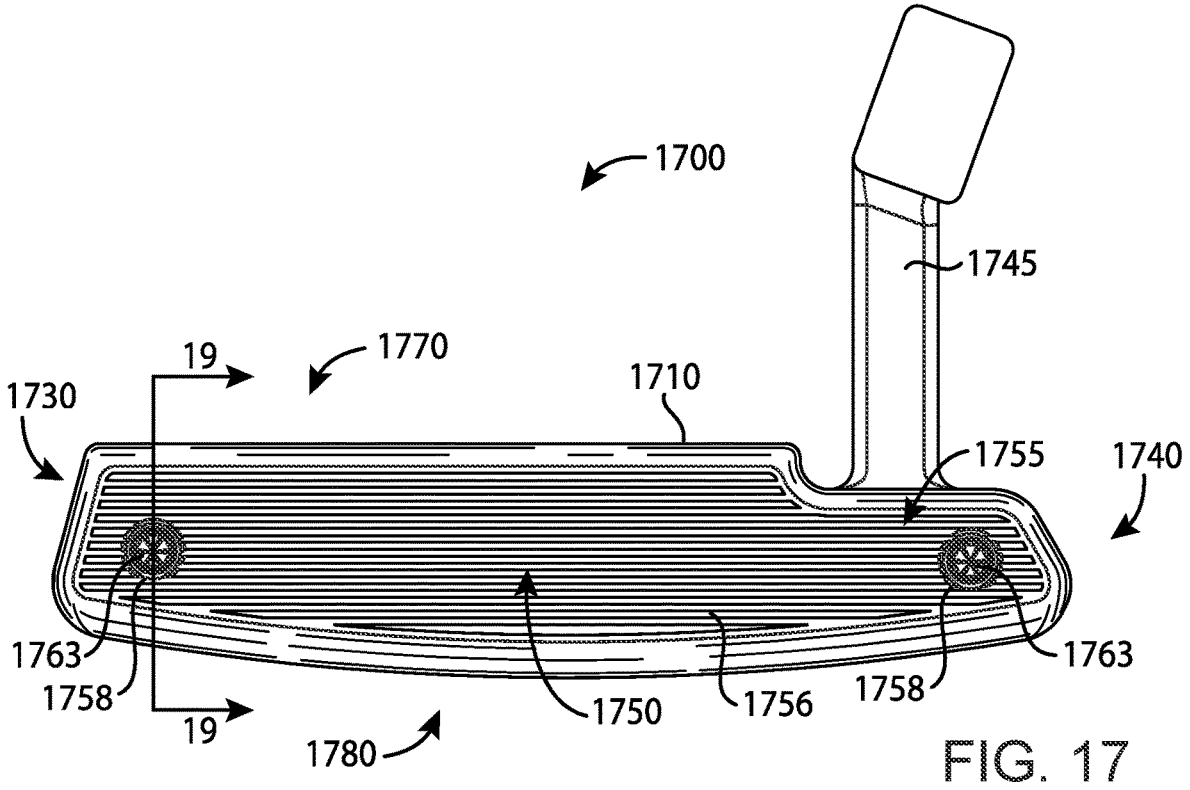
FIG. 17 depicts a front view of a golf club head according to yet another example of the apparatus, methods, and articles of manufacture described herein.
Figure 18:
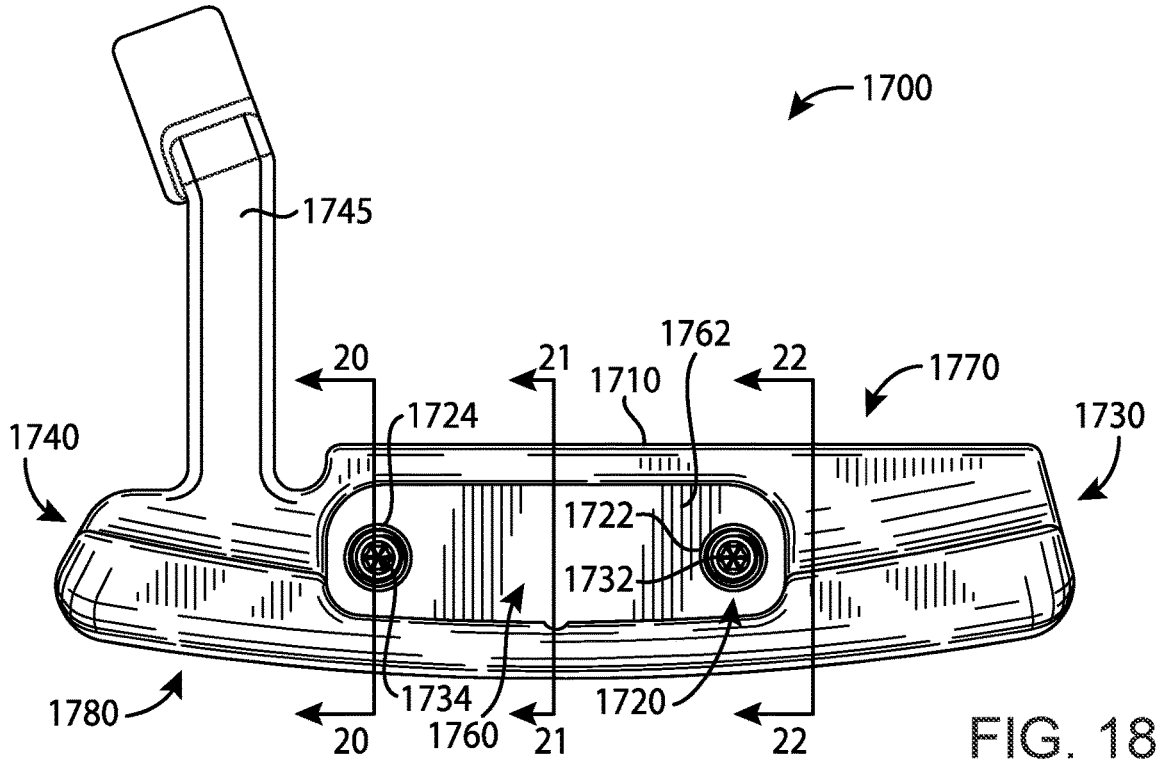
FIG. 18 depicts a rear view of the golf club head of FIG. 17.
Figure 19:
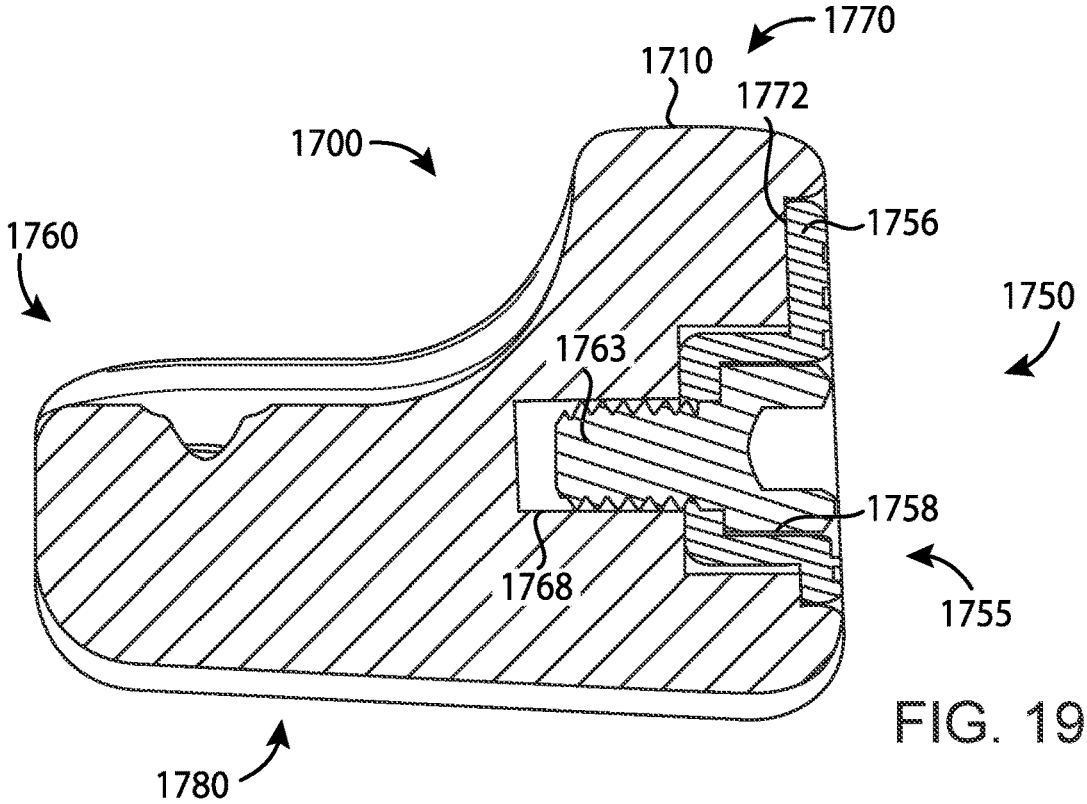
FIG. 19 depicts a cross-sectional view of the golf club head of FIG. 17 at lines 19-19 of FIG. 17.

In the example of FIGS. 17 and 18, a golf club head 1700 may include a body portion 1710. The body portion 1710 may include a toe portion 1730, a heel portion 1740, a front portion 1750, a rear portion 1760, a top portion 1770, and a sole portion 1780. The body portion 1710 may be manufactured via various manufacturing methods and/or processes (e.g., a casting process, a forging process, a milling process, a cutting process, a grinding process, a welding process, a combination thereof, etc.). The body portion 1710 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1710 may be partially or entirely made of non-metal material (e.g., composite, plastic, etc.). The golf club head 1700 may be a putter-type golf club head (e.g., a blade-type putter, a mid-mallet-type putter, a mallet-type putter, etc.). Based on the type of putter as mentioned above, the body portion 1710 may be at least 200 grams. For example, the body portion 1710 may be in a range between 300 to 600 grams. Although FIGS. 17 and 18 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1710 may include a hosel portion 1745 configured to receive a shaft (not shown) with a grip (not shown). The golf club head 1700 and the grip may be located on opposite ends of the shaft to form a golf club. The front and rear portions 1750 and 1760, respectively, may be on opposite ends of the body portion 1710. The front portion 1750 may include a face portion 1755 (e.g., a strike face). The face portion 1755 may be used to impact a golf ball. The face portion 1755 may be associated with a loft plane that defines the loft angle of the golf club head 1700. The apparatus, methods, and articles of manufacture described herein are not limited in this regard.

The body portion 1710 may include one or more weight ports and one or more weight portions similar to any of the golf club heads described herein. For example, the body portion 1710 may include a first set of weight ports 1720 at or proximate the rear portion 1760. In the examples of FIGS. 17-22, the rear portion 1760 may include a back wall portion 1762 having a first weight port 1722 of the first set of weight ports 1720 and a second weight port 1724 of the first set of weight ports 1720. The first weight port 1722 may be closer to the toe portion 1730 than the second weight port 1724. The second weight port 1724 may be closer to the heel portion 1740 than the first weight port 1722. The first and second weight ports 1722 and 1724, respectively, may be at any location on the back wall portion 1762 or the rear portion 1760. Alternatively, the body portion 1710 may not include any weight ports on the back wall portion 1762. The apparatus, methods, and articles of manufacture described herein are not limited in this regard.

Figure 20:
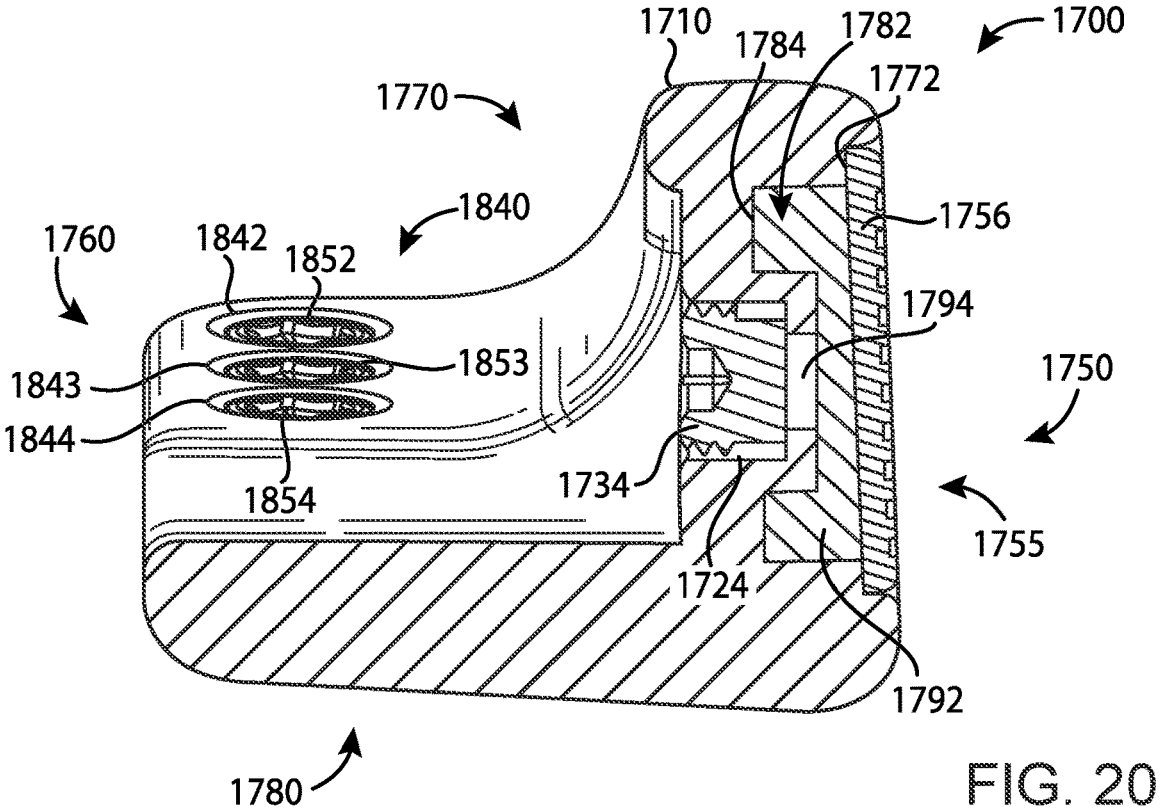
FIG. 20 depicts a cross-sectional view of the golf club head of FIG. 17 at lines 20-20 of FIG. 18.

In the example of FIGS. 17-22, the body portion 1710 may include a second set of weight ports 1840 as shown in FIG. 20 proximate to the heel portion 1740 and extending between the toe portion 1730 and the heel portion 1740. The second set of weight ports 1840 may include any number of weight ports, such as three weight ports as shown in FIG. 20 as weight ports 1842, 1843, and 1844. The body portion 1710 may include a third set of weight ports 1860 that may be located near the toe portion 1730 and extend between the toe portion 1730 and the heel portion 1740. The third set of weight ports 1860 may include any number of weight ports, such as three weight ports similar to the weight ports of the second set of weight ports 1840. The second and third sets of weight ports 1840 and 1860, respectively, may be similar to each other and symmetrically arranged relative to a midpoint of the body portion 1710. The apparatus, methods, and articles of manufacture described herein are not limited in this regard.

Figure 22:
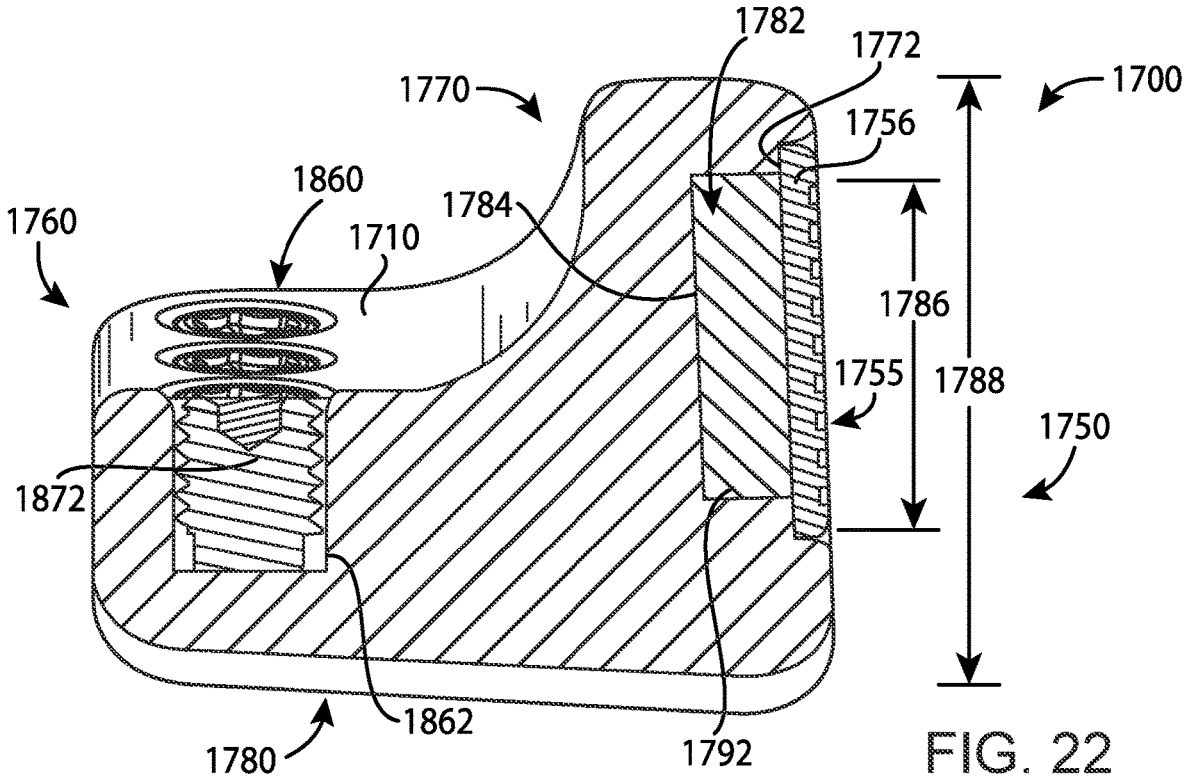
FIG. 22 depicts a cross-sectional view of the golf club head of FIG. 17 at lines 22-22 of FIG. 18.

The golf club head 1700 may include a plurality of weight portions. Each weight port of the first, second, and third sets of weight ports 1720, 1840, and 1860 may be configured to receive a weight portion. For example, the first and second weight ports 1722 and 1724 of the first set of weight ports 1720 may receive weight portions 1732 and 1734, respectively. The weight ports 1842, 1843, and 1844 of the second set of weight ports 1840 may receive weight portions 1852, 1853, and 1854, respectively. The weight ports of the third set of weight ports 1860 may receive weight portions similar to the second set of weight ports 1840. In the example of FIG. 22, a weight port 1862 of the third set of weight ports 1860 is shown to have received a weight portion 1872. The configurations of the weight ports and the weight portions (e.g., inner diameter, outer diameter, size, shape, distance from an adjacent weight port or weight portion, etc.) of the golf club head 1700 may be similar in many respects to the weight ports and weight portions of any of the golf club heads descried herein. Accordingly, a detailed description of the weight ports and weight portions of the golf club 1700 is not described. Alternatively, the body portion 1710 may not include any weight ports and/or weight portions. The apparatus, methods, and articles of manufacture described herein are not limited in this regard.

In the example of FIGS. 17-22, the face portion 1755 may include a separate piece or an insert coupled to the body portion 1710. The face portion 1755 may include a face insert 1756, which may be attached to the front portion 1750 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 17 and 19, the face insert 1756 may include two fastener holes 1758 proximate to the toe portion and heel portion of the face insert 1756. Each of the fastener holes 1758 may be configured to receive a fastener 1763 for attachment of the face insert 1756 to the body portion 1710. The body portion 1710 may include two fastener ports 1768 (one fastener port 1768 shown in FIG. 19) configured to receive the fasteners 1763. Each fastener port 1768 may have internal threads that are configured to engage external threads on the fasteners 1763. The apparatus, methods, and articles of manufacture described herein are not limited in this regard.

The face portion 1755 may include a peripheral recessed portion 1772 configured to receive the face insert 1756. As shown by example in FIGS. 19-22, the depth of the peripheral recessed portion 1772 may be similar to the thickness of the face insert 1756 such that when the face insert 1756 is fastened to the body portion 1710, the face insert 1756 is positioned flush or substantially flush with the face portion 1755. Alternatively, the face insert 1756 may project from the face portion 1755. The apparatus, methods, and articles of manufacture described herein are not limited in this regard.

The fasteners 1763 may have similar or different weights to balance and/or provide heel or toe weight bias for the golf club 1700. For example, the weight of the body portion 1710 may be increased or decreased by similarly increasing or decreasing, respectively, the weights of the fasteners 1763. In one example, the golf club head 1700 may be provided with a toe-biased weight configuration by having the fastener 1763 that is closer to the toe portion 1730 be heavier than the fastener 1763 that is closer to the heel portion 1740. Conversely, the golf club head 1700 may be provided with a heel-biased weight configuration by having the fastener 1763 that is closer to the heel portion 1740 be heavier than the fastener 1763 that is closer to the toe portion 1730. The apparatus, methods, and articles of manufacture described herein are not limited in this regard.

To attach the face insert 1756 to the body portion 1710, the face insert 1756 may be inserted in the peripheral recessed portion 1772, thereby generally aligning the fastener holes 1758 of the face insert 1756 and the fastener ports 1768 of the body portion 1710. The fasteners 1763 can be inserted through the fastener holes 1758 and screwed into the fastener ports 1768 to securely attach the face insert 1756 to the body portion 1710. The face insert 1756 may be constructed from any material such as metal, metal alloys, plastic, wood, composite materials or a combination thereof to provide a certain ball striking characteristic to the golf club head 1700. The material from which the face insert 1756 is manufactured may affect ball speed and spin characteristics. Accordingly, the face insert 1756 may be selected to provide a certain ball speed and spin characteristics for an individual. Thus, the face insert 1756 may be interchangeable with other face inserts having different ball speed and spin characteristics. The face insert 1756 may be coupled to the body portion 1710 by other methods or devices, such as by bonding, welding, adhesive and/or other types of fastening devices and/or methods. The apparatus, methods, and articles of manufacture described herein are not limited in this regard.

Figure 21:
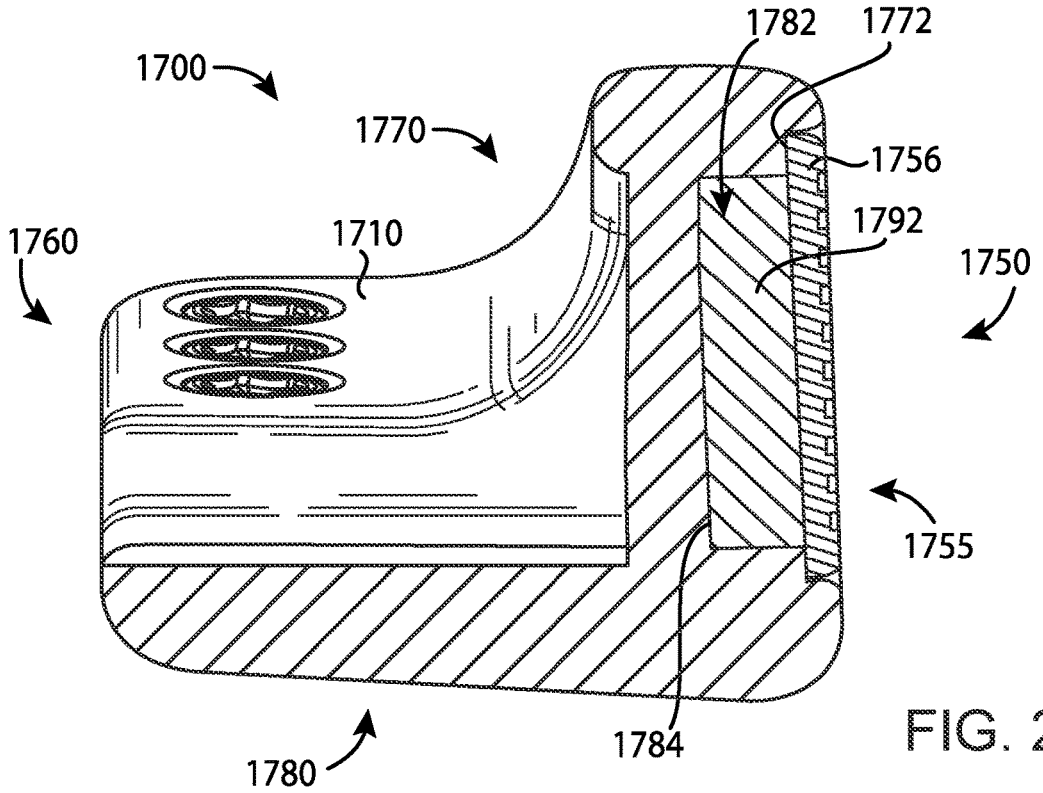
FIG. 21 depicts a cross-sectional view of the golf club head of FIG. 17 at lines 21-21 of FIG. 18.

The body portion 1710 may include an interior cavity 1782 extending between the front portion 1750 and the rear portion 1760 and between the toe portion 1730 and the heel portion 1740. In one example as shown in FIGS. 20-22, the interior cavity 1782 may be defined by a recess 1784 in the front portion 1750 that is covered by the face insert 1756. The recess 1784 may extend from near the toe portion 1730 to near the heel portion 1740 and from near the top portion 1770 to near the sole portion 1780. Alternatively, the recess 1784 may extend between the fastener ports 1768 of the body portion 1710. In one example, the recess 1784 may be located in and/or near the regions of the face portion 1755 that generally strike a golf ball. The apparatus, methods, and articles of manufacture described herein are not limited in this regard.

The interior cavity 1782 may be associated with a cavity height 1786 ($H_C$) and the body portion 1710 may be associated with a body height 1788 ($H_B$). While the cavity height 1786 and the body height 1788 may vary between the toe and heel portions 1730 and 1740, the cavity height 1786 may be at least 50% of a body height 1788 ($H_C>0.5*H_B$). For example, the cavity height 1786 may vary between 70% and 85% of the body height 1788. With the cavity height 1786 of the interior cavity 1782 being greater than 50% of the body height 1788, the golf club head 1700 may produce relatively more consistent feel, sound, and/or result when the golf club head 1700 strikes a golf ball via the face portion 1755 than a golf club head with a cavity height of less than 50% of the body height. However, the cavity height 1786 may be less than 50% of the body height 1788. The apparatus, methods, and articles of manufacture described herein are not limited in this regard.

In one example, the interior cavity 1782 may be unfilled (i.e., empty space). Alternatively, the interior cavity 1782 may be partially or entirely filled with a filler material 1792 to absorb shock, isolate vibration, and/or dampen noise when the face portion 1755 strikes a golf ball. The filler material 1792 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1782 may be filled with a TPE material to absorb shock, isolate vibration, and/or dampen noise when the golf club head 1700 strikes a golf ball via the face portion 1755. The apparatus, methods, and articles of manufacture described herein are not limited in this regard.

In another example, the filler material 1792 may be a polymer material such as an ethylene copolymer material to absorb shock, isolate vibration, and/or dampen noise when the golf club head 1700 strikes a golf ball via the face portion 1755. In particular, at least 50% of the interior cavity 1782 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 1782 may be partially or fully filled with the filler material 1792. In one example, the recess 1784 may be filled with the filler material 1792 prior to attaching the face insert 1756 to the face portion 1755. In one example, the interior cavity 1782 may be filled with the filler material 1792 via any one of the first and second weight ports 1722 or 1724 of the first set of weight ports 1720. In one example as shown in FIG. 20, the second weight port 1724 may be connected to the interior cavity 1782 via an opening 1794. Similarly, the first weight port 1722 may be connected to the interior cavity 1782 via an opening (not shown). The filler material 1792 may be injected in the interior cavity 1782 from the second weight port 1724 via the opening 1794. As the filler material 1792 fills the interior cavity 1782, the air inside the interior cavity 1782 that is displaced by the filler material 1792 may exit the interior cavity 1782 from the first weight port 1722 through the opening (not shown) that connects the first weight port 1722 to the interior cavity 1782. Accordingly, the first weight port 1722 may function as an exit port for the displaced air inside the interior cavity 1782. After the interior cavity 1782 is partially or fully filled with the filler material 1792, the first and second weight ports 1722 and 1724 may be closed by inserting and securing weight portions 1732 and 1734, respectively, therein as described in detail herein. Alternatively, the filler material 1792 may be injected in the interior cavity 1782 from the first weight port 1722 while the second weight port 1724 functions as an exit port for the displaced air inside the interior cavity 1782. The apparatus, methods, and articles of manufacture described herein are not limited in this regard.

For example, at least 50% of the interior cavity 1782 may be filled with the filler material 1792 to absorb shock, isolate vibration, dampen noise, and/or provide structural support when the golf club head 1700 strikes a golf ball via the face portion 1755. With the support of the back wall portion 1762 and filling at least a portion of the interior cavity 1782 with the filler material 1792, the face portion 1755 may be relatively thin without degrading the structural integrity, sound, and/or feel of the golf club head 1700. In one example, the face portion 1755 may have a thickness of less than or equal to 0.075 inch (1.905 millimeters). In another example, the face portion 1755 may have a thickness of less than or equal to 0.060 inch (1.524 millimeters). In yet another example, the face portion 1755 may have a thickness of less than or equal to 0.050 inch (1.270 millimeters). Further, the face portion 1755 may have a thickness of less than or equal to 0.030 inch (0.762 millimeters). The apparatus, methods, and articles of manufacture described herein are not limited in this regard.

In one example, the face portion 1755 may be in one-piece with the body portion 1710 or be an integral part of the body portion 1710 (not shown). The body portion 1710 may include an interior cavity near the face portion 1755 that may be similar in many respects to the interior cavity 1782. However, unlike the interior cavity 1782 which may be partially defined by the face insert 1756, an interior cavity of the body portion 1710 having a one-piece face portion 1755 may be an integral part of the body portion 1710. The interior cavity may be partially or fully filled with a filler material 1792 via the first and second weight ports 1722 and/or 1724 as described in detail herein. The apparatus, methods, and articles of manufacture described herein are not limited in this regard.

In the example of FIGS. 23-31, a golf club head 2300 may include a body portion 2310. The body portion 2310 may include a toe portion 2330, a heel portion 2340, a front portion 2350, a rear portion 2360, a top portion 2370, and a sole portion 2380. The body portion 2310 may be manufactured via various manufacturing methods and/or processes (e.g., a casting process, a forging process, a milling process, a cutting process, a grinding process, a welding process, a combination thereof, etc.). The body portion 2310 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 2310 may be partially or entirely made of non-metal material (e.g., composite, plastic, etc.). The golf club head 2300 may be a putter-type golf club head (e.g., a blade-type putter, a mid-mallet-type putter, a mallet-type putter, etc.). Based on the type of putter as mentioned above, the body portion 2310 may be at least 200 grams. For example, the body portion 2310 may be in a range between 300 to 600 grams. Although FIGS. 23-31 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 2310 may include a hosel portion 2345 configured to receive a shaft (not shown) with a grip (not shown). The golf club head 2300 and the grip may be located on opposite ends of the shaft to form a golf club. Alternatively, the body portion 2310 may include a bore (not shown) for receiving the shaft (not shown). The front and rear portions 2350 and 2360, respectively, may be on opposite ends of the body portion 2310. The front portion 2350 may include a face portion 2355 (e.g., a strike face). The face portion 2355 may be used to impact a golf ball. The face portion 2355 may be associated with a loft plane that defines the loft angle of the golf club head 2300. The apparatus, methods, and articles of manufacture described herein are not limited in this regard.

Figure 23:
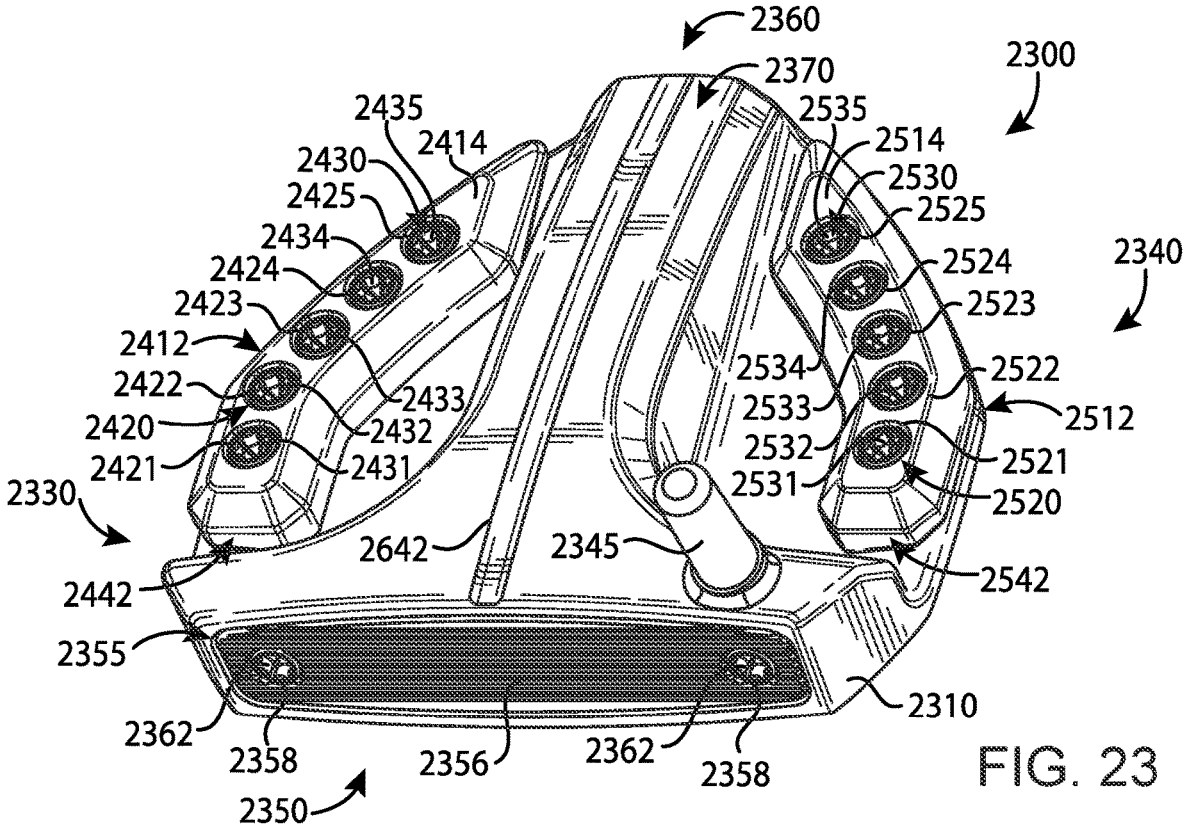
FIG. 23 depicts a front and top perspective view of a golf club head according to yet another example of the apparatus, methods, and articles of manufacture described herein.
Figure 24:
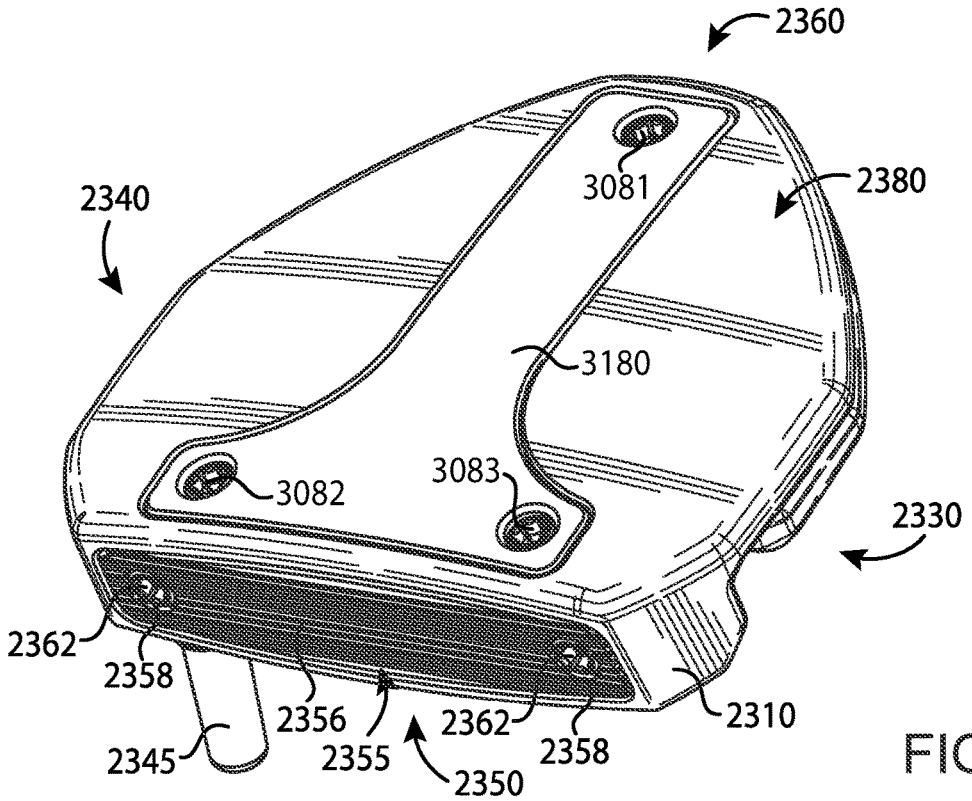
FIG. 24 depicts a front and bottom perspective view of the golf club head of FIG. 23.
Figure 25:
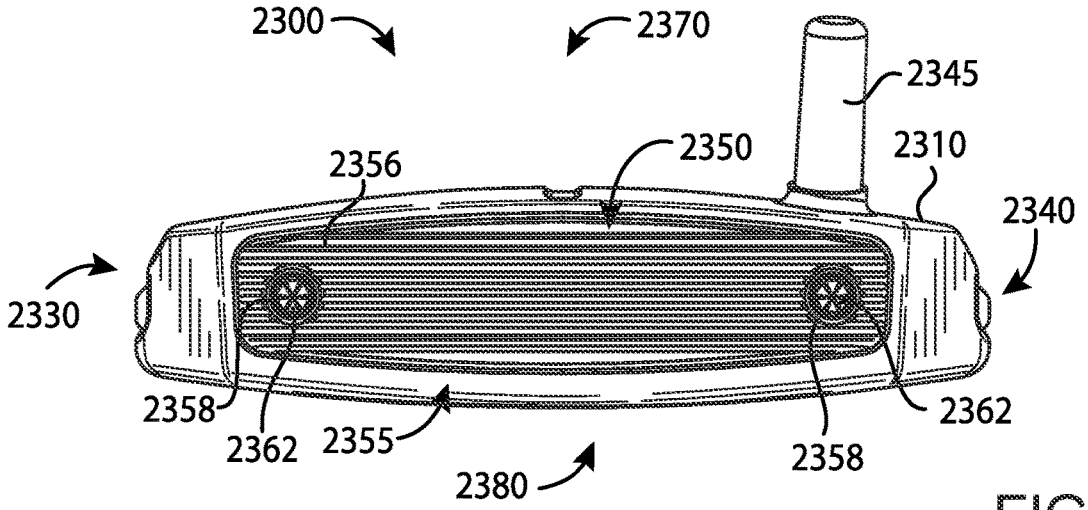
FIG. 25 depicts a front view of the golf club head of FIG. 23.
Figure 26:
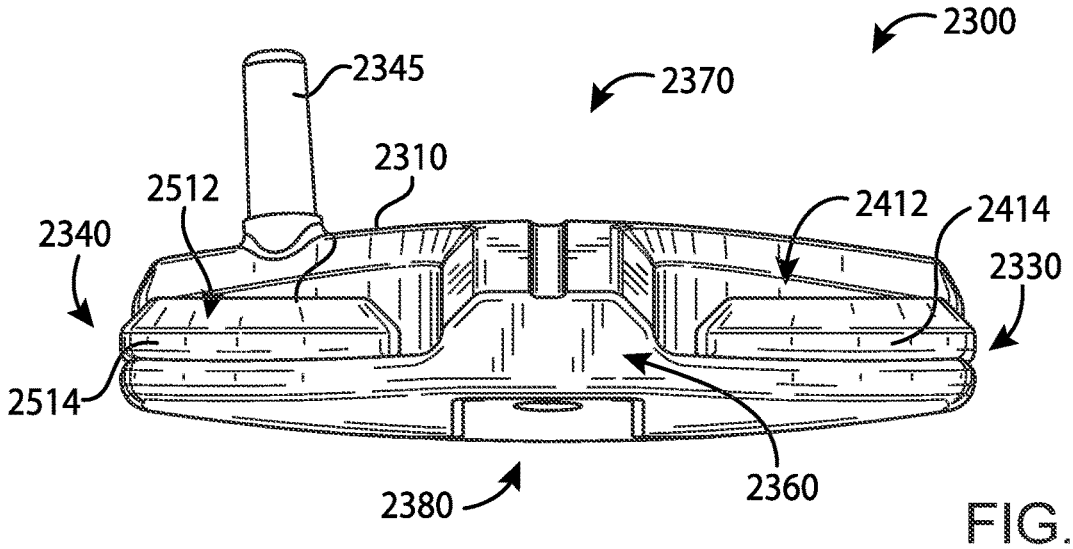
FIG. 26 depicts a rear view of the golf club head of FIG. 23.
Figure 27:
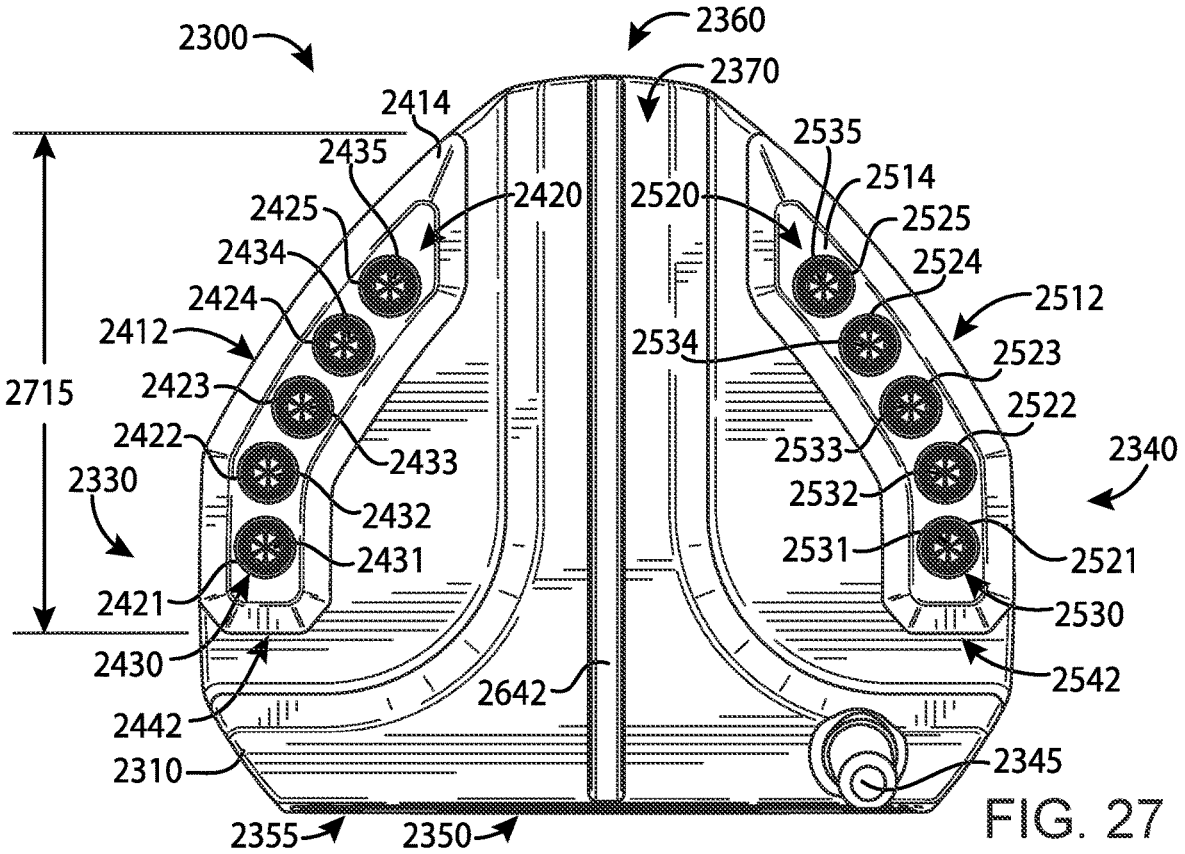
FIG. 27 depicts a top view of the golf club head of FIG. 23.

As illustrated in FIGS. 23 and 27, for example, the body portion 2310 may include two or more weight regions, generally shown as a first weight region 2412 and a second weight region 2512. The first weight region 2412 may include a first weight platform portion 2414 having a first set of weight ports 2420 (e.g., shown as weight ports 2421, 2422, 2423, 2424, and 2425). Each weight port of the first set of weight ports 2420 is configured to receive a weight portion of a first set of weight portions 2430 (e.g. shown as weight portions 2431, 2432, 2433, 2434 and 2435). The second weight region 2512 may include a second weight platform portion 2514 having a second set of weight ports 2520 (e.g., shown as weight ports 2521, 2522, 2523, 2524, and 2525). Each weight port of the second set of weight ports 2520 is configured to receive a weight portion of a second set of weight portions 2530 (e.g. shown as weight portions 2531, 2532, 2533, 2534 and 2535). Each weight portion of the first set of weight portions 2430 may be interchangeable with each weight portion of the second set of weight portions 2530. Accordingly, each weight port of the first set of weight ports 2420 and the second set of weight ports 2520 may be configured to interchangeably receive any of the weight portions of the first set of weight portions 2430 or the second set of weight portions 2530. The apparatus, methods, and articles of manufacture described herein are not limited in this regard.

Figure 28:
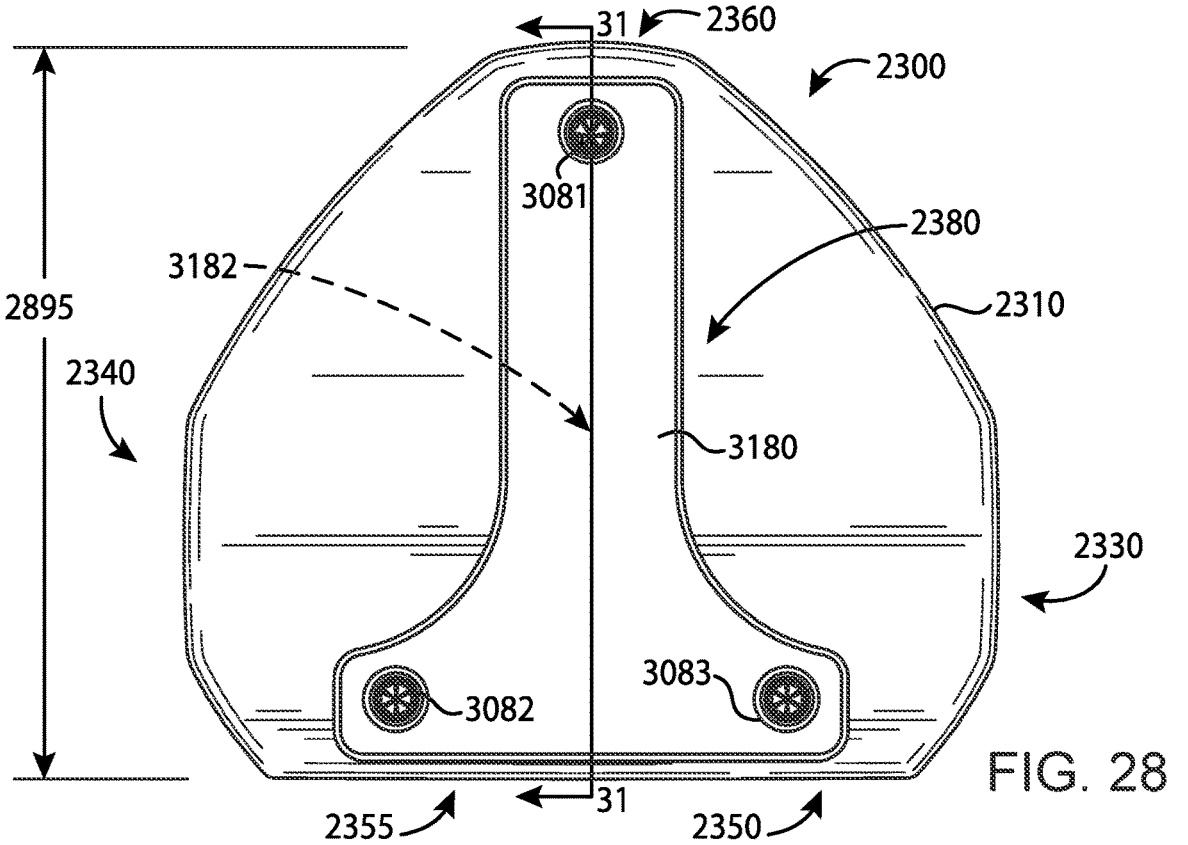
FIG. 28 depicts a bottom view of the golf club head of FIG. 23.
Figure 29:
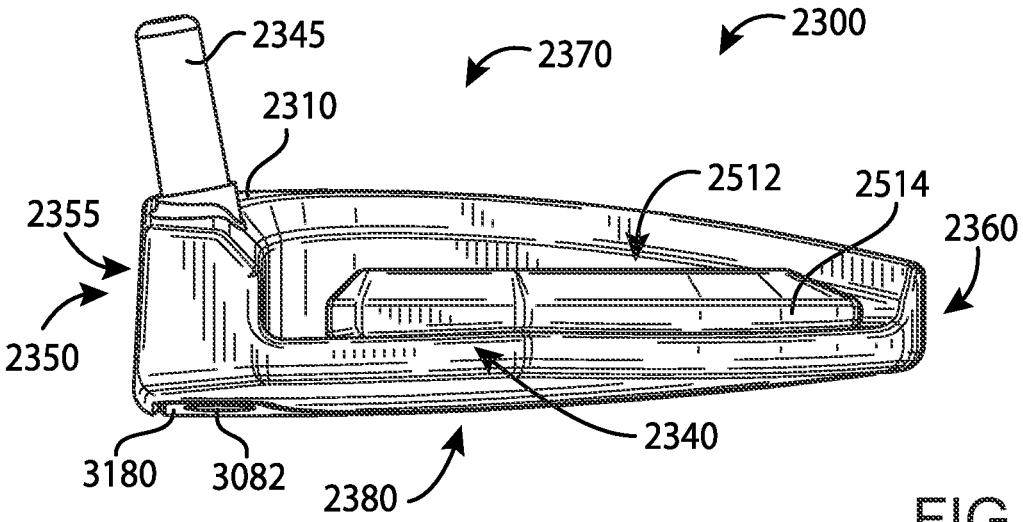
FIG. 29 depicts a left view of the golf club head of FIG. 23.
Figure 30:
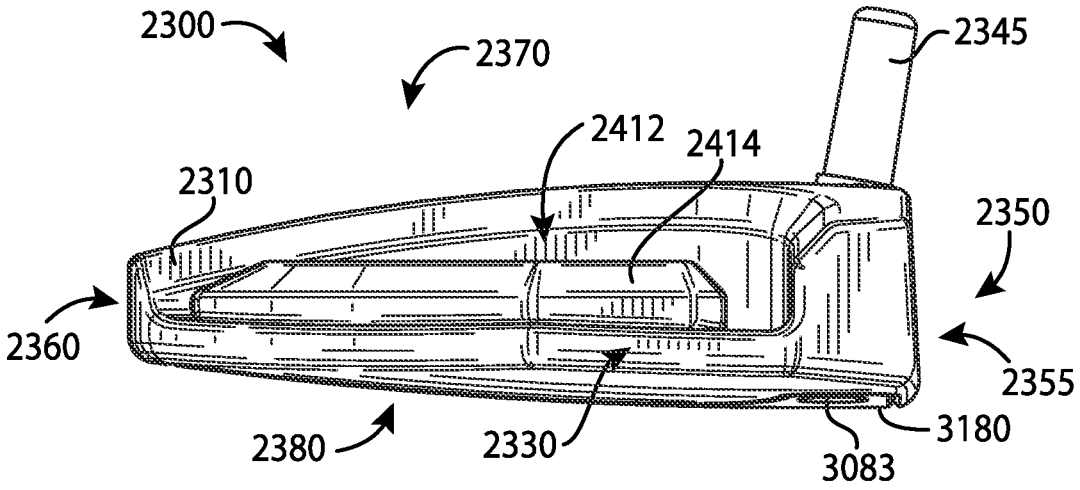
FIG. 30 depicts a right view of the golf club head of FIG. 23.

The first weight platform portion 2414 and the second weight platform portion 2514 may have a weight platform portion length ($L_{wp}$) 2715 that may be greater than about 40% of a body portion length ($L_B$) 2895 (FIG. 28). In one example, the weight platform portion length 2715 may be greater than 50% of the body portion length 2895. In one example, the weight platform portion length 2715 may be greater than 60% of the body portion length 2895. In one example, the weight platform portion length 2715 may be greater than 70% of the body portion length 2895. Accordingly, the mass of each of the first and second weight platform portions 2414 and 2514 may be distributed along a substantial portion of the body portion length 2895. The apparatus, methods, and articles of manufacture described herein are not limited in this regard.

The masses of the first and second weight platform portions 2414 and 2514 may be moved laterally outward on the body portion 2310. The mass of each of the first and second weight platform portions 2414 and 2514 may be between 5% and 30% of the mass of the body portion 2310 including the mass of the first weight platform portion 2414 and the second weight platform portion 2514. In one example, the mass of each of the first and second weight platform portions 2414 and 2514 may be between about 3% and about 13% of the mass of the body portion 2310 if the first and second weight platform portions 2414 and 2514 are made from relatively lighter metals such as metals including titanium or titanium alloys. In another example, the mass of each of the first and second weight platform portions 2414 and 2514 may be between about 8% and about 21% of the mass of the body portion 2310 if the first and second weight platform portions 2414 and 2514 are made from metals including steel. In yet another example, the mass of each of the first and second weight platform portions 2414 and 2514 may be between about 10% and about 30% of the mass of the body portion 2310 if the first and second weight platform portions 2414 and 2514 are made from relatively heavier metals such as metals including magnesium or magnesium alloys. Accordingly, between about 3% and about 30% of the mass of the body portion 2310 may be redistributed to the toe portion 2330 and the heel portion 2340 by the first and second weight platform portions 2414 and 2514 from other parts of the body portion 2310. Further, the first weight platform portion 2414 may be located at or proximate to the periphery of the toe portion 2330 and the second weight platform portion 2514 may be located at or proximate to the periphery of the heel portion 2340. The apparatus, methods, and articles of manufacture described herein are not limited in this regard.

Each weight port of the first set of weight ports 2420 may have a first port diameter ($PD_1$). In particular, a uniform distance of less than the first port diameter may separate any two adjacent weight ports of the first set of weight ports 2420 (e.g., (i) weight ports 2421 and 2422, (ii) weight ports 2422 and 2423, (iii) weight ports 2423 and 2424, or (iv) weight ports 2424 and 2425). In one example, the first port diameter may be about 0.25 inch (6.35 millimeters) and any two adjacent weight ports of the first set of weight ports 2420 may be separated by 0.1 inch (2.54 millimeters). Each weight port of the second set of weight ports 2520 may have a second port diameter ($PD_2$). A uniform distance of less than the second port diameter may separate any two adjacent weight ports of the second set of weight ports 2520 (e.g., (i) weight ports 2521 and 2522, (ii) weight ports 2522 and 2523, (iii) weight ports 2523 and 2524, or (iv) weight ports 2524 and 2525). For example, the second port diameter may be about 0.25 inch (6.35 millimeters) and any two adjacent weight ports of the second set of weight ports 2520 may be separated by 0.1 inch (2.54 millimeters). The first and second port diameters may be equal to each other (i.e., $PD_1=PD_2$). Alternatively, the first and second port diameters may be different. The apparatus, methods, and articles of manufacture described herein are not limited in this regard.

The first weight platform portion 1414, the first set of weight ports 2420 (weight ports 2421, 2422, 2423, 2424, and 2425), and/or the first set of weight portions 2430 (weight portions 2431, 2432, 2433, 2434, and 2435) may form a first visual guide portion 2442. The second weight platform portion 2514, the second set of weight ports 2520 (weight ports 2521, 2522, 2523, 2524, and 2525), and/or the second set of weight portions 2530 (weight portions 2531, 2532, 2533, 2534, and 2535) may form a second visual guide portion 2542. The first weight region 2412 may be located at or proximate to a periphery of the toe portion 2330 of the golf club head 2300. Accordingly, the first visual guide portion 2442 may be located at or proximate to the periphery of the toe portion 2330. The second weight region 2512 may be located at or proximate to the periphery of the heel portion 2340 of the golf club head 2300. Accordingly, the second visual guide portion 2542 may be located at or proximate to the periphery of the heel portion 2340. The first weight platform portion 2414 and/or any of the weight portions of the first set of weight portions 2430 may have distinct colors, markings and/or other visual features so as to be visually distinguished from the surrounding portions of the body portion 2310. Similarly, the second weight platform portion 2514 and/or any of the weight portions of the second set of weight portions 2530 may have distinct colors, markings and/or other visual features so as to be visually distinguished from the surrounding portions of the body portion 2310. The apparatus, methods, and articles of manufacture described herein are not limited in this regard.

The golf club head 2300 may also include a third visual guide portion 2642, which may be substantially equidistant from the first and second visual guide portions 2442 and 2542. For example, the third visual guide portion 2642 may extend between the front and rear portions 2350 and 2360 located at or proximate to a center of the body portion 2310. The third visual guide portion 2642 may be the same as or different from the first and/or second visual guide portions 2442 and 2542, respectively. In one example, the third visual guide portion 2642 may be a recessed line portion having a certain color. In another example, the third visual guide portion 2642 may include a plurality of weight ports (not shown) with a plurality of weight portions (not shown) received therein. Alternatively, the third visual guide portion 2642 may be defined by a raised portion of the top portion 2370. The third visual guide portion 2642 may be similar in many respects to any of the visual guide portions described herein. Therefore, a detailed description of the third visual guide portion 2642 is not provided. The apparatus, methods, and articles of manufacture described herein are not limited in this regard.

The first and second sets of weight portions 2430 and 2530, respectively, may have similar or different physical properties (e.g., density, shape, mass, volume, size, color, etc.). The first and second sets of weight portions 2430 and 2530, respectively, may include threads to secure in the weight ports of the first and second sets of weight ports 2420 and 2520, respectively. The physical properties of the weight portions of the first and second sets of weight portions 2430 and 2530, respectively, may be similar in many respects to any of the weight portions described herein. Therefore, a detailed description of the physical properties of the weight portions of the first and second sets of weight portions 2430 and 2530, respectively, is not provided. The apparatus, methods, and articles of manufacture described herein are not limited in this regard.

The first weight platform portion 2414 may be attached to the body portion 2310 with any one or more weight portions of the first set of weight portions 2430 or the second set of weight portions 2530. The body portion 2310 may include a plurality of toe side threaded bores (not shown) on the top portion 2370 at or proximate to the toe portion 2330. When the first weight platform portion 2414 is placed on the top portion 2370 at or proximate to the periphery of the toe portion 2330 as shown in FIGS. 23 and 27, for example, the toe side threaded bores may generally align with the weight ports of the first set of weight ports 2420. When a weight portion of the first set of weight portions 2430 or the second set of weight portions 2530 is inserted in a weight port of the first set of weight ports 2420, the weight portion extends through a corresponding one of the toe side threaded bores of the body portion 2310 such that the threads on the weight portion engage the corresponding threads in the toe side threaded bore. The weight portion can then be screwed into the corresponding toe side threaded bore to fasten the first weight platform portion 2414 on the body portion 2310. The apparatus, methods, and articles of manufacture described herein are not limited in this regard.

The second weight platform portion 2514 may be attached to the body portion 2310 with any one or more weight portions of the first set of weight portions 2430 or the second set of weight portions 2530. The body portion 2310 may include a plurality of heel side threaded bores (not shown) on the top portion 2370 at or proximate to the heel portion 2340. When the second weight platform portion 2514 is placed on the top portion 2370 at or proximate to the periphery of the heel portion 2340 as shown in FIGS. 23 and 27, for example, the heel side threaded bores generally align with the weight ports of the second set of weight ports 2520. When a weight portion of the first set of weight portions 2430 or the second set of weight portions 2530 is inserted in a weight port of the second set of weight ports 2520, the weight portion extends through a corresponding one of the heel side threaded bores of the body portion 2310 such that the threads on the weight portion engage the corresponding threads in the heel side threaded bore. The weight portion can then be screwed into the corresponding heel side threaded bore to fasten the second weight platform portion 2514 on the body portion 2310. The apparatus, methods, and articles of manufacture described herein are not limited in this regard.

Each of the weight portions of the first and second sets of weight portions 2430 and 2530, respectively, may have sufficient length to extend through a weight port and into a corresponding threaded bore of the body portion 2310 as described herein to fasten the first weight platform portion 2414 and the second weight platform portion 2514 to the body portion 2310. One or more weight portions of the first set of weight portions 2430 and/or one or more weight portions of the second set of weight portions 2530 may function both as weights for configuring a weight distribution of the golf club head 2300 and as fasteners for fastening the first weight platform portion 2414 and/or the second weight platform portion 2514 on the body portion 2310. Alternately, the first weight platform portion 2414 and/or the second weight platform portion 2514 may be fastened on the body portion 2310 by using other types of fastening mechanisms such that one or more weight portions of the first set of weight portions 2430 and/or one or more weight portions of the second set of weight portions 2530 may only function as weight portions. The apparatus, methods, and articles of manufacture described herein are not limited in this regard.

Each of the first and second weight platform portions 2414 and 2514, respectively, may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The first and second weight platform portions 2414 and 2514, respectively, may have a similar mass or different masses to optimally affect the weight distribution, center or gravity location, and/or moment of inertia of the golf club head 2300. Each of the first and second weight platform portions 2414 and 2514 may function as an added weight for the body portion 2310 and as a platform for receiving additional weights for the body portion 2310 in the form of the first and second sets of weight portions 2430 and 2530. Thus, the physical properties and the materials of construction of the first and second weight platform portions 2414 and/or 2514 may be determined to optimally affect the weight, weight distribution, center of gravity (CG), moment of inertia (MOI) characteristics, structural integrity and/or or other static and/or dynamic characteristics of the golf club head 2300. The apparatus, methods, and articles of manufacture described herein are not limited in this regard.

In one example, the face portion 2355 may be in one-piece with the body portion 2310 or be an integral part of the body portion 2310 (not shown). The face portion 2355 may include a separate piece or an insert coupled to the body portion 2310. The face portion 2355 may include a face insert 2356, which may be attached to the front portion 2350 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 23-25, the face insert 2356 may include two fastener holes 2358 proximate to the toe portion and heel portion of the face insert 2356. Each of the fastener holes 2358 may be configured to receive a fastener 2362 for attachment of the face insert 2356 to the body portion 2310. The body portion 2310 may include two fastener ports (not shown) configured to receive the fasteners 2362. The fasteners 2362 may be similar or substantially similar to the weight portions of the first set of weight portions 2430 and/or the weight portions of the second set of weight portions 2530. Accordingly, the fasteners 2362 may function both as weights for configuring a weight distribution of the golf club head 2300 and as fasteners for fastening the face insert 2356 to the face portion 2355. Each fastener port may have internal threads that are configured to engage external threads on the fasteners 2362. The fastener ports of the body portion 2310 may be similar in many respects to the fastener ports 1768 of the golf club head 1700 described herein. The apparatus, methods, and articles of manufacture described herein are not limited in this regard.

The face portion 2355 may include a peripheral recessed portion 3172 (shown in FIG. 31) configured to receive the face insert 2356. As shown by example in FIG. 31, the depth of the peripheral recessed portion 3172 may be similar to the thickness of the face insert 2356 such that when the face insert 2356 is fastened to the body portion 2310, the face insert 2356 is positioned flush or substantially flush with the face portion 2355. Alternatively, the face insert 2356 may project from the face portion 2355. The apparatus, methods, and articles of manufacture described herein are not limited in this regard.

As described, the fasteners 2362 may be similar or substantially similar to the weight portions of the first set of weight portions 2430 and/or the weight portions of the second set of weight portions 2530 so that the fasteners 2362 may function to configure the weight distribution of the golf club head 2300. Accordingly, the fasteners 2362 may have similar or different weights to balance and/or provide heel or toe weight bias for the golf club 2300. For example, the weight of the body portion 2310 may be increased or decreased by similarly increasing or decreasing, respectively, the weights of the fasteners 2362. In one example, the golf club head 2300 may be provided with a toe-biased weight configuration by having the fastener 2362 that is closer to the toe portion 2330 be heavier than the fastener 2362 that is closer to the heel portion 2340. Conversely, the golf club head 2300 may be provided with a heel-biased weight configuration by having the fastener 2362 that is closer to the heel portion 2340 be heavier than the fastener 2362 that is closer to the toe portion 2330. The apparatus, methods, and articles of manufacture described herein are not limited in this regard.

To attach the face insert 2356 to the body portion 2310, the face insert 2356 may be inserted in the peripheral recessed portion 3172, thereby generally aligning the fastener holes 2358 of the face insert 2356 and the fastener ports (not shown) of the body portion 2310. The fasteners 2362 can be inserted through the fastener holes 2358 and screwed into the fastener ports of the body portion 2310 to securely attach the face insert 2356 to the body portion 2310. The face insert 2356 may be constructed from any material such as metal, metal alloys, plastic, wood, composite materials or a combination thereof to provide a certain ball striking characteristic to the golf club head 2300. The material from which the face insert 2356 is manufactured may affect ball speed and spin characteristics. Accordingly, the face insert 2356 may be selected to provide a certain ball speed and spin characteristics for an individual. Thus, the face insert 2356 may be interchangeable with other face inserts having different ball speed and spin characteristics. The face insert 2356 may be coupled to the body portion 2310 by other methods or devices, such as by bonding, welding, adhesive and/or other types of fastening devices and/or methods. The apparatus, methods, and articles of manufacture described herein are not limited in this regard.

The body portion 2310 may include an interior cavity 3182 (shown in FIG. 31) extending between the front portion 2350 and the rear portion 2360 and between the toe portion 2330 and the heel portion 2340. The interior cavity 3182 may be open or accessible at the face portion 2355 and/or at the sole portion 2380. Accordingly, the interior cavity 3182 may have a first opening 3176 at the face portion 2355 and/or a second opening 3178 at the sole portion 2380. The interior cavity 3182 allows the mass of the body portion 2310 to be removed at or around the center portion of the body portion 2310 so that removed mass may be redistributed to the toe portion 2330 and the heel portion 2340 using the first weight platform portion 2414 and the second weight platform portion 2514 without affecting or substantially affecting the overall mass of the golf club head 2300. The apparatus, methods, and articles of manufacture described herein are not limited in this regard.

Figure 31:
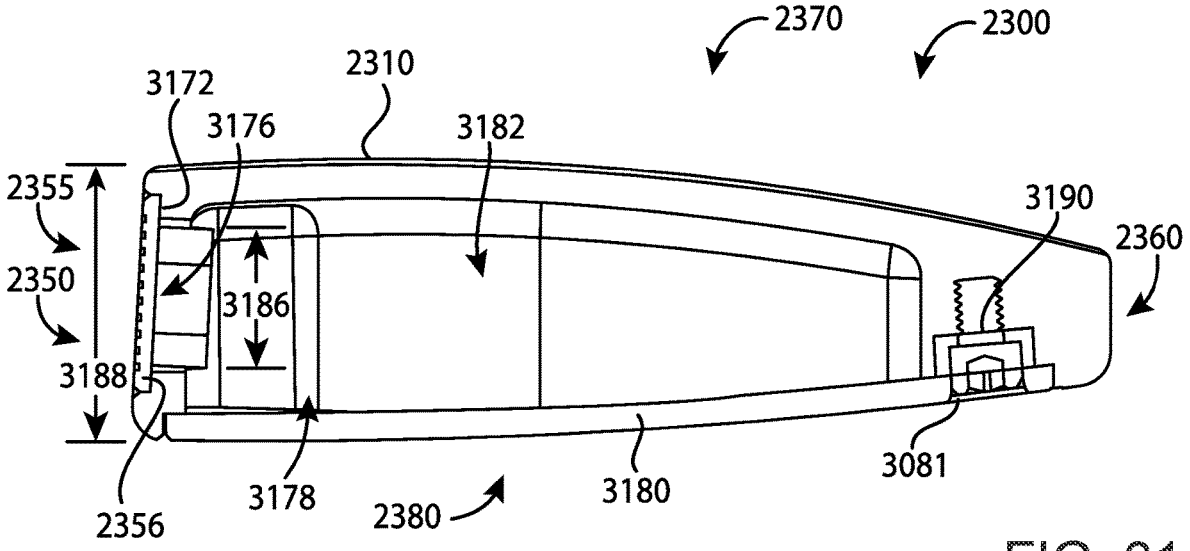
FIG. 31 depicts a cross-sectional view of the golf club head of FIG. 23 taken at lines 31-31 of FIG. 31.
Figure 32:
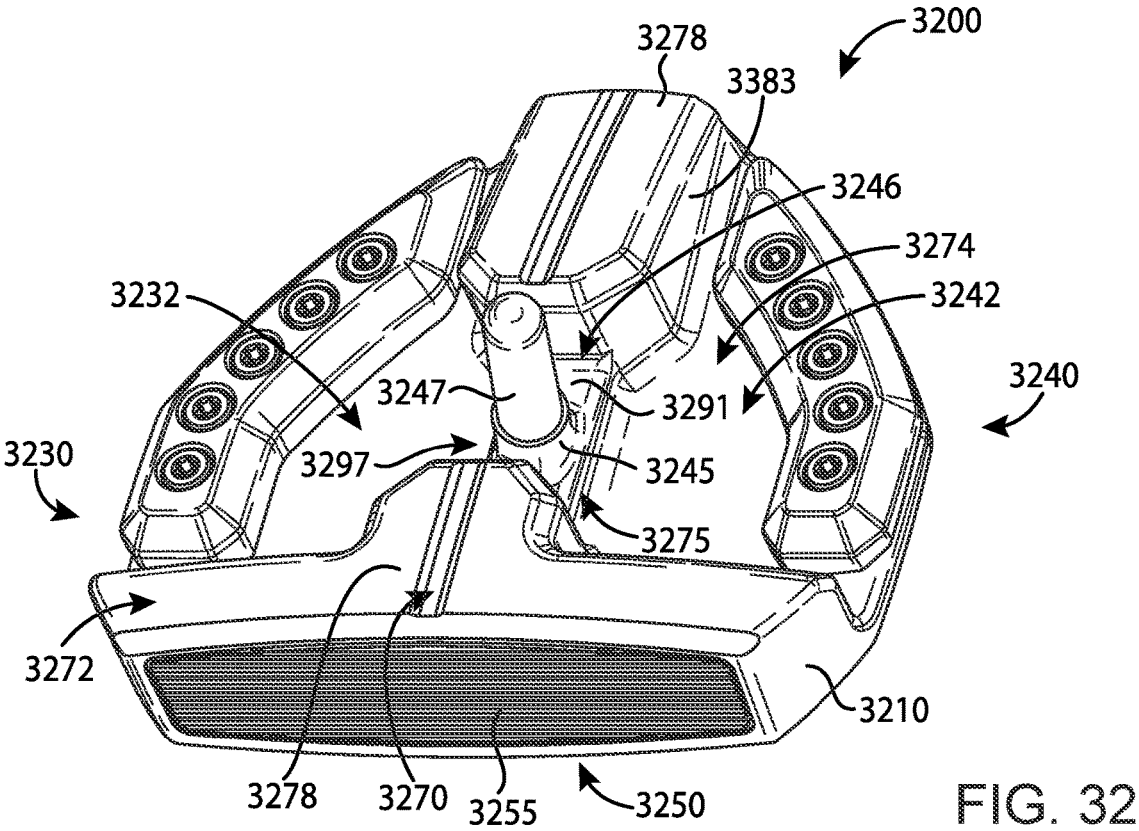
FIG. 32 depicts a front and top perspective view of a golf club head according to yet another example of the apparatus, methods, and articles of manufacture described herein.
Figure 33:
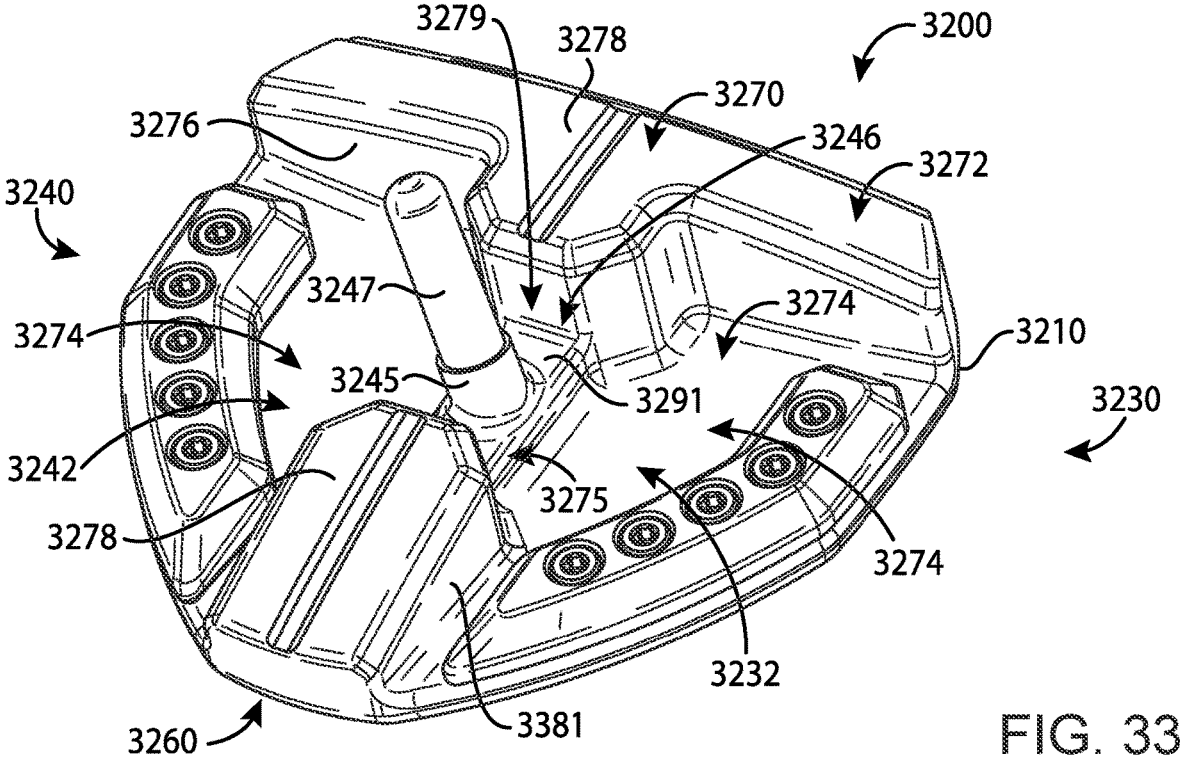
FIG. 33 depicts a rear and top perspective view of the golf club head of FIG. 32.
Figure 34:
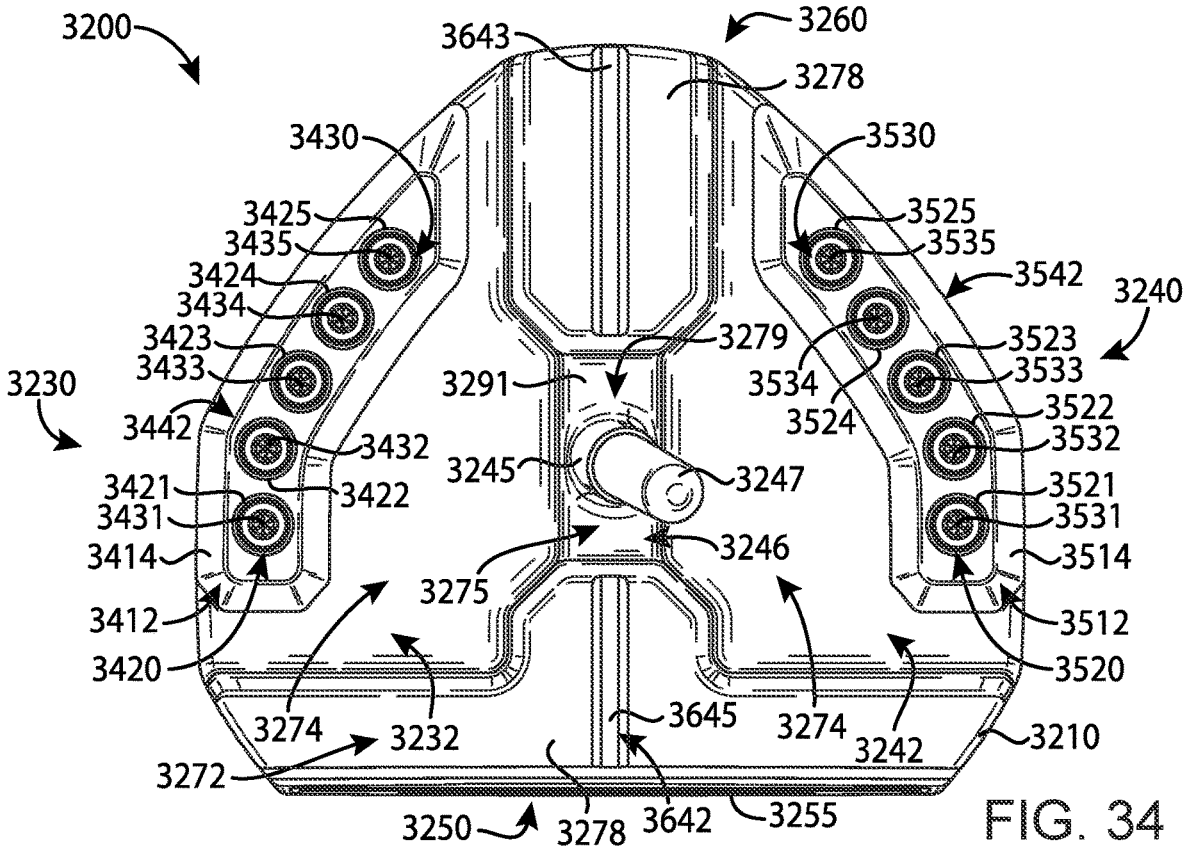
FIG. 34 depicts a top view of the golf club head of FIG. 32.
Figure 35:
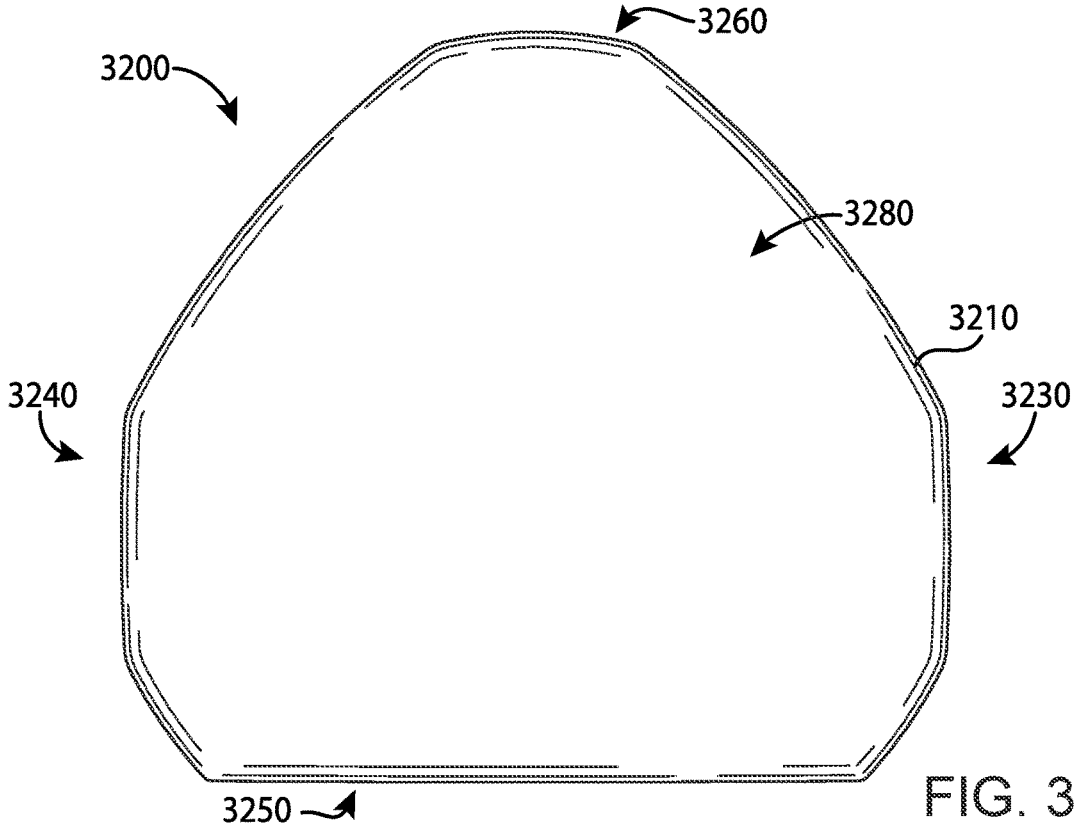
FIG. 35 depicts a bottom view of the golf club head of FIG. 32.
Figure 36:
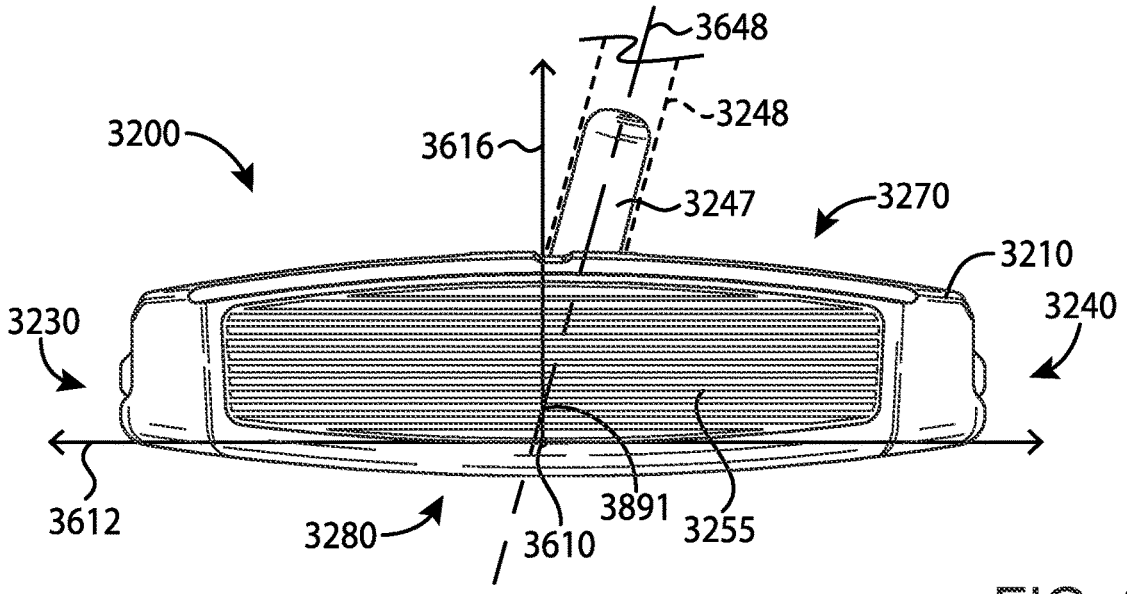
FIG. 36 depicts a front view of the golf club head of FIG. 32.
Figure 37:
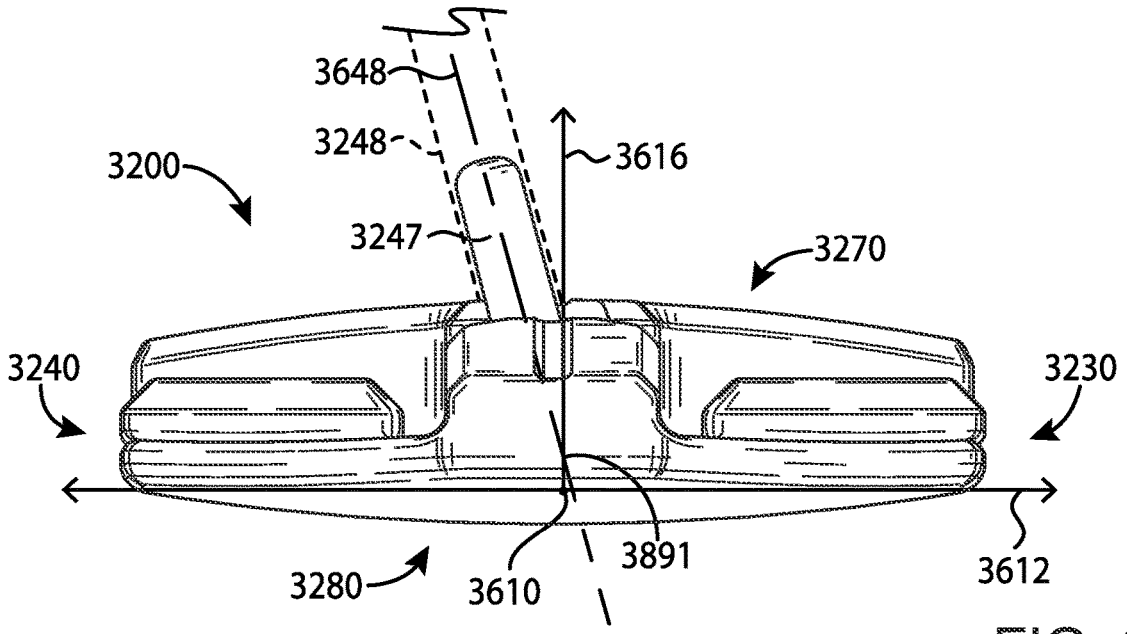
FIG. 37 depicts a rear view of the golf club head of FIG. 32.
Figure 38:
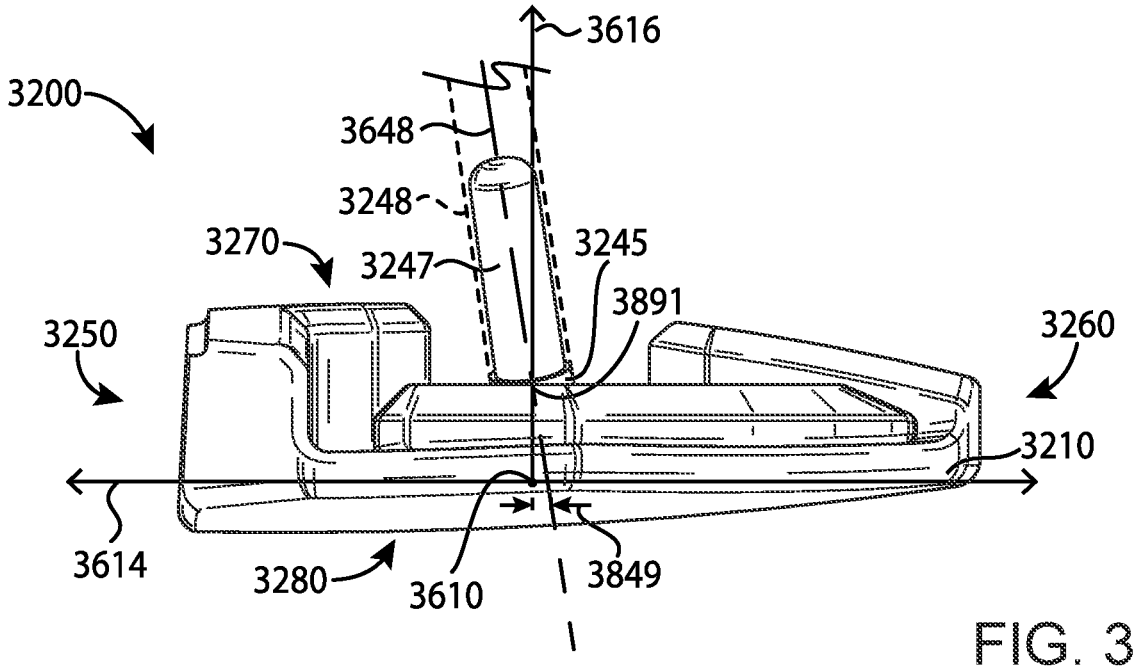
FIG. 38 depicts a left view of the golf club head of FIG. 32.
Figure 39:
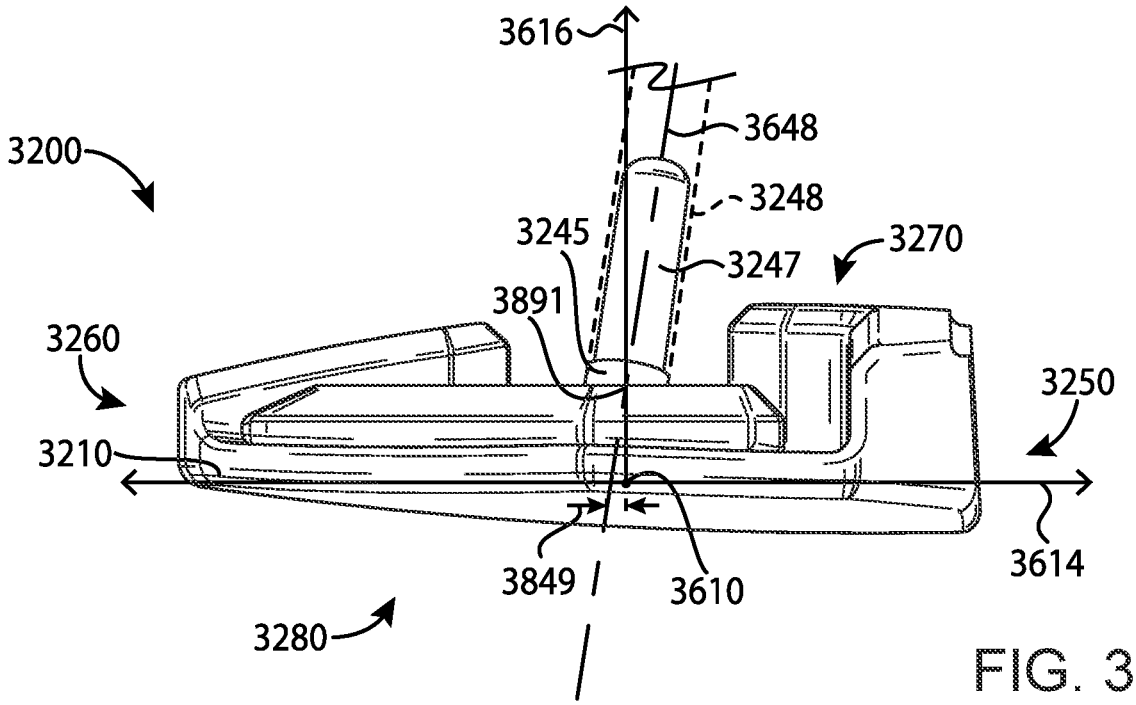
FIG. 39 depicts a right view of the golf club head of FIG. 32.

In one example as shown in FIGS. 28 and 31, the interior cavity 3182 may be covered at the face portion 2355 by the face insert 2356 and at the sole portion 2380 by a cover or sole plate 3180. In one example, the sole plate 3180 may have a mass between 7% and 17% of the mass of the golf club head 2300. In one example, the sole plate 3180 may have a mass between 10% and 15% of the mass of the golf club head 2300. As described herein, the interior cavity 3182 allows the mass of the body portion 2310 to be removed at or around the center portion of the body portion 2310. The removed mass can be also redistributed to the sole portion 2380 using the sole plate 3180 to lower the CG of the golf club head 2300 without affecting or substantially affecting the overall mass of the golf club head 2300. The apparatus, methods, and articles of manufacture described herein are not limited in this regard.

The sole plate 3180 may be attached to the sole portion 2380 with one or more fasteners. In the example of FIGS. 24 and 28-31, the sole plate 3180 may be attached to the sole portion 2380 with fasteners 3081, 3082, and 3083 to cover the second opening 3178 of the interior cavity 3182 at the sole portion 2380. Each of the fasteners 3081, 3082, and 3083 may have a threaded portion that is configured to engage a correspondingly threaded bore 3190 (shown in FIG. 31) in the body portion 2310. The fasteners 3081, 3082, and/or 3083 may be similar or substantially similar to the weight portions of the first set of weight portions 2430 and/or the weight portions of the second set of weight portions 2530. Accordingly, the fasteners 3081, 3082, and/or 3083 may function both as weights for configuring a weight distribution of the golf club head 2300 and as fasteners for fastening the sole plate 3180 to the sole portion 2380. The fasteners 3081, 3082, and/or 3083 may also lower the CG of the golf club head 2300 by adding more mass to the sole portion 2380 without affecting or substantially affecting the overall mass of the golf club head 2300 as described herein with respect to the sole plate 3180. The apparatus, methods, and articles of manufacture described herein are not limited in this regard.

The sole plate 3180 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The physical properties and the materials of construction of the sole plate 3180 may be determined to optimally affect the weight, weight distribution, CG, MOI characteristics, structural integrity and/or or other static and/or dynamic characteristics of the golf club head 2300. The apparatus, methods, and articles of manufacture described herein are not limited in this regard.

The interior cavity 3182 may extend from near the toe portion 2330 to near the heel portion 2340 and from near the top portion 2370 to near the sole portion 2380. Alternatively, the interior cavity 3182 may extend between the front portion 2350 and the rear portion 2360 and include a portion of the body portion 2310 between the toe portion 2330 and near the heel portion 2340 and between the top portion 2370 and near the sole portion 2380. In one example, a portion of the interior cavity 3182 may be located proximate to the regions of the face portion 2355 that generally strike a golf ball. In one example, the interior cavity 3182 may be only at the face portion 2355 similar to the interior cavity 1782 of the golf club head 1700 described herein. The apparatus, methods, and articles of manufacture described herein are not limited in this regard.

The interior cavity 3182 proximate to the face portion 2355 may be associated with a cavity height 3186 ($H_C$), and the body portion 2310 proximate to the face portion 2355 may be associated with a body height 3188 ($H_B$). While the cavity height 3186 and the body height 3188 may vary between the toe and heel portions 2330 and 2340, the front and rear portions 2350 and 2360, and the top and sole portions 2370 and 2380, the cavity height 3186 may be at least 50% of the body height 3188 ($H_C > 0.5 * H_B$) proximate to the face portion 2355 or an any location of the interior cavity 3182. For example, the cavity height 3186 may vary between 70% and 85% of the body height 3188. With the cavity height 3186 of the interior cavity 3182 being greater than 50% of the body height 3188, the golf club head 2300 may produce relatively more consistent feel, sound, and/or result when the golf club head 2300 strikes a golf ball via the face portion 2355 than a golf club head with a cavity height of less than 50% of the body height. However, the cavity height 3186 may be less than 50% of the body height 3188. The apparatus, methods, and articles of manufacture described herein are not limited in this regard.

In one example, the interior cavity 3182 may be unfilled (i.e., empty space). Alternatively, the interior cavity 3182 may be partially or entirely filled with a filler material (not shown) to absorb shock, isolate vibration, and/or dampen noise when the face portion 2355 strikes a golf ball. The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3182 may be filled with a TPE material to absorb shock, isolate vibration, and/or dampen noise when the golf club head 2300 strikes a golf ball via the face portion 2355. In one example, the mass of the filler material (e.g., TPE, TPU, etc.) may be between 3% and 13% of the mass of the golf club head 2300. In one example, the mass of the filler material may be between 6% and 10% of the mass of the golf club head 2300. The apparatus, methods, and articles of manufacture described herein are not limited in this regard.

In another example, the filler material may be a polymer material such as an ethylene copolymer material to absorb shock, isolate vibration, and/or dampen noise when the golf club head 2300 strikes a golf ball via the face portion 2355. In particular, at least 50% of the interior cavity 3182 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3182 may be partially or fully filled with the filler material. In one example, the interior cavity 3182 may be filled with the filler material from the first opening 3176 and/or the second opening 3178 prior to attaching the face insert 2356 and/or the sole plate 3180, respectively, to the body portion 2310. In one example, the interior cavity 3182 may be filled with the filler material after the face insert 2356 and the sole plate 3180 are attached to the body portion 2310 by injecting the filler material into the interior cavity 3182 through one or more ports (not shown) on the sole plate 3180. The filler material may be injected into the interior cavity 3182 from one or more ports on the sole plate 3180 while the air inside the interior cavity 3182 that is displaced by the filler material may exit the interior cavity 3182 from one or more other ports on the sole plate 3180. The apparatus, methods, and articles of manufacture described herein are not limited in this regard.

For example, at least 50% of the interior cavity 3182 may be filled with the filler material to absorb shock, isolate vibration, dampen noise, and/or provide structural support when the golf club head 2300 strikes a golf ball via the face portion 2355. With the filler material, the face portion 2355 may be relatively thin without degrading the structural integrity, sound, and/or feel of the golf club head 2300. In one example, the face portion 2355 may have a thickness of less than or equal to 0.075 inch (1.905 millimeters). In another example, the face portion 2355 may have a thickness of less than or equal to 0.060 inch (1.524 millimeters). In yet another example, the face portion 2355 may have a thickness of less than or equal to 0.050 inch (1.270 millimeters). Further, the face portion 2355 may have a thickness of less than or equal to 0.030 inch (0.762 millimeters). The apparatus, methods, and articles of manufacture described herein are not limited in this regard.

In the example of FIGS. 32-39, a golf club head 3200 may include a body portion 3210 having a toe portion 3230, a heel portion 3240, a front portion 3250, a rear portion 3260, a top portion 3270, and a sole portion 3280. The body portion 3210 may include a hosel portion 3245 having a stem portion 3247 configured to receive a shaft 3248 with a grip (not shown). The grip may be on one end of the shaft 3248 and the golf club head 3200 on the opposite end of the shaft 3248 to form a golf club. Alternatively, the body portion 3210 may include a bore (not shown) for receiving the shaft 3248. The front and rear portions 3250 and 3260, respectively, may be on opposite ends of the body portion 3210. The front portion 3250 may include a face portion 3255 (e.g., a strike face). The face portion 3255 may be used to impact a golf ball. The face portion 3255 may be associated with a loft plane that defines the loft angle of the golf club head 3200. The body portion 3210 may be manufactured by any method and/or processes including the methods and/or processes described herein. The body portion 3210 may be partially or entirely made from any material including any of the materials described herein. The body portion 3210 may be any type of golf club head having a certain volume. Although FIGS. 32-39 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The top portion 3270 may include an upper portion 3272 and a lower portion 3274. The upper portion 3272 of the top portion 3270 may extend from the front portion 3250 toward the rear portion 3260. The upper portion 3272 may transition into the lower portion 3274 by a back wall portion 3276 and a center portion 3278. The back wall portion 3276 may be opposite the face portion 3255. The center portion 3278 may extend from the front portion 3250 to the rear portion 3260 and may be equidistant from the toe portion 3230 and the heel portion 3240. The center portion 3278 may include side walls 3381 and 3383 that extend from the back wall portion 3276 to the rear portion 3260. Accordingly, the center portion 3278 defines a toe side portion 3232 of the lower portion 3274 and a heel side portion 3242 of the lower portion 3274. The center portion 3278 may include a recess portion 3279 that extends from the upper portion 3272 to the lower portion 3274. The center portion 3278 may include an intermediate portion 3275 located in the recess portion 3279. The intermediate portion 3275 may be positioned higher than the lower portion 3274 and lower than the upper portion 3272. In other words, the intermediate portion 3275 may be positioned between the lower portion 3274 and the upper portion 3272. In one example, the intermediate portion 3275 may serve as a platform for the hosel portion 3245. The apparatus, methods, and articles of manufacture described herein are not limited in this regard.

In one example, as shown in FIGS. 32-39, the hosel portion 3245 may be located at or proximate a central area 3246 of the body portion 3210 such that a center axis 3648 of the shaft 3248 may pass through or pass near a CG 3610 of the golf club head 3200. The stem portion 3247 and the shaft 3248 may be concentric, and therefore, the center axis 3648 may correspond to a centerline longitudinal axis that is common to both the stem portion 3247 and the shaft 3248. The CG 3610 of the golf club head 3200 may be the origin of CG coordinate axes with a CG x-axis 3612, a CG y-axis 3614, and a CG z-axis 3616. In one example, the CG x-axis 3612 may correspond to a transverse axis of the golf club head 3200, the CG y-axis 3614 may correspond to a longitudinal axis of the golf club head 3200, and the CG z-axis 3616 may correspond to a vertical axis of the golf club head 3200. The apparatus, methods, and articles of manufacture described herein are not limited in this regard.

For the center axis 3648 of the shaft 3248 to pass through or pass near the CG 3610 as described herein, any portion of the hosel portion 3245 may intersect or be located near a vertical plane that generally faces the front portion 3250 and the rear portion 3260 and is defined by the CG x-axis 3612 and the CG z-axis 3616 (i.e., the CG xz plane) and a vertical plane that generally faces the heel portion 3240 and the toe portion 3230 and is defined by the CG y-axis 3614 and the CG z-axis 3616 (i.e., the CG yz plane). Any portion of the hosel portion 3245 may also intersect or be located near a horizontal plane that generally faces the top portion 3270 and the sole portion 3280 and is defined by the CG x-axis 3612 and the CG y-axis 3614 (i.e., the CG xy plane). The apparatus, methods, and articles of manufacture described herein are not limited in this regard.

In one example, as shown in FIGS. 32-39, the hosel portion 3245 may be located in the recess portion 3279 and/or in the lower portion 3274 of the top portion 3270. In other words, the hosel portion 3245 may be located as low as possible on the body portion 3210 so as to be as close as possible to the horizontal plane defined by the CG x-axis 3612 and the CG y-axis 3614 (i.e., the CG xy plane). Accordingly, the recess portion 3279 allows the hosel portion 3245 to intersect or be located near the horizontal plane defined by the CG x-axis 3612 and the CG y-axis 3614 (i.e., the CG xy plane). In another example, the hosel portion 3245 may be located at any vertical location relative to the CG 3610 as long as the center axis 3648 of the shaft 3248 passes through or passes near the CG 3610 of the golf club head 3200 as described herein. For example, the hosel portion 3245 may be located at or proximate (e.g., directly above) the CG 3610. In an alternative example, the golf club head 3200 may not include the recess portion 3279 and may be similar to the golf club head 2300 of FIGS. 23-31. As such, and in the absence of the recess portion 3279, the hosel portion 3245 may be located at a more elevated position on the top portion 3270 while the center axis 3648 of the shaft 3248 passes through or passes near the CG 3610 of the golf club head 3200 as described herein. The apparatus, methods, and articles of manufacture described herein are not limited in this regard.

In the example of FIGS. 32-39, at least the stem portion 3247 of the hosel portion 3245 may be tilted relative to a top surface 3291 of the intermediate portion 3275. Additionally or alternatively, at least the stem portion 3247 of the hosel portion 3247 may be tilted relative to the CG Z-axis 3616. In one example, at least the stem portion 3247 of the hosel portion 3245 may lean in a forward direction toward the front portion 3250 and either the heel portion 3240 or the toe portion 3230. Alternatively, at least the stem portion 3247 of the hosel portion 3245 may lean in a rearward direction toward the rear portion 3260 and either the heel portion 3240 or the toe portion 3230. Alternatively still, at least the stem portion 3247 of the hosel portion 3245 may lean in a direction toward only the front portion 3250, only the rear portion 3260, only the heel portion 3240, or only the toe portion 3230. The apparatus, methods, and articles of manufacture described herein are not limited in this regard.

In one example, the center axis 3648 of the shaft 3248 may intersect the CG z-axis 3616 at a point (e.g., point 3891 shown in FIGS. 36-39) located above the CG 3610 such that the center axis 3648 of the shaft 3248 and the CG 3610 are separated by a distance 3849 in the horizontal plane that is defined by the CG x-axis 3612 and the CG y-axis 3614 (i.e., the CG xy plane). The distance 3849 between the center axis 3648 of the shaft 3248 and the CG 3610 may be greater than or equal to 0.0 inch and less than or equal to about 0.25 inch (0.635 cm). In another example, the distance 3849 between the center axis 3648 of the shaft 3248 and the CG 3610 may be greater than or equal to 0.0 inch and less than or equal to about 0.2 inch (0.508 cm). In yet another example, the distance 3849 between the center axis 3648 of the shaft 3248 and the CG 3610 may be greater than or equal to 0.0 inch and less than or equal to about 0.1 inch (0.254 cm). With respect to any of the foregoing examples, the distance 3849 may correspond to the shortest distance from the CG 3610 to the center axis 3648 of the shaft 3248. Alternatively, the distance 3948 may correspond to some other distance from the CG 3610 to the center axis 3648 of the shaft 3248. The apparatus, methods, and articles of manufacture described herein are not limited in this regard.

In the example of FIGS. 32-39, the body portion 3210 may include a first weight region 3412 and a second weight region 3512. The first weight region 3412 may be located on the toe side 3232 of the lower portion 3274 and include a first weight platform portion 3414 having a first set of weight ports 3420 (e.g., shown as weight ports 3421, 3422, 3423, 3424, and 3425) configured to receive a weight portion of a first set of weight portions 3430 (e.g. shown as weight portions 3431, 3432, 3433, 3434, and 3435). The second weight region 3512 may be located on the heel side 3242 of the lower portion 3274 and include a second weight platform portion 3514 having a second set of weight ports 3520 (e.g., shown as weight ports 3521, 3522, 3523, 3524, and 3525) configured to receive a weight portion of a second set of weight portions 3530 (e.g. shown as weight portions 3531, 3532, 3533, 3534, and 3535). The weight regions 3412 and 3512, the first and second weight platform portions 3414 and 3514, the first set of weight ports 3420 (e.g., shown as weight ports 3421, 3422, 3423, 3424, and 3425), the second set of weight ports 3520 (e.g., shown as weight ports 3521, 3522, 3523, 3524, and 3525), the first set of weight portions 3430 (e.g. shown as weight portions 3431, 3432, 3433, 3434, and 3435), and the second set of weight portions 3530 (e.g. shown as weight portions 3531, 3532, 3533, 3534, and 3535) may be similar in many respects to the weight regions, weight platform portions, weight ports, and/or weight portions of the golf club head 2300 of FIGS. 23-31. The apparatus, methods, and articles of manufacture described herein are not limited in this regard.

The first weight platform portion 3414, the first set of weight ports 3420 (e.g., weight ports 3421, 3422, 3423, 3424, and 3425), and/or the first set of weight portions 3430

(e.g., weight portions 3431, 3432, 3433, 3434, and 3435) may form a first visual guide portion 3442. The second weight platform portion 3514, the second set of weight ports 3520 (weight ports 3521, 3522, 3523, 3524, and 3525), and/or the second set of weight portions 3530 (weight portions 3531, 3532, 3533, 3534, and 3535) may form a second visual guide portion 3542. The golf club head 3200, and more particularly, the center portion 3278 may also include a third visual guide portion 3642, which may be substantially equidistant from the first and second visual guide portions 3442 and 3542. For example, the third visual guide portion 3642 may extend between the front and rear portions 3250 and 3260 located at or proximate to a center of the body portion 3210. The third visual guide portion 3642 may have a first portion 3643 that may extend from the rear portion 3260 to the recess portion 3279 and a second portion 3645 that may be aligned with the first portion 3643 and extend from the recess portion 3279 to the front portion 3250. Accordingly, the first and second portions 3643 and 3645 of the third visual guide portion 3642 may be separated from one another by the recess portion 3279, and the hosel portion 3245 and the shaft 3248 may be positioned between the first and second portions 3643 and 3645 of the third visual guide portion 3642. The third visual guide portion 3642 may be the same as or different from the first and/or second visual guide portions 3442 and 3542, respectively. In one example, the third visual guide portion 3642 may be a recessed line portion having a certain color. Accordingly, the first portion 3643 may be recessed line portion and the second portion 3645 may be a recessed line portion. In another example, the third visual guide portion 3642 may include a plurality of weight ports (not shown) with a plurality of weight portions (not shown) received therein. Alternatively, the third visual guide portion 3642 may be defined by a raised portion of the top portion 3270. The third visual guide portion 3642 may be similar in many respects to any of the visual guide portions described herein. The apparatus, methods, and articles of manufacture described herein are not limited in this regard.

In one example, the remaining portions of the golf club head 3200 may be similar in many respects to the golf club head 2300 of FIGS. 23-31. For example, the face portion 3255 may include a face insert (not shown), which may be attached to the front portion 3250 with fasteners (not shown). In another example, the body portion 3210 may include an interior cavity (not shown) and a cover or sole plate (not shown) that may be attached to the sole portion 3280 with fasteners (not shown) to cover an opening (not shown) of the interior cavity. In another example, the interior cavity may be unfilled or filled partially or fully with a filler material. Alternatively, the golf club head 3200 may not be similar in many respects to the golf club head 2300 of FIGS. 23-31. The apparatus, methods, and articles of manufacture described herein are not limited in this regard.

Figure 40:
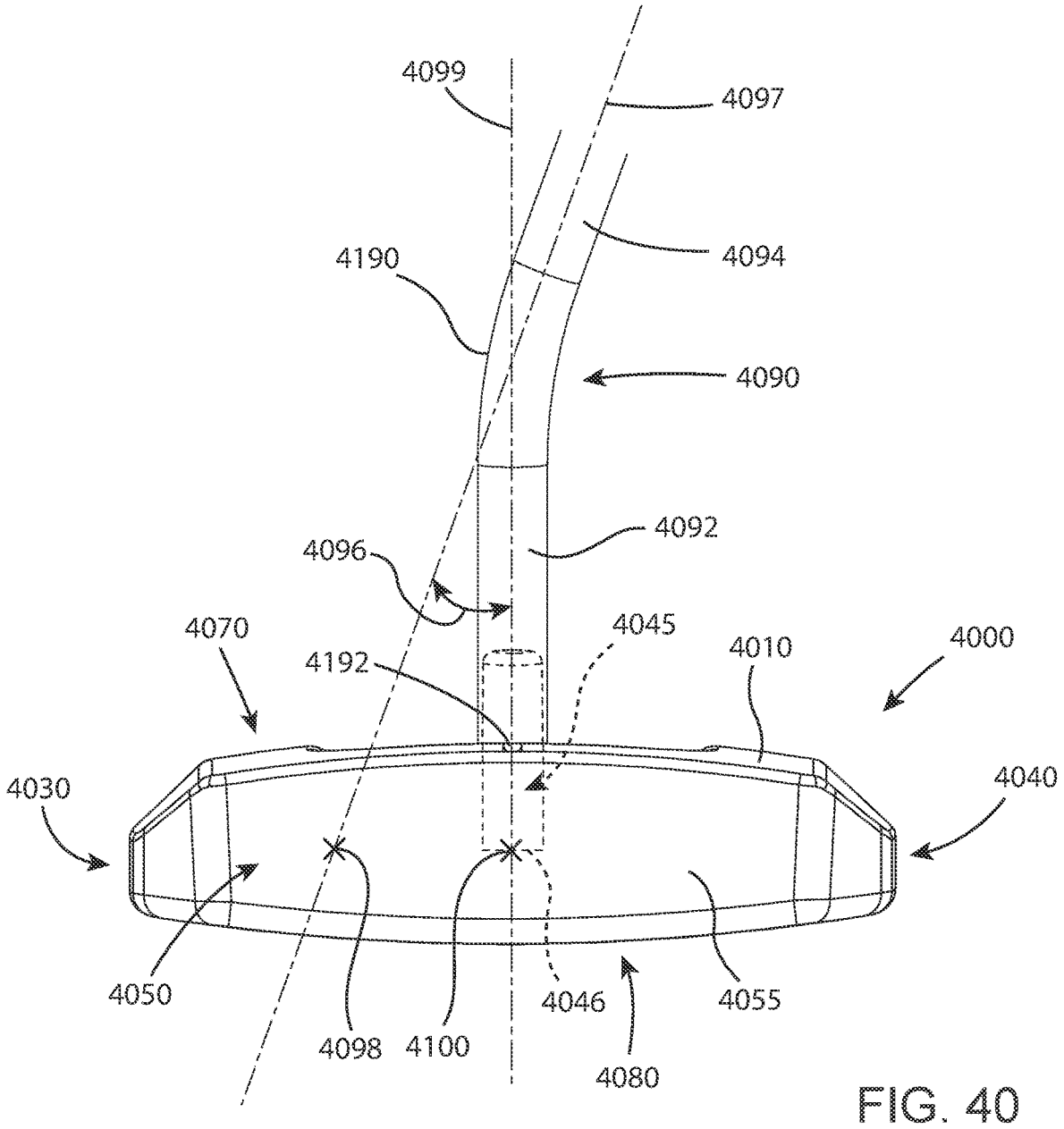
FIG. 40 depicts a front view of a golf club head according to an embodiment of the apparatus, methods, and articles of manufacture described herein.
Figure 41:
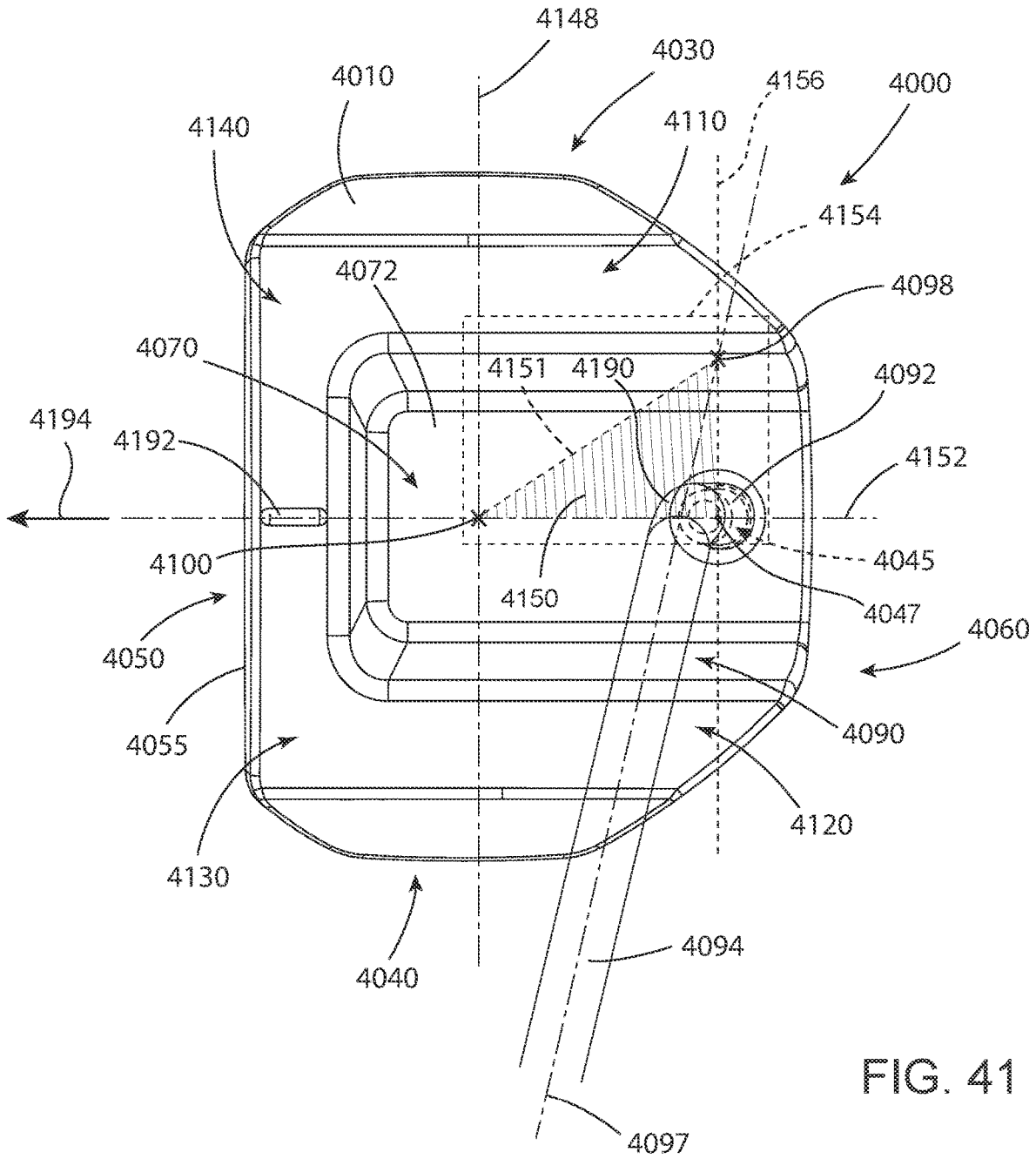
FIG. 41 depicts a top view of the example golf club head of FIG. 40.
Figure 42:
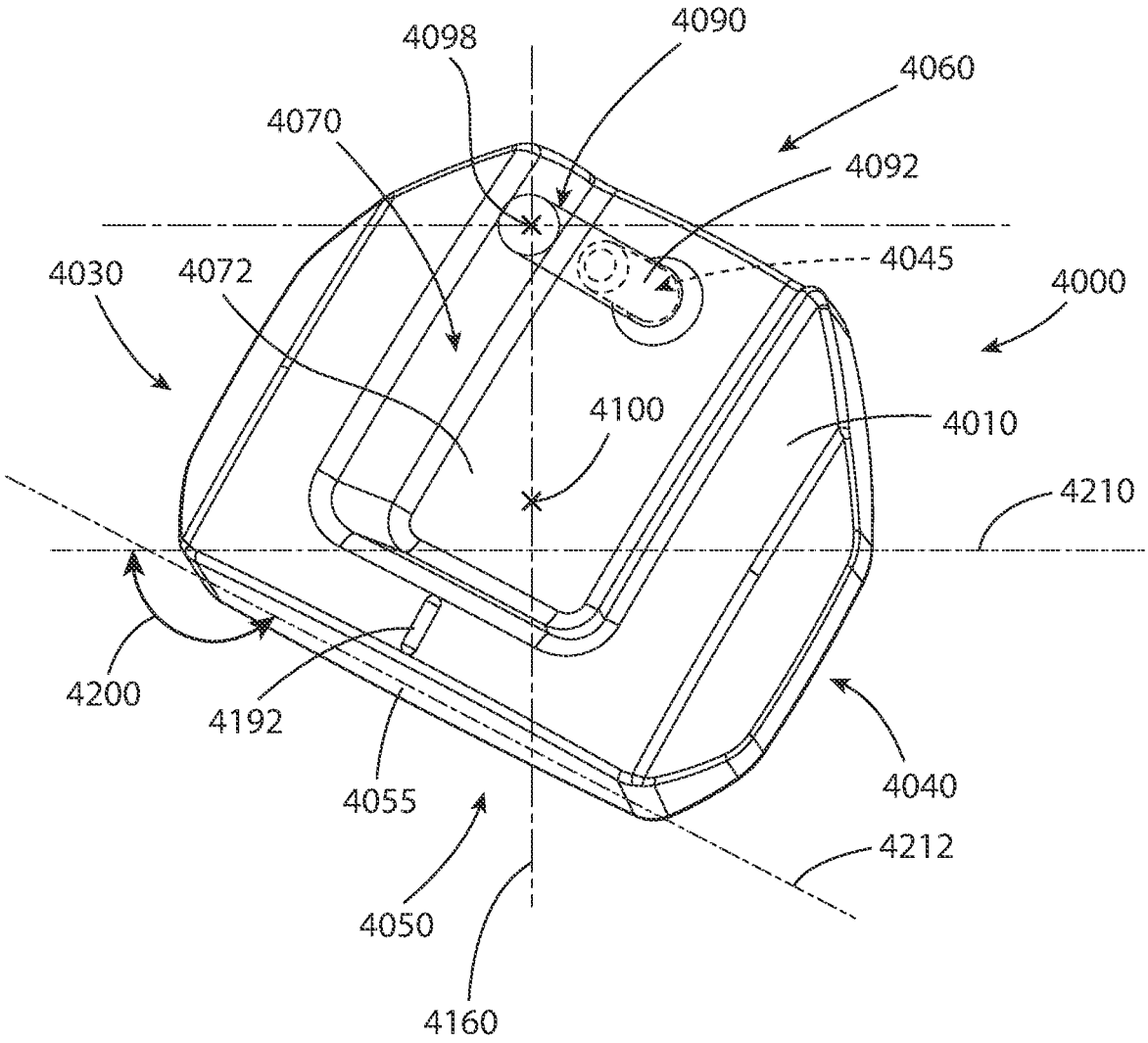
FIG. 42 depicts a top perspective view of the example golf club head of FIG. 40.

Referring to FIGS. 40-42, for example, a golf club head 4000 may include a body portion 4010 having a toe portion 4030, a heel portion 4040, a front portion 4050 with a face portion 4055, a rear portion 4060, a top portion 4070, and a sole portion 4080. In the example of FIGS. 40-42, the golf club head 4000 may include a hosel portion 4045 coupled to a shaft 4090 to form a golf club. Alternatively, the golf club head 4000 may include a bore to receive the shaft 4090. Although not shown in the example of FIGS. 40-42, the golf club head 4000 may include a plurality of weight ports, weight portions and/or visual guide portions that may be similar in many respects to other example golf club heads described herein. Furthermore, the golf club head 4000 may be similar in many respects including methods and materials of manufacture to any of the golf club heads described herein. Therefore, a detailed description of the various features of the golf club head 4000 that may be similar in many respects to any of the golf club heads described herein is not provided. The apparatus, methods, and articles of manufacture described herein are not limited in this regard.

The golf club head 4000 may be a putter-type golf club head (e.g., a blade-type putter, a mid-mallet-type putter, a mallet-type putter, etc.). Based on the type of putter as mentioned above, the body portion 4010 may be at least 200 grams. For example, the body portion 4010 may be in a range between 300 to 600 grams. Although FIGS. 40-42 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The golf club head 4000 may have a CG 4100. Referring to FIG. 41, the body portion 4010 may be divided into four quadrants based on the CG 4100. For example, the four quadrants may include a toe-rear quadrant 4110, a heel-rear quadrant 4120, a heel-front quadrant 4130 and a toe-front quadrant 4140. The front portion quadrants 4130 and 4140 and the rear portion quadrants 4110 and 4120 may be separated by a first plane 4148 that intersects the CG 4100 and extends laterally across body portion 4010. The first plane 4148 may be vertical and may be parallel or substantially parallel with the face portion 4055. The toe portion quadrants 4110 and 4140 and the heel portion quadrants 4120 and 4130 may be separated by a second plane 4152 that intersects the CG 4100 and is perpendicular or substantially perpendicular to the first plane 4148. The second plane 4152 may be vertical and may extend in a fore- and aft direction to bisect the body portion 4010. In the example of FIGS. 40-42, the hosel portion 4045 may be provided at a recessed portion 4072 of the top portion 4070. The hosel portion 4045 may be centrally located behind the CG 4100 and aft of the body portion 4010. Accordingly, the hosel portion 4045 may be bisected by the second plane 4152 and may be equidistant from the toe portion 4030 and the heel portion 4040. Alternatively, the hosel portion 4045 may be located in the toe-rear quadrant 4110 or the heel-rear quadrant 4120. The hosel portion 4045 may have a forward tilt (e.g., toward the face portion 4055) with no lateral tilt toward the toe portion 4030 or the heel portion 4040. Alternatively, the hosel portion 4045 may be upright, substantially upright, or exhibit tilt in a direction toward the front portion 4050, the toe portion 4030, the heel portion 4040, the rear portion 4060, or any possible combination thereof. The apparatus, methods, and articles of manufacture described herein are not limited in this regard.

In the example of FIGS. 40-42, the shaft 4090 may include a first shaft portion 4092 and a second shaft portion 4094. The first shaft portion 4092 may be coupled to the hosel portion 4045. For example, the first shaft portion 4092 may receive the hosel portion 4045 therein to attach the shaft 4090 to the body portion 4010. In another example (not shown), the hosel portion 4045 may receive the first shaft portion 4092 therein. In yet another example (not shown), the first shaft portion 4092 may be received inside a bore formed in the body portion 4010. The second shaft portion 4094 may extend from the first shaft portion 4092 to a grip portion (not shown) that may be held by an individual using the golf club. The second shaft portion 4094 may have a center axis 4097 that forms a shaft angle 4096 with a center axis 4099 of the first shaft portion 4092. In one example, the center axis 4097 of the second shaft portion 4094 may intersect the body portion 4010 in the toe-rear quadrant 4110. The shaft angle 4096 may be in the range of about 15° to about 25°, and more preferably, may be 20° or about 20°. The center axis 4097 may pass through an intersection point 4098 at the same height as the CG 4100 in the toe-rear quadrant 4110. The quadrant location of the intersection point 4098 may be determined based on the location of the hosel portion 4045 relative to the CG 4100, the tilt of the hosel portion 4045, the length of the first shaft portion 4092, and/or the shaft angle 4096 between the first shaft portion 4092 and the second shaft portion 4094. Thus, while the intersection point 4098 may be described herein as having the same height as the CG 4100 and being located in the toe-rear quadrant 4110, the intersection point 4098 may otherwise be located at a different height as the CG 4100 and/or in a different quadrant than the toe-rear quadrant 4110. In one example, the intersection point 4098 may have a distance from the CG 4100 in the toe-heel direction of between about 0.1 inches (0.25 cm) and about 2.5 inches (6.4 cm). In one example, the intersection point 4098 may have a distance from the CG 4100 in the front-rear direction of between about 0.1 inches (0.25 cm) and about 2.5 inches (6.4 cm). The apparatus, methods, and articles of manufacture described herein are not limited in this regard.

The CG of a golf club head may be determined by placing the shaft of the golf club head on a flat and horizontal surface such as a tabletop with the golf club head extending or hanging from the flat surface and being allowed to rotate freely. The golf club head then freely rotates until a stable hanging position is reached, which corresponds to the CG of the golf club head being vertically below and aligned with the shaft axis. The angle of rotation of the toe of the golf club head measured between the face portion and the horizontal or the flat surface may be referred to as the toe hang angle. A face balanced putter has a toe hang angle of about 0°. In other words, the face portion of a face balanced putter remains horizontal when determining the CG of the putter as described. In the example of FIGS. 40-42, the shaft 4090 is connected aft of the body portion and behind the CG 4100 and the center axis 4097 of the second shaft portion 4094 passes through the toe-rear quadrant 4110 or intersects the body portion 4010 in the toe-rear quadrant 4110. As a result, the intersection point 4098 and the CG 4100 may be aligned vertically along a vertical line 4160 as shown in FIG. 42 and the golf club head 4000 may have a toe hang angle 4200 that may be greater than 90° and less than 180° as measured between the face portion 4055 (orientation of the face portion 4055 is illustrated in FIG. 42 with line 4212) and a horizontal axis 4210. The apparatus, methods, and articles of manufacture described herein are not limited in this regard.

As discussed herein, the hosel portion 4045 may have a forward tilt and the first shaft portion 4092 and the second shaft portion 4094 may be bent relative to each other to enable the center axis 4097 of the second shaft portion 4094 to intersect the body portion 4010 at a point (e.g., intersection point 4098) located behind the CG 4100 and aft of the body portion 4010. In one example, the CG 4100, the intersection point 4098, and a base portion 4046 of the hosel portion 4045 may all be located on a third plane 4154 located between the top portion 4070 and the sole portion 4080 and extending between the front portion 4050 and the rear portion 4060. The third plane 4154 may be horizontal or substantially horizontal and may be perpendicular or substantially perpendicular to the first and second planes 4148 and 4152. A line 4156 extending through the intersection point 4098 and a center point 4047 of the base portion 4046 may be parallel with the first plane 4148 and/or the face portion 4055. Accordingly, the intersection point 4098 and the center point 4047 may be the same distance from the face portion 4055. The CG 4100, the intersection point 4098, and the center point 4047 may each define a vertex of an imaginary right triangle 4150 having a hypotenuse 4151 formed between the CG 4100 and the intersection point 4098. The imaginary right triangle 4150 may coincide with the third plane 4154 and represents a balance profile of the golf club. Advantageously, a putter-type golf club employing the balance profile described herein may feel more stable or balanced during a putting stroke. Accordingly, less effort may be required to move the golf club along an intended path, and as a result, an individual using the golf club may experience greater success in keeping the golf club head along the intended path, thereby producing a more accurate strike onto a golf ball. In alternative examples, the feel (e.g., stability, balance) of a golf club may be selected by adopting a balance profile represented by a different geometric shape and/or positioned in a different spatial orientation relative the first, second, and third planes 4148, 4152, and 4154. This may be accomplished by varying one or more of the CG 4100 location, the hosel portion 4045 position, and the intersection point 4098 location. The apparatus, methods, and articles of manufacture described herein are not limited in this regard.

As an additional benefit, the first shaft portion 4092 and the second shaft portion 4094 may define a bent portion 4190 usable in conjunction with a visual guide portion 4192 adjacent the face portion 4055 and extending between the front and rear portions 4050 and 4060 to provide an alignment aid for an individual at an address position. The visual guide portion 4192 may be equidistant from the toe portion 4030 and the heel portion 4040 and may be bisected by the second plane 4152. In use, an individual may simply align the bent portion 4190 and the visual guide portion 4192 in a target direction (e.g., target direction 4194) to help square the face portion 4055 toward a target, and as such, benefit from improved accuracy when striking a golf ball with the golf club. The apparatus, methods, and articles of manufacture described herein are not limited in this regard.

Figure 43:
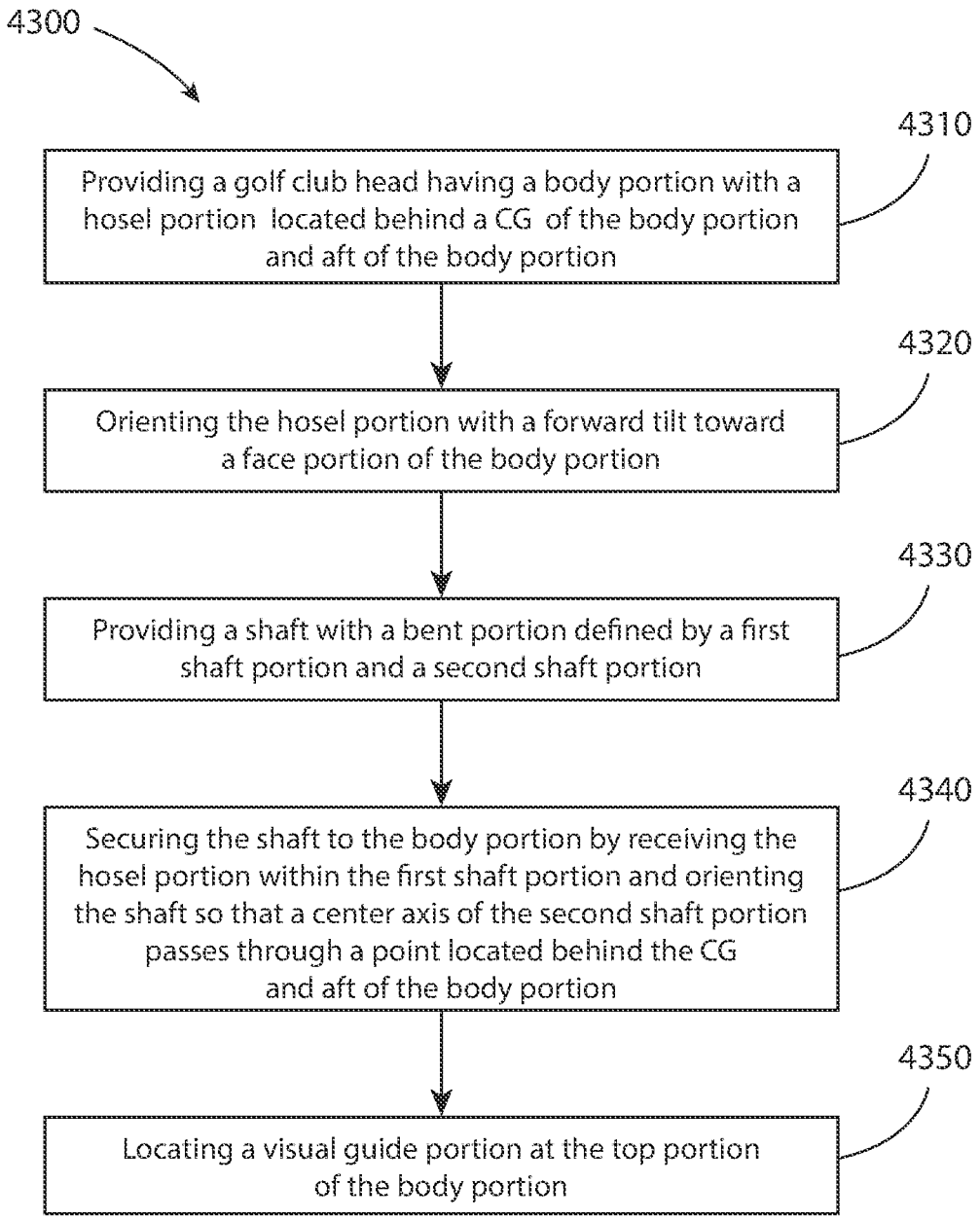
FIG. 43 depicts a method of assembling a golf club according to an example of the apparatus, methods, and articles of manufacture described herein.

In the example of FIG. 43, a method 4300 of assembling a golf club is generally shown. For purposes of illustration, the method 4300 is described herein with reference to the example golf club head 4000 and shaft 4090 shown in FIGS. 40-42. A golf club head (e.g., golf club head 4000) may be provided having a body portion with a hosel portion located behind a CG of the body portion and aft with respect thereto (block 4310). The hosel portion may be oriented with a forward tilt toward a face portion of the body portion (block 4320). In one example, the hosel portion may be oriented with no lateral tilt toward the toe portion or the heel portion. A shaft (e.g., shaft 4090) may be provided with a bent portion defined by a first shaft portion and a second shaft portion (block 4330). As described herein, the first shaft portion and the second shaft portion may each have a corresponding center axis that form a shaft angle therebetween. The shaft may be secured to the body portion by receiving the hosel portion within the first shaft portion and orienting the shaft so that the center axis of the second shaft portion passes through a point located behind the CG and aft of the body portion (block 4340). As described herein, the point may have the same height as the CG and may be located in a toe-rear quadrant of the body portion. In alternative examples, the point may be located in other quadrants or behind the body portion altogether. A visual guide portion may be located at a top portion of the body portion (block 4350). As described herein, the visual guide portion may be aligned with the bent portion of the shaft in a target direction to assist an individual in squaring the golf club to a golf ball at an address position. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, any of the golf club heads described herein may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of the golf club head. The club identifier may be a trademark to identify a brand or a model of the golf club head. The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion, the face portion, the sole portion etc.) using various methods (e.g., painted, laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club comprising:

a golf club head comprising a body portion having a toe portion, a heel portion, a front portion, a rear portion, a top portion, a sole portion, a face portion at the front portion, and a center of gravity;

a recessed portion in the top portion, the recessed portion extending from a rear surface of the rear portion toward the face portion, the recessed portion located between a top surface of the top portion and a sole surface of the sole portion;

a hosel portion extending upward from the recessed portion and tilted toward the face portion, the hosel portion positioned rearward of the center of gravity of the body portion, the hosel portion being located closer to the rear surface than to the face portion, the hosel portion being equidistant from the toe portion and from the heel portion; and a shaft coupled to the hosel portion and having a first shaft portion and a second shaft portion, the first shaft portion extending from the hosel portion and tilted toward the face portion with no lateral tilt toward the toe portion or the heel portion, the second shaft portion extending from the first shaft portion toward the heel portion and toward the face portion, the second shaft portion having a center axis that forms a non-zero angle with a center axis of the first shaft portion, wherein the center axis of the second shaft portion passes through the body portion at an intersection point located rearward of the center of gravity, and wherein the intersection point is located about 0.1 inch (0.25 cm) to 2.5 inches (6.4 cm) from the center of gravity in both a toe-to-heel direction and a front-to-rear direction.

2. A golf club as defined in claim 1, wherein the center axis of the first shaft portion and the center of gravity are located on a vertical plane that bisects the body portion in a front-to-rear direction.

3. A golf club as defined in claim 1 further comprising a visual guide portion on the top surface, the visual guide portion aligned with a target direction of the golf club.

4. A golf club as defined in claim 1 further comprising a visual guide portion on the top surface, the visual guide portion aligned with a target direction of the golf club, wherein the center axis of the first shaft portion and the center of gravity are located on a vertical plane that bisects the body portion in a front-to-rear direction and bisects the visual guide portion.

5. A golf club as defined in claim 1, wherein the center of gravity, the intersection point, and a base portion of the hosel portion are located on a horizontal plane between the top surface and the sole surface.

6. A golf club as defined in claim 1 further comprising a grip attached to the second shaft portion.

7. A golf club comprising:

a golf club head comprising a body portion having a toe portion, a heel portion, a front portion, a rear portion, a top portion, a sole portion, a face portion at the front portion, and a center of gravity;

a hosel portion extending upward from the top portion and tilted toward the face portion, the hosel portion positioned rearward of the center of gravity of the body portion, the hosel portion being located closer to a rear surface of the rear portion than to the face portion, the hosel portion being equidistant from the toe portion and from the heel portion;

a shaft coupled to the hosel portion and having a first shaft portion and a second shaft portion, the first shaft portion extending from the hosel portion and tilted toward the face portion with no lateral tilt toward the toe portion or the heel portion, the second shaft portion extending from the first shaft portion toward the heel portion and toward the face portion, the second shaft portion having a center axis that forms a non-zero angle with a center axis of the first shaft portion; and a visual guide portion on the top portion, the visual guide portion aligned with a target direction of the golf club, wherein the center axis of the first shaft portion and the center of gravity are located on a vertical plane that bisects the body portion in a front-to-rear direction and bisects the visual guide portion, and wherein the center of gravity is located closer to the visual guide portion than to the hosel portion.

8. A golf club as defined in claim 7, wherein the center of gravity is located closer to a forward most point of the front portion than to a rearward most point of the rear portion.

9. A golf club as defined in claim 7, wherein the center axis of the second shaft portion passes through the body portion at an intersection point located rearward of the center of gravity, and wherein the center of gravity is located closer to the visual guide portion than to the intersection point.

10. A golf club as defined in claim 7, wherein the center axis of the second shaft portion passes through the body portion at an intersection point located rearward of the center of gravity, and wherein the center of gravity, the intersection point, and a base portion of the hosel portion are located on a horizontal plane between a top surface of the top portion and a sole surface of the sole portion.

11. A golf club as defined in claim 7, wherein the center axis of the second shaft portion passes through the body portion at an intersection point located rearward of the center of gravity, and wherein the intersection point is located about 0.1 inch (0.25 cm) to 2.5 inches (6.4 cm) from the center of gravity in both a toe-to-heel direction and a front-to-rear direction.

12. A golf club as defined in claim 7 further comprising a grip attached to the second shaft portion.

13. A golf club comprising:

a golf club head comprising a body portion having a toe portion, a heel portion, a front portion, a rear portion, a top portion, a sole portion, a face portion at the front portion, and a center of gravity;

a hosel portion extending upward from the top portion and tilted toward the face portion, the hosel portion positioned rearward of the center of gravity of the body portion, the hosel portion being located closer to a rear surface of the rear portion than to the face portion, the hosel portion being equidistant from the toe portion and from the heel portion; and a shaft coupled to the hosel portion and having a first shaft portion and a second shaft portion, the first shaft portion extending from the hosel portion and tilted toward the face portion with no lateral tilt toward the toe portion or the heel portion, the second shaft portion extending from the first shaft portion toward the heel portion and toward the face portion, the second shaft portion having a center axis that forms a non-zero angle with a center axis of the first shaft portion, wherein the center axis of the first shaft portion and the center of gravity are located on a vertical plane that bisects the body portion in a front-to-rear direction, wherein the center axis of the second shaft portion passes through the body portion at an intersection point located rearward of the center of gravity, and wherein the intersection point is located about 0.1 inch (0.25 cm) to 2.5 inches (6.4 cm) from the center of gravity in both a toe-to-heel direction and a front-to-rear direction.

14. A golf club as defined in claim 13 further comprising a visual guide portion on a top surface of the top portion, the visual guide portion located proximate to the face portion, the visual guide portion aligned with a target direction of the golf club, the visual guide portion being bisected by the vertical plane.

15. A golf club as defined in claim 13 further comprising a visual guide portion on the top portion, the visual guide portion aligned with a target direction of the golf club, wherein the center axis of the first shaft portion and the center of gravity are located on a vertical plane that bisects the body portion in a front-to-rear direction and bisects the visual guide portion.

16. A golf club as defined in claim 13, wherein the center axis of the second shaft portion passes through the body portion at an intersection point located rearward of the center of gravity, and wherein the center of gravity, the intersection point, and a base portion of the hosel portion are located on a horizontal plane between a top surface of the top portion and a sole surface of the sole portion.

17. A golf club as defined in claim 13 further comprising a grip attached to the second shaft portion.

* * * * *